US011007102B2

(12) United States Patent
Patmore et al.

(10) Patent No.: US 11,007,102 B2
(45) Date of Patent: May 18, 2021

(54) PATIENT TRANSPORT SYSTEM

(71) Applicant: Stryker Corporation, Kalamazoo, MI (US)

(72) Inventors: Kevin M. Patmore, Plainwell, MI (US); Sarah Mynhier, Seattle, WA (US); Adam Dudycha, Paw Paw, MI (US); Bryce Porter, Grand Rapids, MI (US); Donald S. Strum, Princeton, NJ (US); Yuka Midorikawa-Haelters, Langhorne, PA (US); Matthew Schmitt, Skillman, NJ (US); William Robert Parcells, Princeton, NJ (US)

(73) Assignee: Stryker Corporation, Kalamazoo, MI (US)

( * ) Notice: Subject to any disclaimer, the term of this patent is extended or adjusted under 35 U.S.C. 154(b) by 224 days.

(21) Appl. No.: 16/108,695

(22) Filed: Aug. 22, 2018

(65) Prior Publication Data

US 2019/0060149 A1 Feb. 28, 2019

Related U.S. Application Data

(60) Provisional application No. 62/548,687, filed on Aug. 22, 2017.

(51) Int. Cl.
*A61G 7/10* (2006.01)
*A61G 7/05* (2006.01)

(52) U.S. Cl.
CPC ..... *A61G 7/1046* (2013.01); *A61G 7/05* (2013.01); *A61G 7/0503* (2013.01); *A61G 7/1057* (2013.01); *A61G 2203/80* (2013.01)

(58) Field of Classification Search
CPC ..... A61G 7/1046; A61G 7/05; A61G 7/0503; A61G 7/1057; A61G 2203/80; A61G 2203/78; A61G 13/101
See application file for complete search history.

(56) References Cited

U.S. PATENT DOCUMENTS 3,179,431 A 4/1965 Pikl
3,191,953 A 6/1965 Kysta
(Continued)

FOREIGN PATENT DOCUMENTS

AU 2012211373 A1 3/2013
CN 101947013 1/2011
(Continued)

OTHER PUBLICATIONS

Indi, "Stair Climbing Robot—Group 11—Report", 2015-2016, Industrieel Ingenieur in Brussel Student and Project Blog, http://fablab.hylas.be/blog/stair-climbing-robot-group-11/, 5 pages.
(Continued)

*Primary Examiner* — Robert G Santos
*Assistant Examiner* — Rahib T Zaman
(74) *Attorney, Agent, or Firm* — Howard & Howard Attorneys PLLC

(57) ABSTRACT

A patient transport system comprising a patient support apparatus and a wheeled accessory. The wheeled accessory comprises an accessory base and at least two legs radially extending outwardly from the accessory base. The legs are spaced apart from one another to define an accommodation space between two legs. The patient support apparatus comprises a patient support base, and wheels coupled to the patient support base. The patient support apparatus further comprises an accessory coupler capable of releasably securing the wheeled accessory to the patient support apparatus, the accessory coupler movable relative to the patient support base into first and second positions. The accessory base and the patient support apparatus are configured such that at least one of the wheels is at least partially nested within the accommodation space when the wheeled accessory is secured to the accessory coupler and the accessory coupler is in the first position.

13 Claims, 33 Drawing Sheets

(56) References Cited

U.S. PATENT DOCUMENTS 4,332,378 A 6/1982 Pryor
4,511,157 A * 4/1985 Wilt, Jr. ..... A61G 5/10 280/304.1
4,511,158 A * 4/1985 Varga ..... A61G 7/05 248/229.11
4,572,536 A 2/1986 Doughty
4,600,209 A 7/1986 Kerr, Jr.
4,725,027 A 2/1988 Bekanich
4,767,131 A * 8/1988 Springer ..... A61G 5/10 248/316.2
4,832,294 A 5/1989 Eidem
4,840,391 A * 6/1989 Schneider ..... A61G 5/10 248/121
4,886,237 A * 12/1989 Dennis ..... A61G 7/05 248/289.11
4,892,279 A 1/1990 Lafferty et al.
4,905,944 A 3/1990 Jost et al.
4,945,592 A * 8/1990 Sims ..... A61G 7/05 248/129
4,966,340 A * 10/1990 Hunter ..... A61G 7/05 248/125.8
4,969,768 A * 11/1990 Young ..... A61G 5/10 403/24
5,009,442 A * 4/1991 Schneider ..... C07D 233/64 280/304.1
5,083,807 A * 1/1992 Bobb ..... A61G 5/10 248/231.51
5,110,076 A 5/1992 Snyder et al.
5,112,019 A 5/1992 Metzler et al.
5,117,521 A 6/1992 Foster et al.
5,125,607 A 6/1992 Pryor
5,135,191 A 8/1992 Schmuhl
5,149,036 A * 9/1992 Sheehan ..... A61G 7/0503 248/215
5,172,927 A 12/1992 Bobb et al.
5,188,323 A 2/1993 David
5,219,139 A * 6/1993 Hertzler ..... A61G 5/10 248/276.1
5,236,213 A 8/1993 Trickett
5,288,093 A 2/1994 Gross
5,292,094 A 3/1994 VanKuiken
5,319,816 A 6/1994 Ruehl
5,337,992 A 8/1994 Pryor et al.
5,355,539 A 10/1994 Boettger
5,374,074 A 12/1994 Smith
5,421,548 A * 6/1995 Bennett ..... A61G 5/10 248/129
5,457,831 A 10/1995 Foster et al.
5,458,305 A 10/1995 Woodward
5,475,884 A 12/1995 Kirmse et al.
5,479,953 A 1/1996 Pasulka
5,501,419 A 3/1996 Huang
5,509,680 A 4/1996 Scharf et al.
5,513,406 A 5/1996 Foster et al.
5,551,105 A 9/1996 Short
5,556,065 A 9/1996 Wadley
D377,282 S 1/1997 Chen
5,699,988 A 12/1997 Boettger et al.
5,704,577 A 1/1998 Gordon
5,820,086 A 10/1998 Holtman et al.
5,857,685 A 1/1999 Phillips et al.
5,890,687 A 4/1999 Pryor et al.
5,898,961 A 5/1999 Ambach et al.
5,924,658 A 7/1999 Shiery et al.
5,966,760 A 10/1999 Gallant et al.
5,987,670 A * 11/1999 Sims ..... A61G 7/05 5/503.1
6,056,249 A 5/2000 Fillon, Jr.
6,073,285 A 6/2000 Ambach et al.
6,079,678 A * 6/2000 Schott ..... A61G 7/05 248/125.1
6,179,260 B1 * 1/2001 Ohanian ..... A61G 7/05 248/219.4
6,183,417 B1 2/2001 Geheb et al.
6,360,389 B1 3/2002 Gallant et al.
6,390,311 B1 5/2002 Belokin
6,585,206 B2 7/2003 Metz et al.
6,619,599 B2 9/2003 Elliott et al.
6,708,991 B1 3/2004 Ortlieb
D503,052 S 3/2005 Chi
6,966,086 B2 11/2005 Metz et al.
6,969,031 B2 11/2005 Ugent et al.
7,314,200 B2 1/2008 Bally et al.
7,412,735 B2 8/2008 McDaniel et al.
7,418,749 B2 9/2008 Graham et al.
7,497,407 B2 3/2009 Blankenship et al.
7,533,428 B2 5/2009 Yunker
7,556,226 B2 7/2009 Muncie
7,570,152 B2 8/2009 Smith et al.
D606,202 S 12/2009 Banryu
7,624,463 B2 * 12/2009 Graham ..... A61G 7/0503 5/600
7,624,953 B2 12/2009 Silverman et al.
7,636,966 B2 12/2009 Gallant et al.
7,637,464 B2 * 12/2009 Heimbrock ..... A61G 1/04 248/218.4
7,641,158 B2 1/2010 Ferguson
7,731,136 B1 6/2010 Chisolm et al.
7,735,788 B2 * 6/2010 Newkirk ..... A61G 7/0503 248/129
7,735,789 B2 6/2010 Blankenship et al.
7,793,902 B2 9/2010 Buchanan et al.
7,802,764 B2 9/2010 Leinen
7,845,601 B1 * 12/2010 Culpepper ..... A61M 5/1418 248/125.2
7,865,983 B2 1/2011 Newkirk et al.
7,874,410 B2 1/2011 Fulbrook et al.
7,896,298 B2 3/2011 Meyers et al.
7,918,422 B2 4/2011 Blankenship et al.
8,056,162 B2 11/2011 Newkirk et al.
8,075,513 B2 12/2011 Rudko et al.
8,100,371 B2 1/2012 Eggleston et al.
8,104,729 B2 1/2012 Walke et al.
8,136,773 B2 3/2012 Schmutzer et al.
8,152,181 B2 4/2012 Tomlinson
8,191,909 B2 6/2012 Livengood et al.
8,196,874 B2 6/2012 Zitting et al.
8,258,973 B2 9/2012 Newkirk
8,292,310 B2 * 10/2012 Turner ..... A61H 3/04 280/47.35
8,292,656 B2 10/2012 Mydlarz
8,313,066 B2 11/2012 Hampton et al.
8,313,067 B2 11/2012 Knieriem et al.
8,334,779 B2 12/2012 Zerhusen et al.
8,403,275 B2 3/2013 Cote
8,516,637 B2 8/2013 Karwal et al.
8,534,616 B2 9/2013 Schmutzer et al.
8,539,640 B1 9/2013 Waggener
8,567,730 B1 10/2013 Stevenson
8,650,710 B1 2/2014 Waggener
8,657,241 B2 2/2014 Zitting et al.
8,684,375 B2 4/2014 Fink et al.
8,733,719 B2 5/2014 Gaal et al.
8,747,764 B1 6/2014 Burchman et al.
8,752,799 B2 6/2014 Johnson
8,756,078 B2 6/2014 Collins, Jr. et al.
RE45,058 E * 8/2014 Blankenship ..... A61M 5/1414 248/129
8,826,475 B2 9/2014 Jackson
8,827,215 B2 * 9/2014 Hilton ..... F16B 2/10 248/121
8,857,920 B2 10/2014 Wollborg
8,910,344 B2 12/2014 Nguyen et al.
9,033,349 B2 5/2015 Graves et al.
9,289,336 B2 3/2016 Lambarth et al.
9,528,536 B2 12/2016 Bally et al.
9,569,591 B2 2/2017 Vanderpohl, III
D783,837 S 4/2017 Janzen
2002/0096608 A1 7/2002 Cedarberg
2004/0011941 A1 1/2004 Roepke et al.
2004/0075228 A1 4/2004 Duffey
2004/0201191 A1 10/2004 Jacques et al.

(56) References Cited

U.S. PATENT DOCUMENTS

| | | | | |
|---|---|---|---|---|
| 2005/0006538 | A1 | 1/2005 | Turi et al. | |
| 2005/0017468 | A1 | 1/2005 | Gallant et al. | |
| 2005/0139736 | A1 | 6/2005 | Breda et al. | |
| 2005/0230575 | A1 | 10/2005 | Zelenski et al. | |
| 2006/0179571 | A1 | 8/2006 | Newkirk | |
| 2006/0249635 | A1 | 11/2006 | Newkirk et al. | |
| 2007/0023587 | A1* | 2/2007 | Eggleston | A61G 12/008 248/98 |
| 2007/0159772 | A1 | 7/2007 | Morice | |
| 2008/0234555 | A1 | 9/2008 | Lafleche et al. | |
| 2009/0261215 | A1 | 10/2009 | Lambert | |
| 2009/0294604 | A1* | 12/2009 | Sunderland | A61M 5/1415 248/124.1 |
| 2009/0321589 | A1 | 12/2009 | Hampton et al. | |
| 2010/0006711 | A1 | 1/2010 | Roth | |
| 2010/0154124 | A1 | 6/2010 | Zerhusen et al. | |
| 2013/0037663 | A1 | 2/2013 | Walther et al. | |
| 2013/0181100 | A1* | 7/2013 | Blankenship | A61M 5/1413 248/129 |
| 2013/0228997 | A1 | 9/2013 | Fukuhara et al. | |
| 2013/0280755 | A1 | 10/2013 | Hubert | |
| 2013/0292521 | A1 | 11/2013 | Chepurny | |
| 2014/0080413 | A1 | 3/2014 | Hayes et al. | |
| 2014/0166828 | A1 | 6/2014 | Zitting et al. | |
| 2014/0209550 | A1 | 7/2014 | Pryor et al. | |
| 2014/0259837 | A1* | 9/2014 | Belliveau | A61M 5/1417 40/673 |
| 2014/0297327 | A1 | 10/2014 | Heil et al. | |
| 2014/0361129 | A1 | 12/2014 | Gomez | |
| 2014/0367540 | A1 | 12/2014 | Gaal et al. | |
| 2015/0059150 | A1 | 3/2015 | Hilton | |
| 2015/0157522 | A1* | 6/2015 | Blankenship | A61G 12/008 224/547 |
| 2015/0216606 | A1 | 8/2015 | Bally et al. | |
| 2015/0257952 | A1 | 9/2015 | Zerhusen et al. | |
| 2016/0000995 | A1* | 1/2016 | Blankenship | F16M 11/2014 248/514 |
| 2016/0022039 | A1 | 1/2016 | Paul et al. | |
| 2016/0022900 | A1* | 1/2016 | Pryor | A61M 5/1414 248/218.4 |
| 2016/0128468 | A1 | 5/2016 | Lafleche et al. | |
| 2016/0157951 | A1 | 6/2016 | Schoenig et al. | |
| 2016/0166216 | A1 | 6/2016 | Igney et al. | |
| 2016/0302982 | A1* | 10/2016 | Blankenship | A61M 5/1413 |
| 2017/0027789 | A1 | 2/2017 | St.John et al. | |

FOREIGN PATENT DOCUMENTS

| | | | |
|---|---|---|---|
| CN | 101947013 | A | 1/2011 |
| EP | 1032350 | B1 | 2/2002 |
| EP | 1690517 | A2 | 8/2006 |
| EP | 1772291 | A1 | 4/2007 |
| EP | 2688445 | A1 | 1/2014 |
| EP | 2688445 | A4 | 9/2014 |
| EP | 2416822 | B1 | 3/2015 |
| IN | 238758 | | 11/2011 |
| JP | 2006-288774 | | 10/2006 |
| JP | 2006288774 | A | 10/2006 |
| KR | 2013-0076922 | | 7/2013 |
| KR | 20130076922 | A | 7/2013 |
| WO | 2005051278 | A1 | 6/2005 |
| WO | WO 2005/051278 | | 6/2005 |
| WO | 2011055173 | A1 | 5/2011 |
| WO | 2012135118 | A1 | 10/2012 |
| WO | 2013078481 | A1 | 5/2013 |
| WO | 2015031394 | A1 | 3/2015 |
| WO | 2015106232 | A1 | 7/2015 |
| WO | 2016167917 | A1 | 10/2016 |

OTHER PUBLICATIONS

IVEA, "IVEA Patient Ambulation Webpage,"http://www.iveamobility.com/, 2018, 6 pages.

Maker Works, "Reinventing the Wheelchair: Making the First Human-Powered, Stair-Climbing Wheelchair", Aug. 20, 2015, http://old.maker-works.com/reinventing-the-wheelchair-making-the-first-human-powered-stair-climbing-wheelchair/, 4 pages.

Robotmesh, "Vex 6' Wheel Leg (4-Pack)", 2017, https://store.robotmesh.com/vex-robotics/wheels/vex-6inch-wheel-legs, 1 page.

Thring, Meredith, "Walking Wheel Stair Climbers", Popular Mechanics, Jun. 1967, www.cybemeticzoo.com/walking-machines/1964c-walking-wheel-stair-climbers-meredith-thring . . . , 13 pages.

Wikipedia, "Pedrail Wheel", 2017, https://en.wikipedia.org/wiki/Pedrail_wheel, 3 pages.

Yongkang Jinding Machine Electricity Co. Ltd, "2015 The Latest Model Foldable Stair-Climbing Cart", 2015,<https://www.globalsources.com/si/AS/Yongkang-Jinding/6008847958447/pdtl/Stair-climbing-Cart/1140620092.htm>, 4 pages.

Youtube, "IVEA by Firefly Medical Video Preview-Short Version", Oct. 5, 2015, https://www.youtube.com/watch?v=GQSWUWODaEl, 2 pages.

alibaba.com, "GGATC GOGO Medical Electric Stair Climbing Wheelchair", https://ggatc.en.alibaba.com/product/60612659679-805028073/Electric_stair_climbing_wheelchair_price_with_three_big_wheels_For_Old_People_And_Emer.html, 2019, 2 pages.

Global Industrial, "Vestil Steel Stair-Climbing Hand Truck ST-TRUCK-300", 2019, https://www.globalindustrial.com/p/material-handling/hand-trucks-dollies/hand-trucks-steel/steel-stair-climbing-hand-truck-300-lb-capacity?infoParam.campaignId=T9F&gclid=EAlalQobChMlind1qOM4wlV2rjACh1s_QPHEAQYBCABEgL4RPD_BwE, 2 pages.

Wikipedia, "Omni Wheel", 2019, https://en.m.wikipedia.org/wiki/Omni_wheel, 4 pages.

Stryker, "Mistral-Air Forced Air Warming System Brochure", Dec. 12, 2013, Rev. C, 6 pages.

Stryker, "Mistral-Air Forced Air Warming System Webpage", https://patienthandling.stryker.com/en/products/temperature-management, 2018, 7 pages.

Stryker Medical, "Patient Care & Handling Equipment Summer Catalog", 2010, 19 pages.

Alco, "Alco Clamp for IV Poles Photo", 2016, 1 page.

English language abstract for CN 101947013 extracted from espacenet.com database on Sep. 20, 2018, 1 page.

English language abstract and machine-assisted English translation for JP 2006-288774 extracted from espacenet.com database on Sep. 20, 2018; 8 pages.

English language abstract and machine-assisted English translation for KR 2013-0076922 extracted from espacenet.com database on Sep. 20, 2018, 8 pages.

English language abstract and machine-assisted English translation for WO 2005/051278 extracted from espacenet.com database on Sep. 20, 2018, 7 pages.

Hill-Rom, "Affinity Three Birthing Bed and Affinity Four Birthing Bed User Manual", USR025, Rev. 6, 2013, pp. 1-58.

Hill-Rom, "The Hill-Rom Latitude Arm System Brochure", Jul. 11, 2005, 4 pages.

"Integrated Stretcher Pole IV Connector Photo", 2016, 1 page.

NXTHEALTH, "Patient Companion Webpage", http://nxthealth.org/patient-companion, 2016, 1 page.

Pedigo, "Pedigo IV Caddy Photo", 2016, 1 page.

Skytron, "Streamline IV Suspension System Brochure", Feb. 2018, 8 pages.

* cited by examiner

FIG. 19
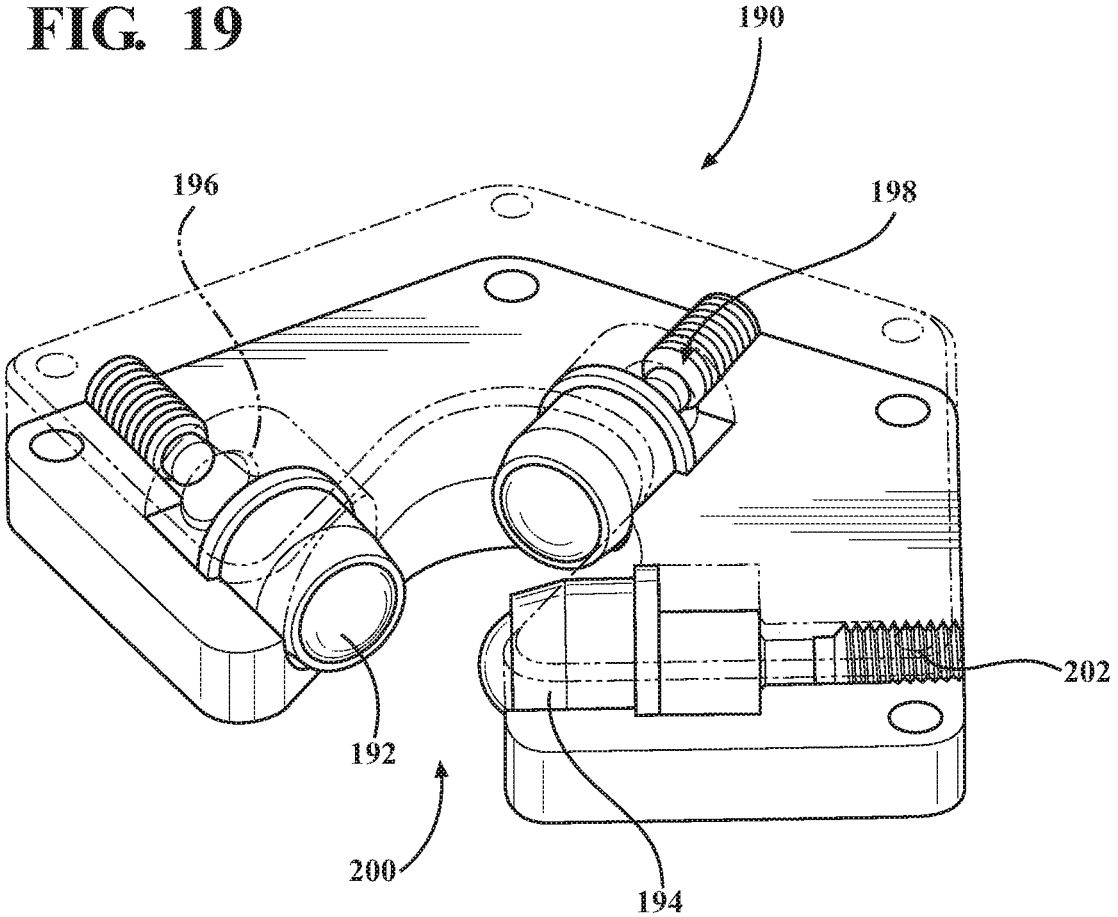
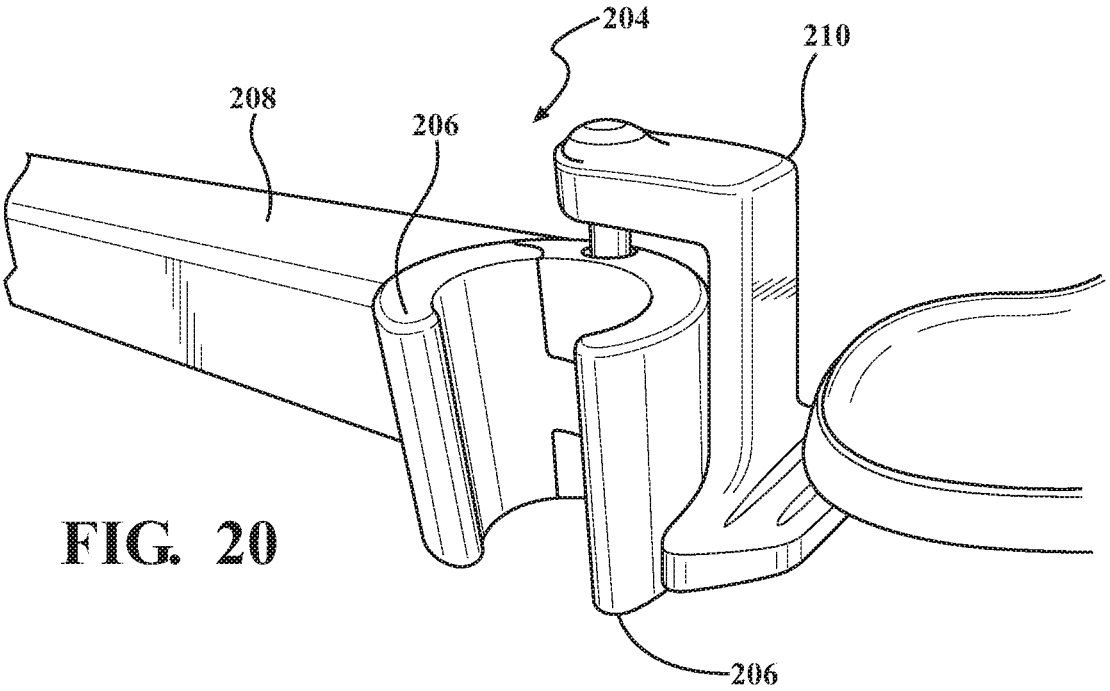
FIG. 20

PATIENT TRANSPORT SYSTEM

CROSS-REFERENCE TO RELATED APPLICATIONS

The subject patent application claims priority to and all the benefits of U.S. Provisional Patent Application No. 62/548,687 which was filed on Aug. 22, 2017, the disclosure of which is hereby incorporated by reference.

BACKGROUND

Patient support apparatuses, such as hospital beds, chairs, stretchers, cots, and tables, facilitate care of patients in a health care setting. Conventional patient support apparatuses comprise a patient support base, wheels coupled to the patient support base, and a litter frame upon which the patient is supported. The patient is able to be moved throughout the health care setting atop the patient support apparatus by a caregiver. Medical accessories, such as infusion pumps and intravenous (IV) fluids are used during care of the patient. In order to facilitate transport, the medical accessories are typically wheeled accessories comprising a wheeled base and an accessory support. Frequently, it is desirable to transport the wheeled accessories at the same time as the patient support apparatus, e.g. when the wheeled accessory is connected to the patient. Currently, a first caregiver is required to transport a typical patient support apparatuses and a second caregiver is required to move the wheeled accessory.

A patient transport system with a patient support apparatus and a wheeled accessory designed to overcome one or more of the aforementioned disadvantages is desired.

BRIEF DESCRIPTION OF THE DRAWINGS

Other advantages of the present invention will be readily appreciated as the same becomes better understood by reference to the following detailed description when considered in connection with the accompanying drawings.

FIG. 19 is a perspective view of another embodiment of an accessory coupler for securing to an accessory post of a wheeled accessory.

FIG. 20 is a perspective view of yet another embodiment of an accessory coupler for securing to an accessory post of a wheeled accessory.

DETAILED DESCRIPTION

Figure 1A:
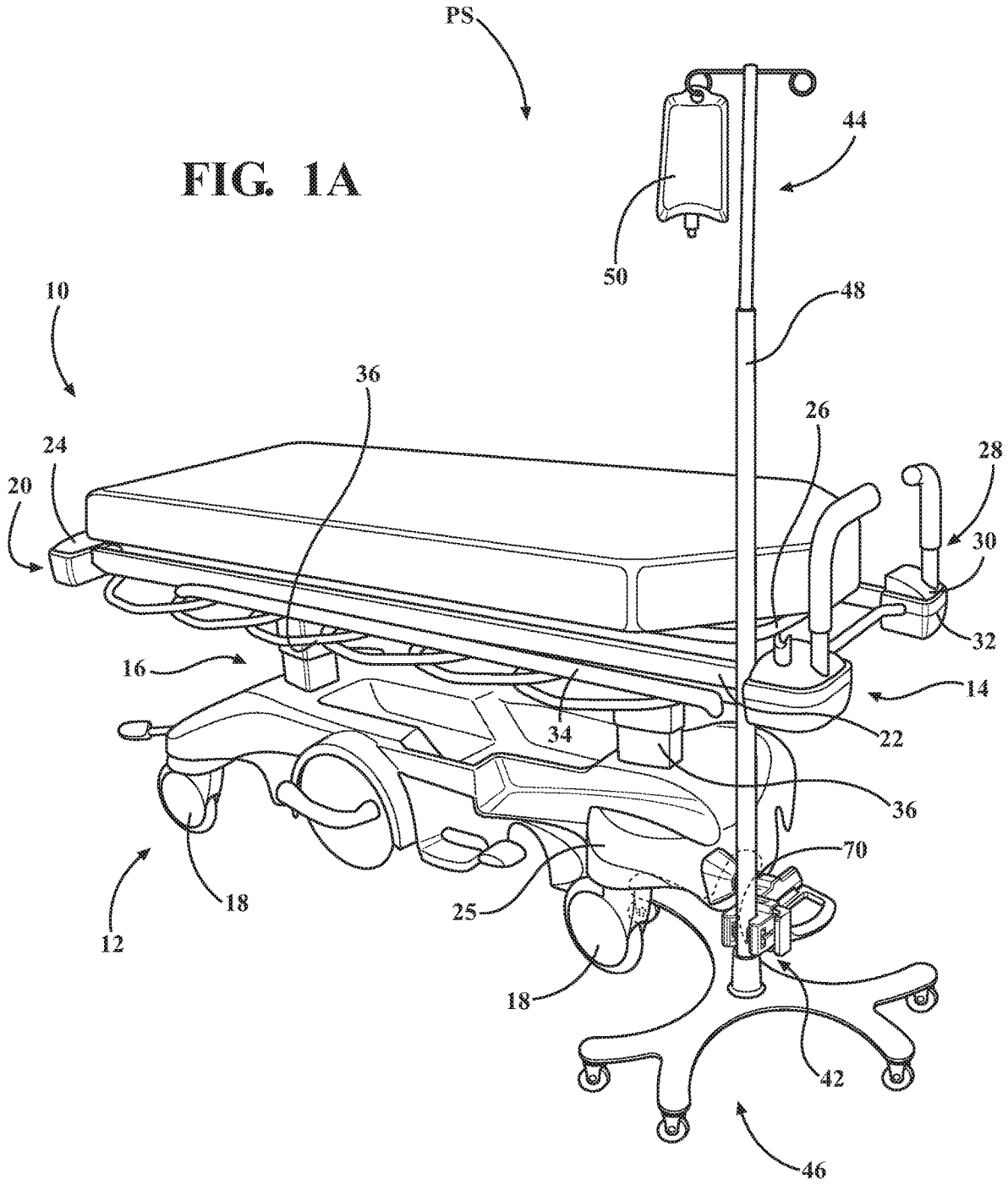
FIG. 1A is a perspective view of one embodiment of a patient transport system, with an accessory coupler and wheeled accessory in a first position.

Certain terminology will be used in the following description for convenience in reference only and will not be limiting. The words "up", and "down", "right" and "left" will designate directions in the drawings to which reference is made. The words "in" and "out" will refer to directions toward and away from, respectively, the geometric center of the patient support apparatus and designated parts thereof. Such terminology will include derivatives and words of similar import.

Figure 1B:
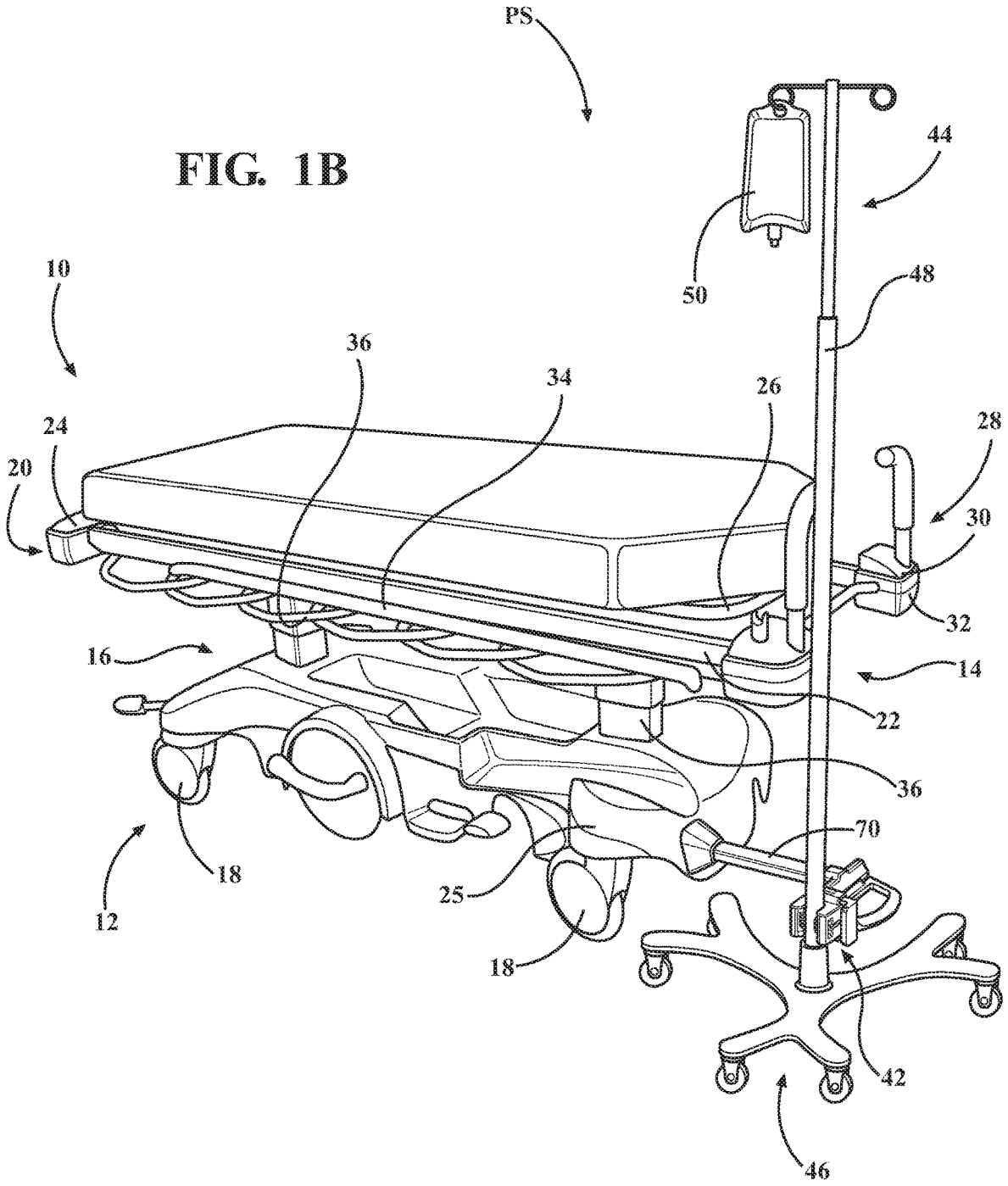
FIG. 1B is a perspective view of the patient transport system of FIG. 1A, with the accessory coupler and the wheeled accessory in a second position.

FIGS. 1A and 1B illustrate an exemplary patient support apparatus 10. In one embodiment, the patient support apparatus 10 comprises a patient support base 12, a litter 14 and a lift device 16 interconnecting the patient support base 12 to the litter 14 and being configured to effect a change in elevation of the litter 14 relative to the patient support base 12. The patient support apparatus 10 further comprises bed wheels 18 coupled to the patient support base 12. The configuration of the patient support apparatus 10 can be of many different varieties, one in particular being disclosed in U.S. Pat. No. 7,412,735, the disclosure of which is incorporated herein by reference.

In the illustrated embodiment, the patient support apparatus 10 is a hospital bed. It is contemplated, however, that the patient support apparatus 10 may be a chair, stretcher, cot, table, or similar apparatus utilized in the care of a patient.

The patient support base 12 and litter 14 each have a head end HE and a foot end FE corresponding to the designated placement of the patient's head and feet on the patient support apparatus 10. The construction of the patient support apparatus 10 may take on any known or conventional design, and is not limited to that specifically set forth above. In some instances, a mattress may be disposed on the patient support litter 14 such that the patient rests directly on the mattress, and the mattress defines a patient support surface.

The patient support litter 14 comprises a litter frame 20 which comprises a pair of laterally spaced, tubular longitudinal support rails 22 and at least two lateral support rails 24. The lateral support rails 24 interconnect the longitudinal support rails 22. Further, the lateral support rails 24 are supported on an extendable and retractable component of the aforementioned lift device 16.

The patient support base 12 may further comprise a base shroud 25. The base shroud 25 may provide a more aesthetic appearance, and may enable easier cleaning. The base shroud 25 comprises plastic in one embodiment.

A patient support deck 26 is mounted on the litter 14, and may comprise pivotally adjustable sections, such as head, seat, thigh, and foot sections. Of course, any number of pivotally adjustable sections are contemplated. The patient support deck 26 may define a patient support surface.

The litter frame 20 has a rectangular configuration and each corner may be provided with a bumper 28. Bumpers 28 are secured to corners at the head end HE of the litter frame 20 and to corners at the foot end FE of the litter frame 20. The bumpers 28 are configured on the litter frame 20 to overhang the litter frame 20. The bumpers 28 provide protection to the litter frame 20 in the event that a collision occurs while moving the patient support apparatus 10.

Each bumper 28 may comprise a bumper frame 30 secured to each of the longitudinal support rails 22 at the head ends HE thereof. The bumper frames 30 are generally rectangular, however other shapes such as L-shaped are considered. In order to absorb energy from impacts with other objects such as walls, doors, or other patient transport apparatuses, each bumper 28 may comprise a bumper cover 32 attached to the bumper frame 30. The bumper cover 32 may comprise a shock-absorbing material, such as an elastomer, to dampen impact forces to prevent damage to either the patient support apparatus 10 or the other object.

Side rails 34 are pivotally coupled to the litter frame 20, on each side. The side rails 34 are movable between a raised position in which they block ingress and egress into and out of the patient support apparatus 10, and a lowered position in which they are not an obstacle to such ingress and egress. The side rails 34 may also be movable to one or more intermediate positions between the raised position and the lowered position. In still other configurations, the patient support apparatus 10 may not comprise any side rails.

As mentioned above, the patient transport apparatus 10 may comprise the lift device 16 to raise and lower the litter 14 relative to the patient support base 12. The lift device 16 may comprise a lead screw, a hydraulic jack, an electric actuator, or a linkage lift. In the illustrated embodiment, the lift device 16 comprises two columns 36, one end of which is mounted on the patient support base 12 and the upper end of which is secured to the underside of the patient support litter 14. The columns 36 are controlled by the caregiver to raise and lower the litter 14 as needed. Each column 36 may be independently controllable to raise and lower either the head end HE or the foot end FE of the litter 14. When the patient support apparatus is configured with the foot end FE of the litter 14 higher than the head end HE it is referred to as the Trendelenburg position. Alternatively, when the patient transport apparatus 10 is configured with the head end HE of the litter 14 higher than the foot end FE it is referred to as the reverse Trendelenburg position.

Figures 2A, 2B, 2C:
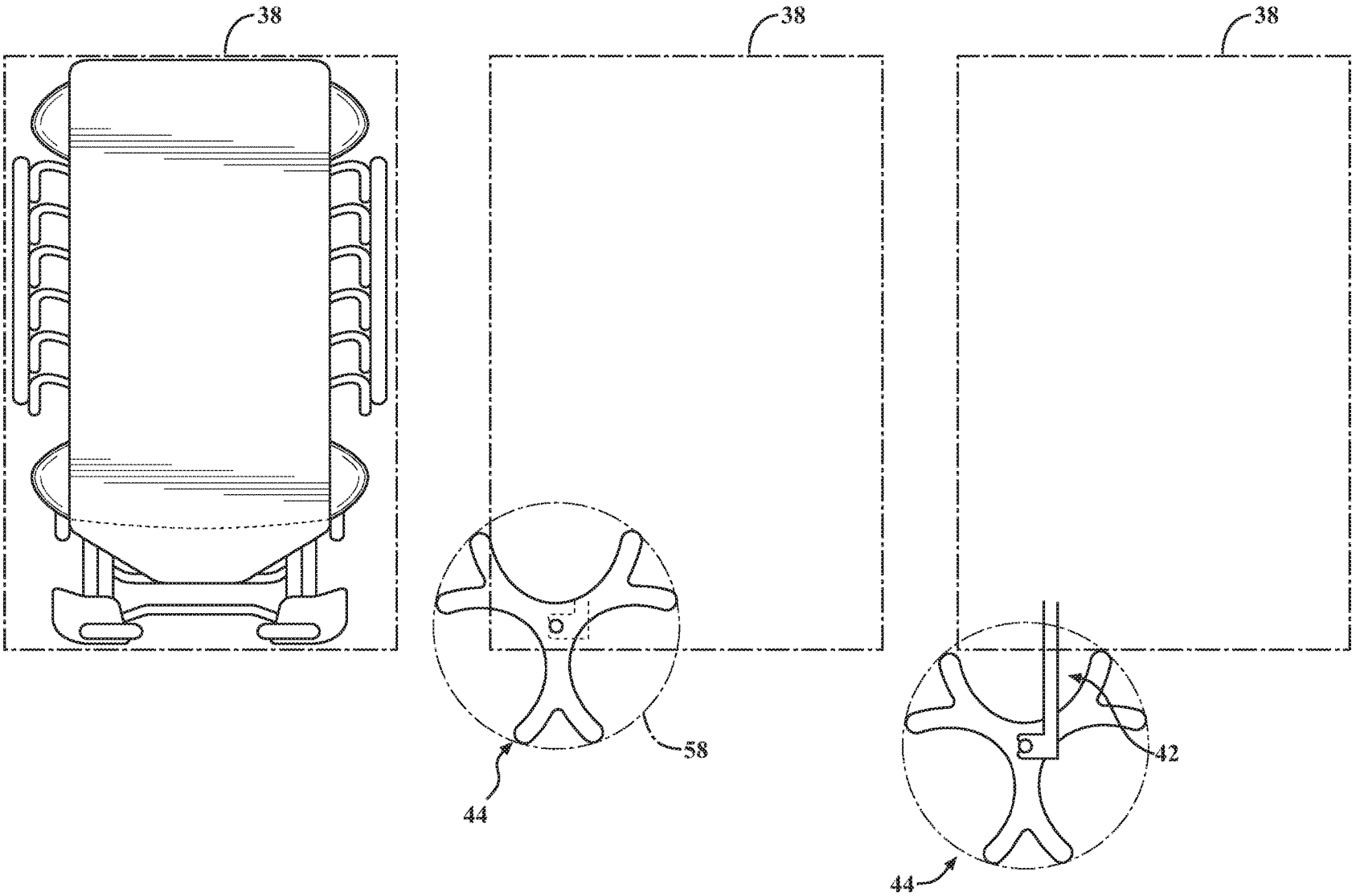
FIG. 2A is a schematic view of the patient support apparatus of FIGS. 1A and 1B showing a litter footprint.
FIG. 2B is a schematic view of the patient support system of FIGS. 1A and 1B showing the wheeled accessory being within the litter footprint in the first position.
FIG. 2C is a schematic view of the patient support system of FIGS. 1A and 1B showing the wheeled accessory being outside the litter footprint in the second position.

Referring to FIGS. 2A-2C, the litter 14 defines a litter footprint 38 projected downward from the litter 14 onto a floor surface when the litter 14 is in a level configuration.

The litter footprint 38 is the area beneath the litter 14 that is taken up by the patient support apparatus 10. The litter footprint 38 generally encompasses the widest dimension of the litter 14 including any accessories that may be mounted to the litter such as bumpers 28, side rails 34, a headboard, and a footboard to form a generally rectangular shape. In other words, the litter footprint 38 is the rectangular projection of the greatest length and width dimension of the litter 14, the bumpers 28, and side rails 34 and other components, collectively.

Referring now to FIG. 2B, an object is said to be within the litter footprint 38 if, when viewed from above, the litter 14 would at least partially cover that object. The litter footprint 38 generally comprises an area beneath the patient support base, however the patient support base may extend beyond the litter footprint 38.

Referring back to FIGS. 1A and 1B, the patient support apparatus 10 further comprises bed wheels 18 coupled to the patient support base 12. The bed wheels 18 may be coupled in several configurations however, for a generally rectangular patient support apparatus 10, one of the bed wheels 18 is coupled near each corner.

Figure 3B:
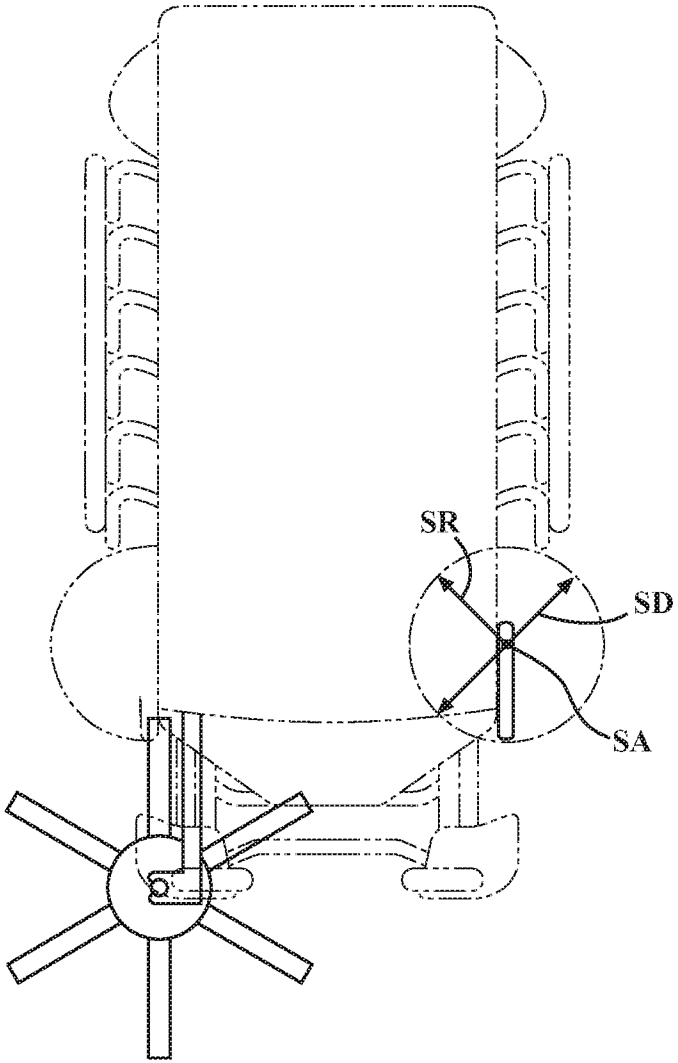
FIGS. 3A and 3B are top views of another embodiment of the patient support apparatus FIGS. 1A and 1B secured to the wheeled accessory shown in FIG. 1A and a second embodiment of a wheeled accessory, with the first wheeled accessory shown in a first position and the second wheeled accessory shown in a second position.
Figure 3A:
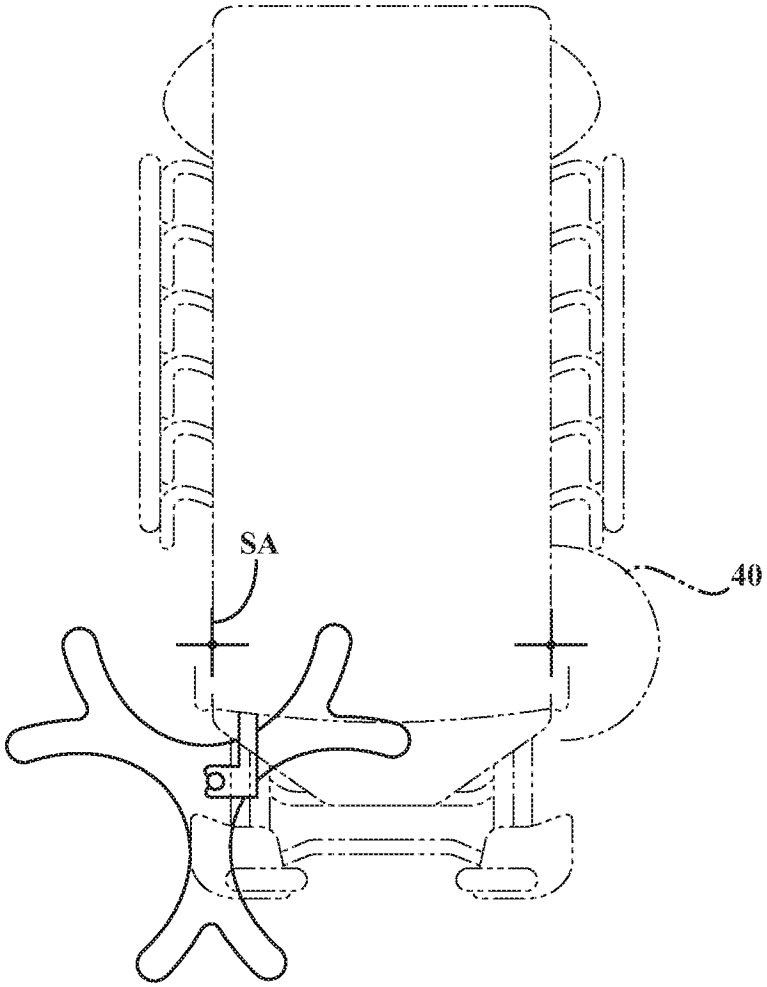

The bed wheels 18 may comprise caster wheels. Caster wheels 18 allow the patient support apparatus 10 to be moved in multiple directions along the floor surface. Referring to FIGS. 3A and 3B, each bed wheel is swivelable around a swivel axis SA to allow the bed wheel to swivel to face the direction of travel. The swivel axis SA is a generally vertical center of rotation about which the bed wheels can swivel.

As each bed wheel swivels about the swivel axis SA, the bed wheel defines a swivel radius SR and a swivel diameter SD. The swivel radius SR is the distance from the outermost surface of the bed wheel to the swivel axis SA of the bed wheel. The swivel diameter SD of each bed wheel is equal to twice the swivel radius SR.

Each bed wheel further defines a swivel area 40 proportional to the swivel radius SR of the bed wheel. The swivel area 40 is defined as the area swept by the outermost surface of the bed wheel as the bed wheel swivels around the swivel axis SA. The swivel area 40 is generally circular.

Referring to FIGS. 1A and 1B, the patient support apparatus 10 further comprises an accessory coupler 42 for securing a wheeled accessory 44 to the patient support apparatus 10. The combination of the patient support apparatus 10 and wheeled accessory 44 form a patient transport system PS. When the accessory coupler 42 is coupled to the patient support apparatus 10, the patient support apparatus 10 may tow the wheeled accessory 44 along the floor surface. Thus, when the caregiver moves the patient support apparatus 10 in a direction along the floor, the patient support apparatus 10 will tow the wheeled accessory 44 in the same general direction.

The accessory coupler 42 is configured to secure or at least constrain movement of the wheeled accessory 44 relative to the patient support apparatus 10 in at least one degree of freedom, but can be constrained in at least two, or at least three degrees of freedom. More particularly, in one embodiment, the accessory coupler 42 may constrain lateral movement of the wheeled accessory 44 relative to the patient support apparatus 10, while in other embodiments, the accessory coupler 42 may constrain vertical movement of the wheeled accessory 44 relative to the patient support apparatus 10 and constrain lateral movement of the wheeled accessory 44 relative to the patient support apparatus 10.

In certain embodiments, the accessory coupler 42 is configured to fix the movement of the wheeled accessory 44 relative to the patient support apparatus 10, i.e., prevent movement of the wheeled accessory 44 relative to the patient support apparatus 10, such as preventing lateral movement of the wheeled accessory 44, and/or preventing the wheeled accessory from spinning about its longitudinal axis. In other embodiments, the accessory coupler 42 is configured to merely constrain the movement of the wheeled accessory 44 relative to the patient support apparatus 10, i.e., impart some restriction of the movement of the wheeled accessory 44 relative to the patient support apparatus 10 that would not be present in the absence of the accessory coupler 42. For example, the accessory coupler 42 may be configured to allow the accessory post to spin about its longitudinal axis, but not may not allow the accessory post from moving laterally.

By fixing or constraining the movement of the wheeled accessory 44 relative to the patient support apparatus 10, the patient transport system PS may eliminate or reduce the need for the caregiver to apply a separate force to the wheeled accessory 44 to move the patient support apparatus 10 and the wheeled accessory 44. Thus, the caregiver simply applies a force to the patient support apparatus 10, which through the accessory coupler 42, will tow the wheeled accessory 44.

In one embodiment, the wheeled accessory 44 comprises a wheeled base 46 and an accessory post 48 coupled to the wheeled base 46. The type of wheeled accessory 44 is not particularly limited, and may comprise an accessory post 48, a medical waste container, a surgical device cart, or the like. The accessory post 48 may be configured to support one or more mounted accessories 50, such as an infusion pump, a tool tray, an IV fluid pouch, or the like. Through use of one or more hangers and connectors, multiple mounted accessories 50 can be supported by the accessory post 48.

While various embodiments are contemplated, the illustrated accessory post 48 has a cylindrical shape. The accessory post 48 is generally arranged vertically such that the bottom end of the accessory post 48 is coupled to the wheeled base 46. The accessory couplers described throughout this disclosure may generally be configured to accommodate and couple to accessory posts having different diameters.

Figure 4A:
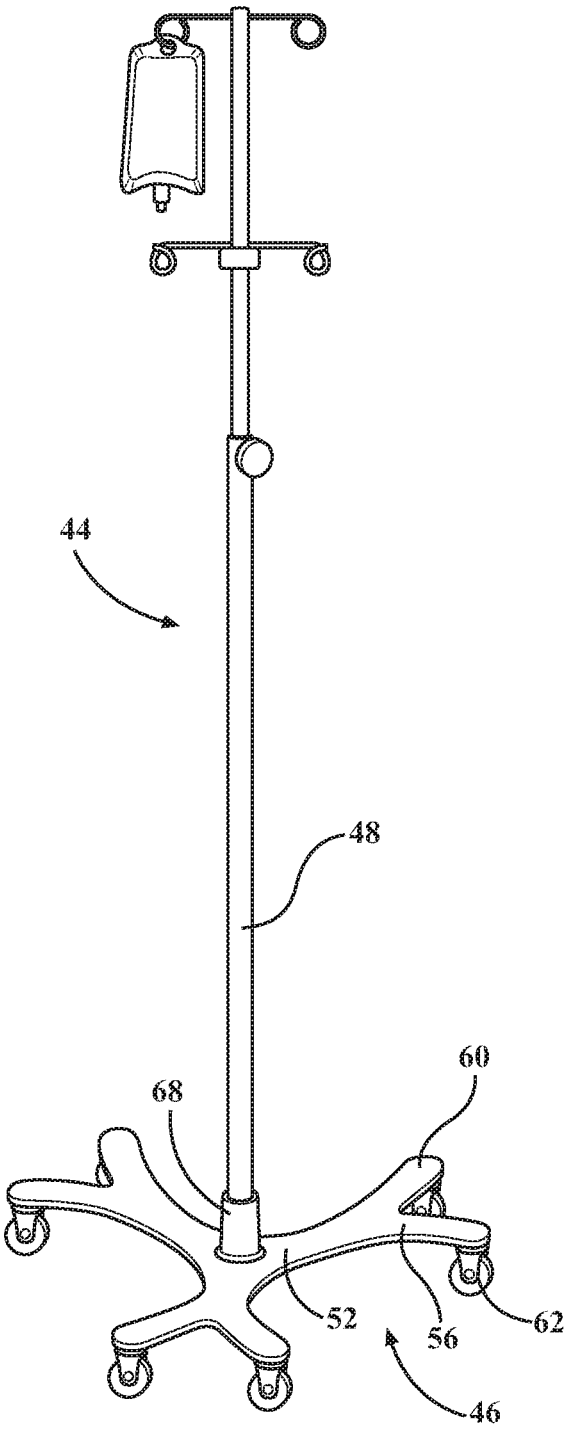
FIG. 4A is a perspective view of the wheeled accessory shown in FIGS. 1A and 1B.
Figure 4B:
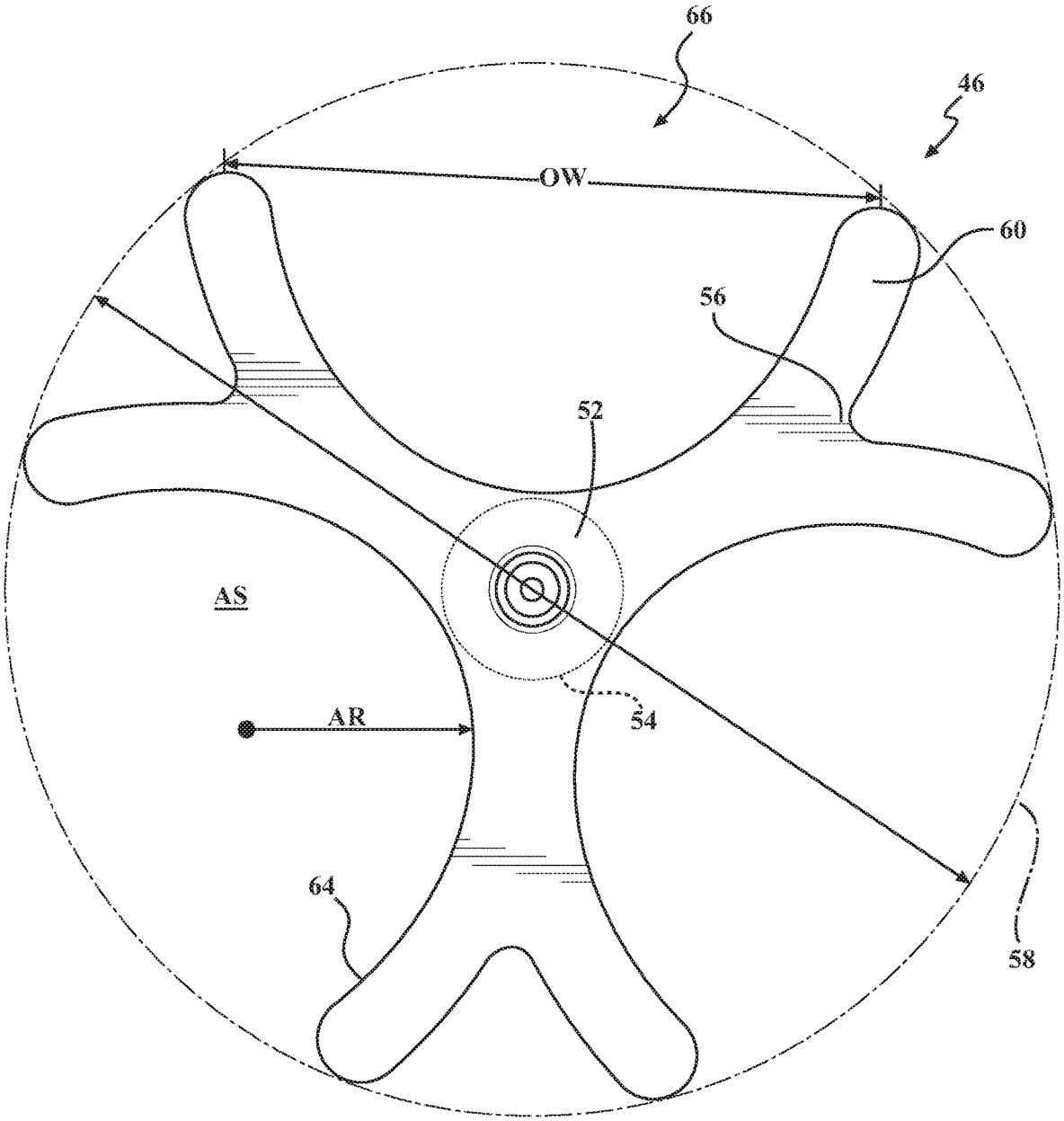
FIG. 4B is a top view of the wheeled accessory shown in FIG. 4A.

Referring to FIGS. 4A and 4B, in one embodiment, the wheeled base 46 comprises a base member 52. The base member 52 has a base member footprint 54 that projects downward from the base member 52 onto the floor surface when the base member 52 is in a level configuration. The base member footprint 54 is the area beneath the base member 52 that is taken up by the base member 52. The base member footprint 54 has a circular shape that generally encompasses the widest dimension of the base member 52. In other words, the base member footprint 54 is the circular projection of the largest radius of the base member 52.

The wheeled base 46 comprises at least two, or at least three, legs 56 radially extending outwardly from the base member 52. In the illustrated embodiment, the legs 56 are spaced radially apart from each other at approximately equal intervals around the base member 52. In other embodiments, the wheeled base 46 may comprise any number of legs, such as four, five, six legs, etc.

Referring to FIG. 4B, the wheeled base 46 comprises a wheeled base footprint 58 that projects downward from the wheeled base 46 onto the floor surface when the wheeled base 46 is in a level configuration. The wheeled base footprint 58 is the area beneath the wheeled base 46 that is taken up by the wheeled base 46. The wheeled base footprint 58 has a circular shape that generally encompasses the widest dimension of the wheeled base 46. In other words, the wheeled base footprint 58 is the circular projection of the largest radius of the wheeled base 46, including but not limited to, the radius of the legs 56 projected from the base member 52. In other embodiments, the wheeled base footprint 58 is the circular projection of the largest radius of the wheeled base 46 including, but not limited to, the radius of the legs 56 projected from the base member 52 and wheels extending out of the legs 56.

It should be appreciated that in the illustrated embodiment the wheeled base footprint 58 is larger than, and completely encompasses, the base member footprint 54. This may be understood by referring to two concentric circles, with the larger of the circles representing the wheeled base footprint 58, and the smaller of the circles representing the base member footprint 54. In other embodiments, where the wheeled accessory 44 does not comprise legs 56, it is to be appreciated that the wheeled base footprint 58 and the base member footprint 54 may be equally sized.

Referring again to FIG. 4A, each of the legs 56 may comprise one or more support feet 60 extending outwardly at an angle from a distal end of each leg 56. While two support feet 60 are coupled to each of the legs 56 in the exemplary embodiment, the number of support feet 60 is not particularly limited. Furthermore, while the length of the support feet 60 is not particularly limited, the support feet 60 are generally shorter than the legs 56. In the illustrated embodiment, each of the one or more support feet 60 comprises an accessory wheel 62 attached to an underside of the support feet 60 to allow the wheeled accessory 44 to move along the floor surface. The accessory wheel 62 may be a caster wheel.

The support feet 60 provide additional mounting points for accessory wheels 62, increasing engagement of the wheeled base 46 with the floor surface thereby providing additional stability to the wheeled accessory 44. Each of the support feet 60 may have more than one accessory wheel 62, which further increases the engagement of the wheeled accessory 44 with the floor surface. Generally, increased engagement with the floor surface increases stability of the wheeled accessory 44. Additional accessory wheels 62 prevent instability of the wheeled accessory 44 from obstructions that cause one or more of the accessory wheels 62 to lose contact with the floor surface.

The wheeled base 46 further comprises an accessory mount 68. The accessory mount 68 may be sized and configured to releasably engage the bottom of the accessory post 48. A number of different accessory mount 68 configurations are contemplated, depending on the type of accessory post 48 to be engaged. For example, in the illustrated embodiment, the accessory mount 68 comprises a hollow protrusion with a diameter larger than the bottom of the accessory post 48. When mounted to the accessory mount 68, the accessory post 48 is engaged with the interior and is supported by the wheeled base 46.

Referring again to FIG. 4B, an accommodation space AS is defined between inner surfaces of each adjacent leg 56, constrained by the wheeled base footprint 58. In the illustrated embodiment, the accommodation space AS is defined by a curved inner segment 64 and a space opening 66. The curved inner segment 64 of each accommodation space AS has a radius of curvature referred to as an accommodation radius AR, and each space opening 66 has an opening width OW. The radius of curvature may vary depending on the shape of the legs 56. In the illustrated embodiment, each accommodation space AS is substantially U-shaped, however other shapes, are contemplated, such as V-shapes, and as such, may not include a curved inner segment. In still other embodiments, it should be appreciated that the curved inner segment may be adjacent to one or more straight portions, i.e. the accommodation space AS has a parabolic shape.

In one embodiment, the opening width OW comprises the distance between inner surfaces of adjacent legs 56 at their distal ends. In configurations where the legs 56 comprise support feet 60, the opening width OW comprises the distance between the inner surfaces of support feet 60 of adjacent legs 56. For example, if the accommodation space AS is a circular segment, the opening width OW would be a length measurement of a chord that encloses the accommodation space AS.

Figure 5A:
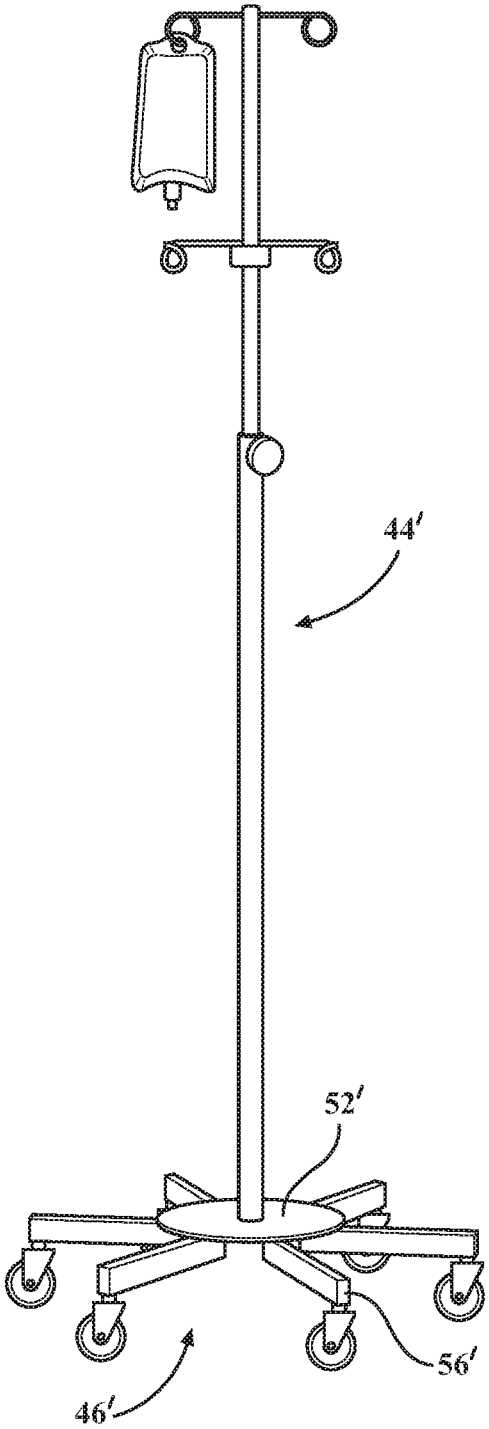
FIG. 5A is a perspective view of the wheeled accessory shown in FIG. 3B.
Figure 5B:
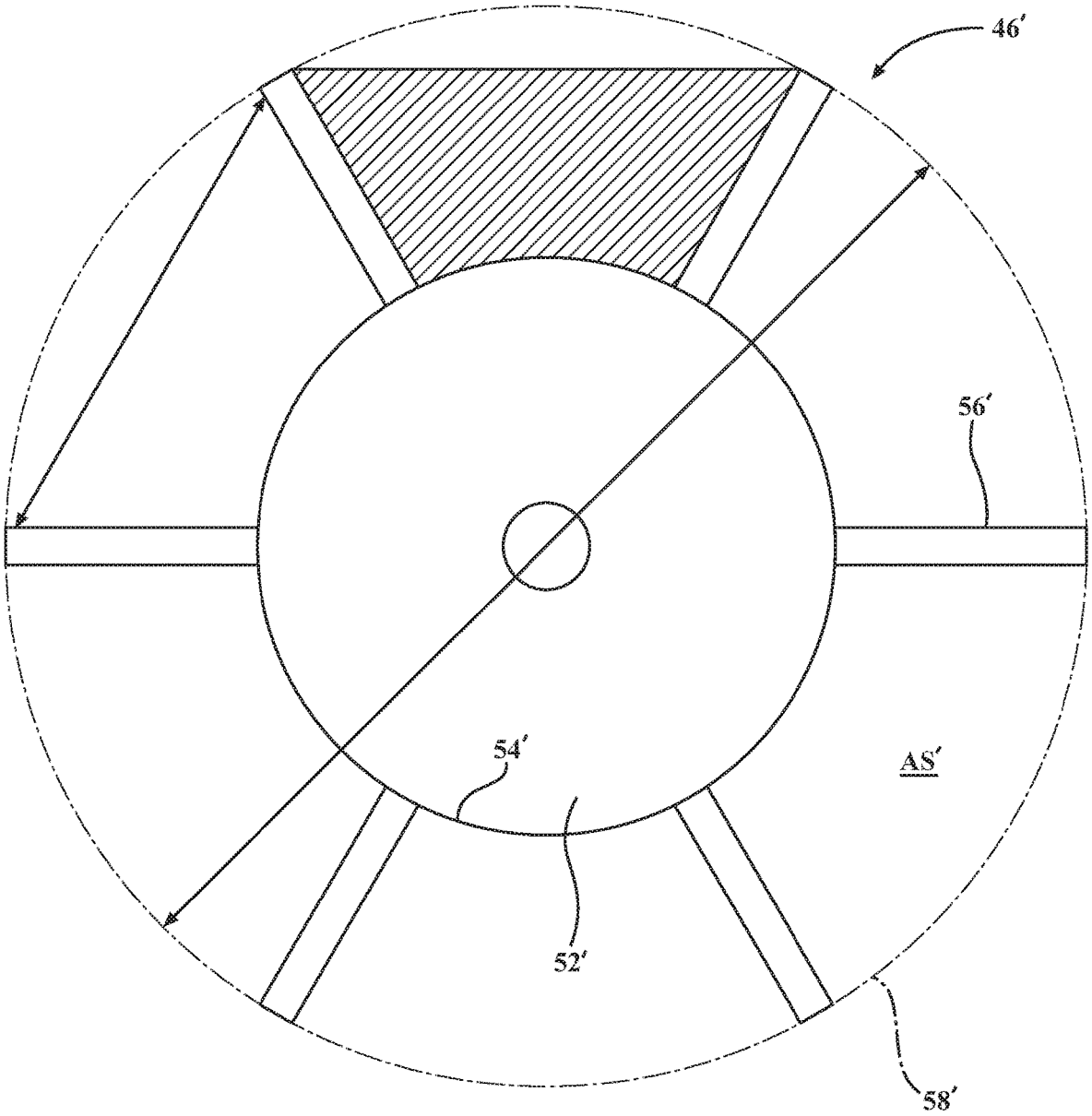
FIG. 5B is a top view of the wheeled accessory shown in FIG. 5A.

Referring to FIGS. 5A and 5B, in one embodiment, the wheeled accessory 44' comprises a wheeled base 46'. The wheeled base 46' comprises a base member 52' having a base member footprint 54' that projects downward from the base member 52' onto the floor surface when the base member 52' is in a level configuration. The base member footprint 54' is the area beneath the base member 52' that is taken up by the base member 52'. The base member footprint 54' has a circular shape that generally encompasses the widest dimension of the base member 52'. In other words, the base member footprint 52' is the circular projection of the largest radius of the base member 52'.

The wheeled base 46' comprises six legs 56', radially extending outwardly from the base member 52'. In the illustrated embodiment, the legs 56' are spaced radially apart from each other at approximately equal intervals around the base member 52'.

Referring to FIG. 5B, the wheeled base 46' comprises a wheeled base footprint 58' that projects downward from the wheeled base 46' onto the floor surface when the wheeled base 46' is in a level configuration. The wheeled base footprint 58' is the area beneath the wheeled base 46' that is taken up by the wheeled base 46'. The wheeled base footprint 58' has a circular shape that generally encompasses the widest dimension of the wheeled base 46'. In other words, the wheeled base footprint 58' is the circular projection of the largest radius of the wheeled base 46', including the radius of the legs 56' projected from the base member 52'.

It should be appreciated that, in the illustrated embodiment, the wheeled base footprint 58' is larger than, and completely encompasses, the base member footprint 54'. This may be understood by referring to two concentric circles, with the larger of the circles representing the wheeled base footprint 58', and the smaller of the circles representing the base member footprint 54'.

It should be appreciated that first wheeled accessory 44 can assume a first proximity to one of bed wheels 18 and second wheeled accessory 44' can assume a second proximity to the bed wheels 18, wherein the first wheeled accessory 44 can be closer to the bed wheel 18 in the first proximity than the second wheeled accessory 44' is to the bed wheel 18 in the second proximity. The first position of the accessory coupler 42 may correspond to the first proximity and the second position of the accessory coupler 42 may correspond to the second proximity. The first wheeled accessory 44 may assume the first proximity or the second proximity. In this case, the first proximity may be defined as the wheeled base footprint 58 of the first wheeled accessory 44 at least partially overlapping the swivel area 40 and the second proximity may be defined as the wheeled base footprint 58 of the first wheeled accessory 44 being outside the swivel area 40.

Referring to FIGS. 1A and 1B, in certain embodiments, the accessory coupler 42 is movable relative to the patient support apparatus 10. In such embodiments, while movable, the accessory coupler 42 may still constrain the movement of the wheeled accessory 44 relative to the patient support apparatus 10, via friction or other force. In other embodiments, the position of the accessory coupler 42 is fixable, or fixed, relative to the patient support apparatus 10. In certain embodiments, the accessory coupler 42 is fixable within a tolerance threshold relative to the patient support apparatus 10, i.e., some predetermined amount of movement between the accessory coupler and the accessory post is permitted when the position of the accessory coupler 42 is fixed.

The accessory coupler 42 is configured engage one or more portions of the wheeled accessory 44. For example, the accessory coupler 42 may be configured to engage the wheeled base 46, the accessory post 48, or a combination thereof. It should be appreciated that the accessory coupler 42 may dimensioned such that the accessory coupler 42 can engage accessory posts 48 having different dimensions, such that the single accessory coupler 42 is said to be universal.

As illustrated, the accessory coupler 42 is coupled to the patient support base 12. The patient support apparatus 10 further comprises a coupler arm assembly 70. In the illustrated embodiment, the coupler arm assembly 70 is movably coupled to the patient support base 12. However, it should be appreciated that the coupler arm assembly 70 could be mounted to the litter 14, and hence, movable relative to the litter 14. The coupler arm assembly 70 has a proximal portion and a distal portion. The accessory coupler 42 is mounted to the distal portion of the coupler arm assembly 70.

In such a configuration, the accessory coupler 42 is movable relative to the patient support base 12 into a first position (See FIG. 1A) and a second position (See FIG. 1B) as the coupler arm assembly 70 moves relative to the patient support base 12. Generally, when the accessory coupler 42 is in the first position, the accessory coupler 42 is closer to the patient support base 12 than when the accessory coupler 42 is in the second position. Of course, it should be appreciated that the accessory coupler 42 may assume an infinite number of positions in between the first and second positions, as necessitated by the application of the accessory coupler 42.

Figure 6A:
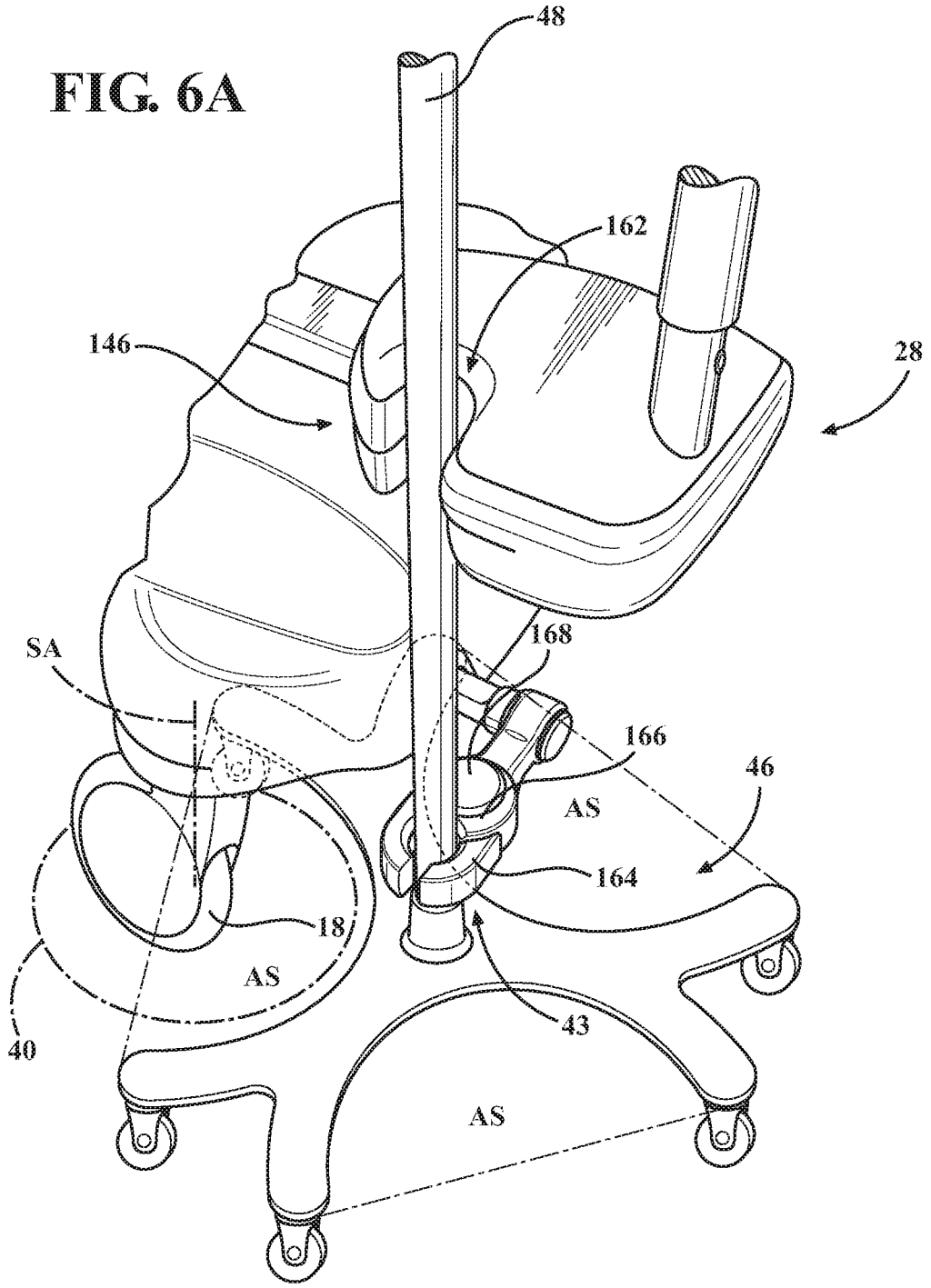
FIG. 6A is a perspective view of another embodiment of the patient support apparatus having an accessory coupler coupled to the wheeled base of FIG. 5A in a first position.
Figure 6B:
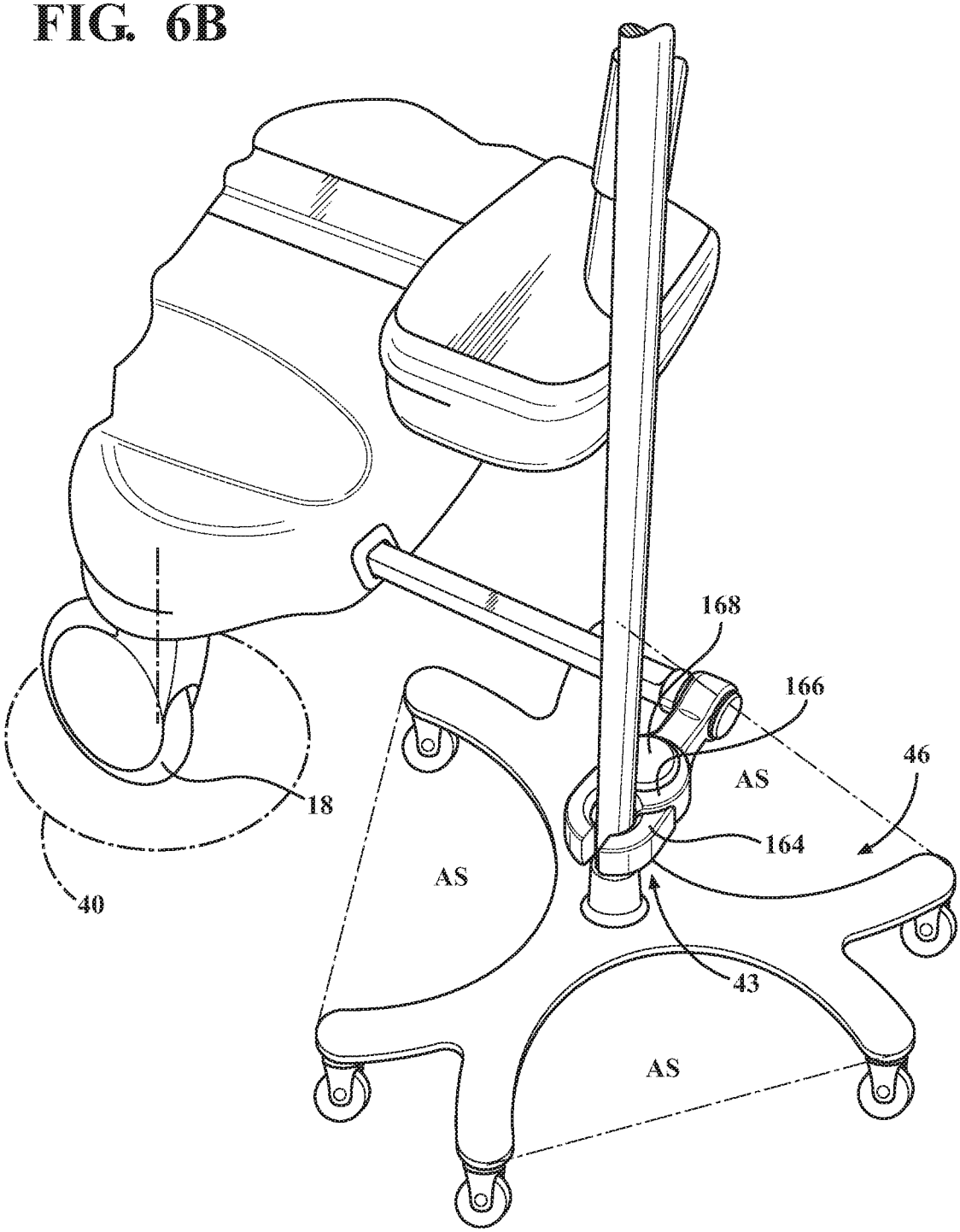
FIG. 6B is a perspective view of the patient support apparatus and accessory coupler coupled to the wheeled base of FIG. 6A in a second position.

Referring now to FIGS. 6A and 6B, a second embodiment of an accessory coupler is shown as clamp 43. In FIG. 6A, the clamp 43 is in the first position and thus, there is overlap between the swivel area 40 and the accommodation space AS. In contrast, as shown in FIG. 6B, where the clamp 43 is in the second position, there is no overlap between the swivel area 40 and the accommodation space AS. In other words, in the first position, at least one of the bed wheels 18 of the patient support apparatus 10 is at least partially nested within the accommodation space AS. The degree of overlap is not particularly limited, and may comprise at least 50%, 60%, 70%, 80%, 90%, of the swivel area 40 overlapping with the accommodation space AS. That is to say that the swivel area 40 of at least one bed wheel 18 overlaps with the accommodation space AS of the wheeled base 46. In particular embodiments, there can be overlap between the swivel area 40 and the accommodation space AS in both the first position and the second position.

Referring back to FIG. 4B, advantageously, in one specific configuration, the opening width OW of the accommodation space AS is greater than the swivel diameter of the at least one bed wheel to thereby allow the bed wheel to swivel freely within the accommodation space AS without contacting one or more of the legs 56 of the wheeled base 46. Of course, in other embodiments where the accessory coupler does not prevent rotation of the wheeled base 44 relative to the accessory coupler, the opening width OW may be arranged to prevent the bed wheel 18 from swiveling freely, but may constrain the swiveling such that less than 30, 60, or 90 degrees of swiveling are tolerated while the bed wheel 18 is at least partially nested within the accommodation space AS. This constraint may be through contact between legs 56 and the bed wheel 18, or swiveling of the wheeled base 46 in the accessory clamp 43 while the accessory coupler is coupled to the wheeled base 44.

Referring to FIGS. 7A-D, the accessory coupler takes the form of offset member 67. Offset member 67 is configured to be coupled to different wheeled accessories 44, 44', each having different configurations of the wheeled base 46, 46' (See FIGS. 4A and 5A, respectively).

Figure 7A:
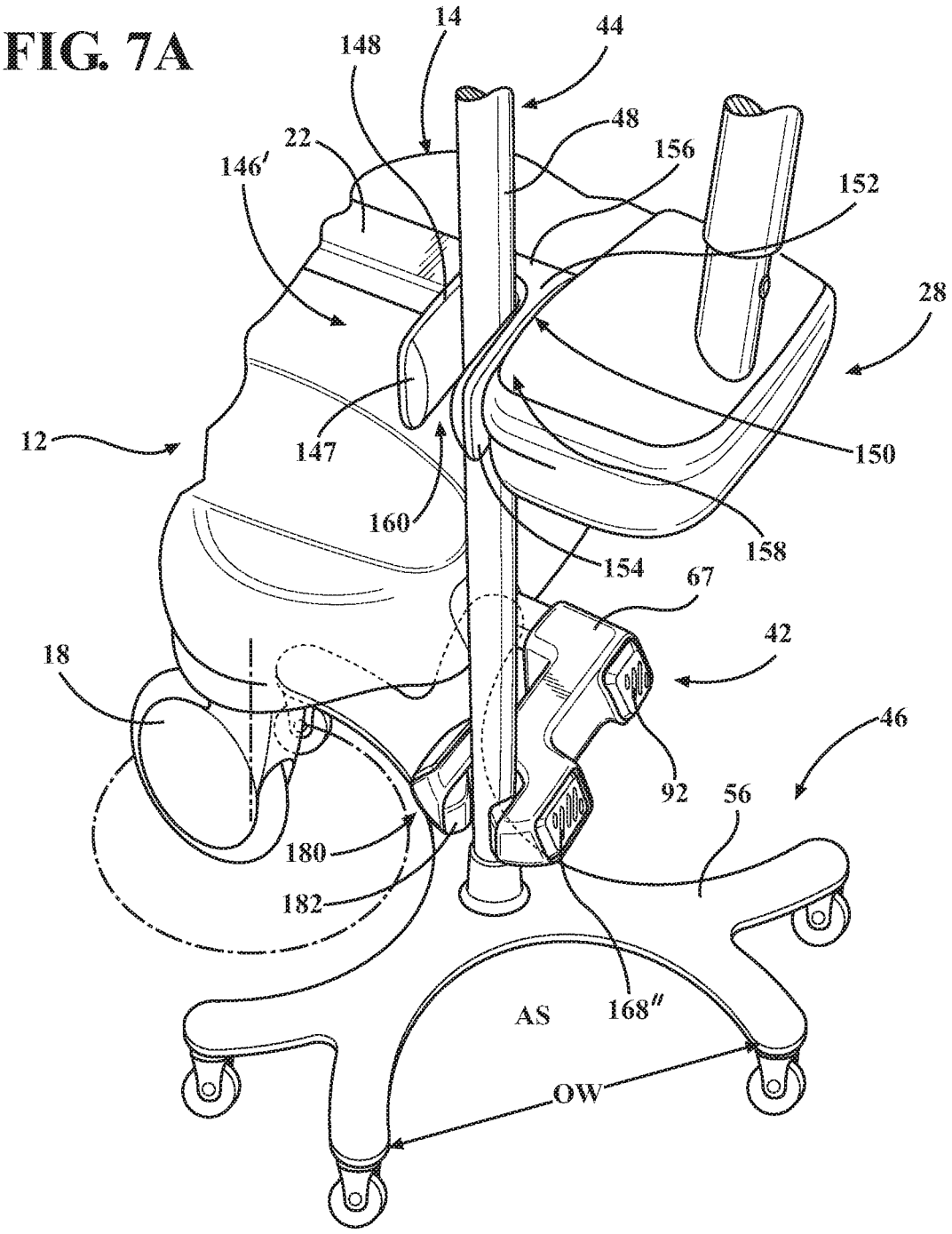
FIG. 7A is a perspective view of yet another embodiment of an accessory coupler coupled to the wheeled accessory of FIG. 4A in a first position.
Figure 7B:
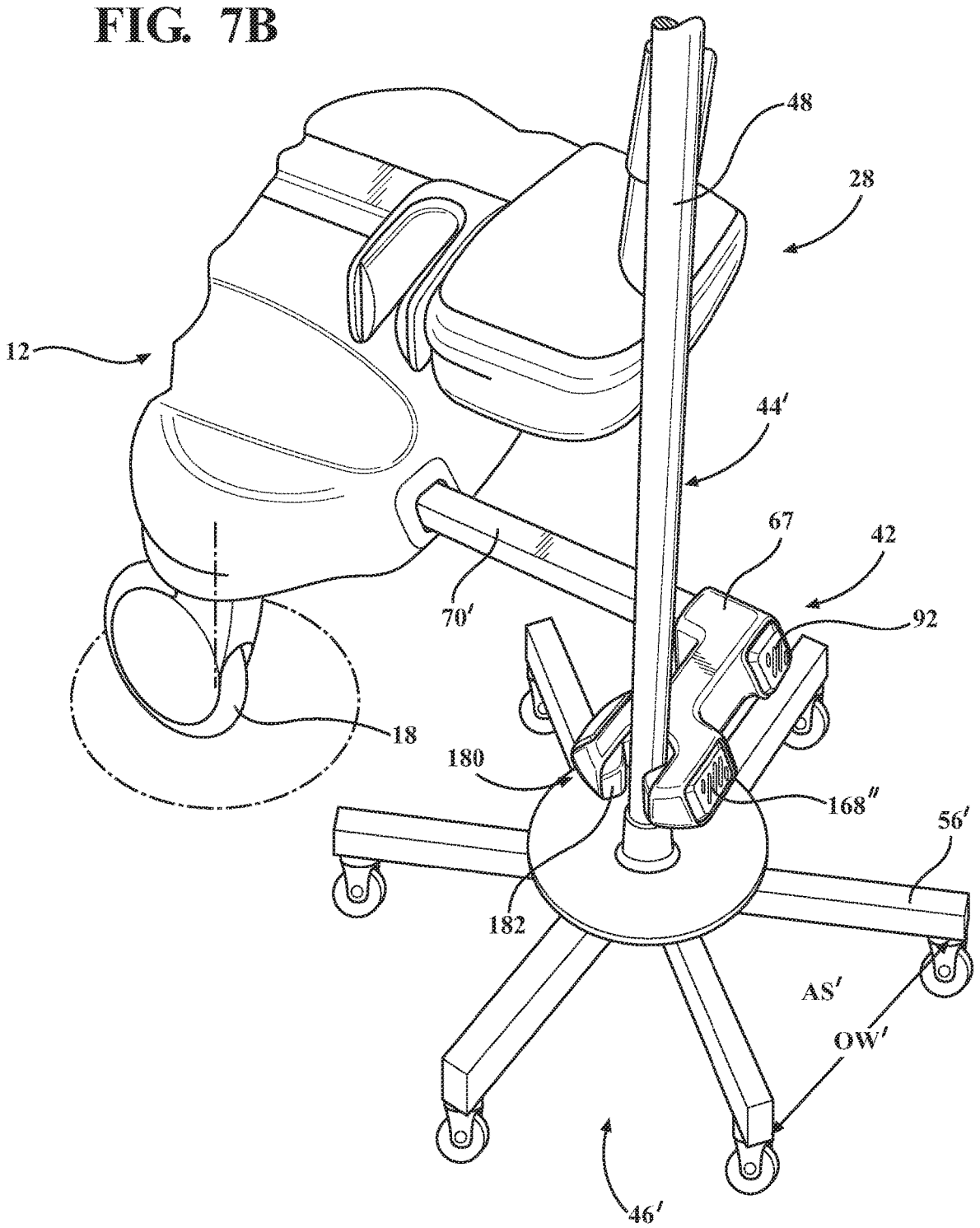
FIG. 7B is a perspective view of the accessory coupler of FIG. 7A coupled to the wheeled accessory of FIG. 5A in a second position.

For example, with reference to FIGS. 4B and 5B, comparing two wheeled bases 46, 46' having the same diameter, the number of legs 56, 56' affects the size of the corresponding opening width OW, OW' of the accommodation spaces AS, AS'. The wheeled base 46 has an opening width OW that is approximately twice as large as the opening width OW' of the wheeled base 46' with six legs 56' when the wheeled bases have the same diameter. Referring to FIG. 7D, the opening width OW' of accommodation space AS' of the wheeled accessory 44' is at least smaller than the swivel diameter of the at least one bed wheels 18, but can also constrain the swiveling such that less than 30, 60, or 90 degrees of swiveling are tolerated while the bed wheel 18 is at least partially nested within the accommodation space AS'. The wheeled accessory 44' may have a configuration that can overly restrict the bed wheel 18 from swiveling about the swivel axis SA. A bed wheel 18 that is restricted from swiveling inhibits the patient support apparatus 10 from moving in certain directions.

Figure 7C:
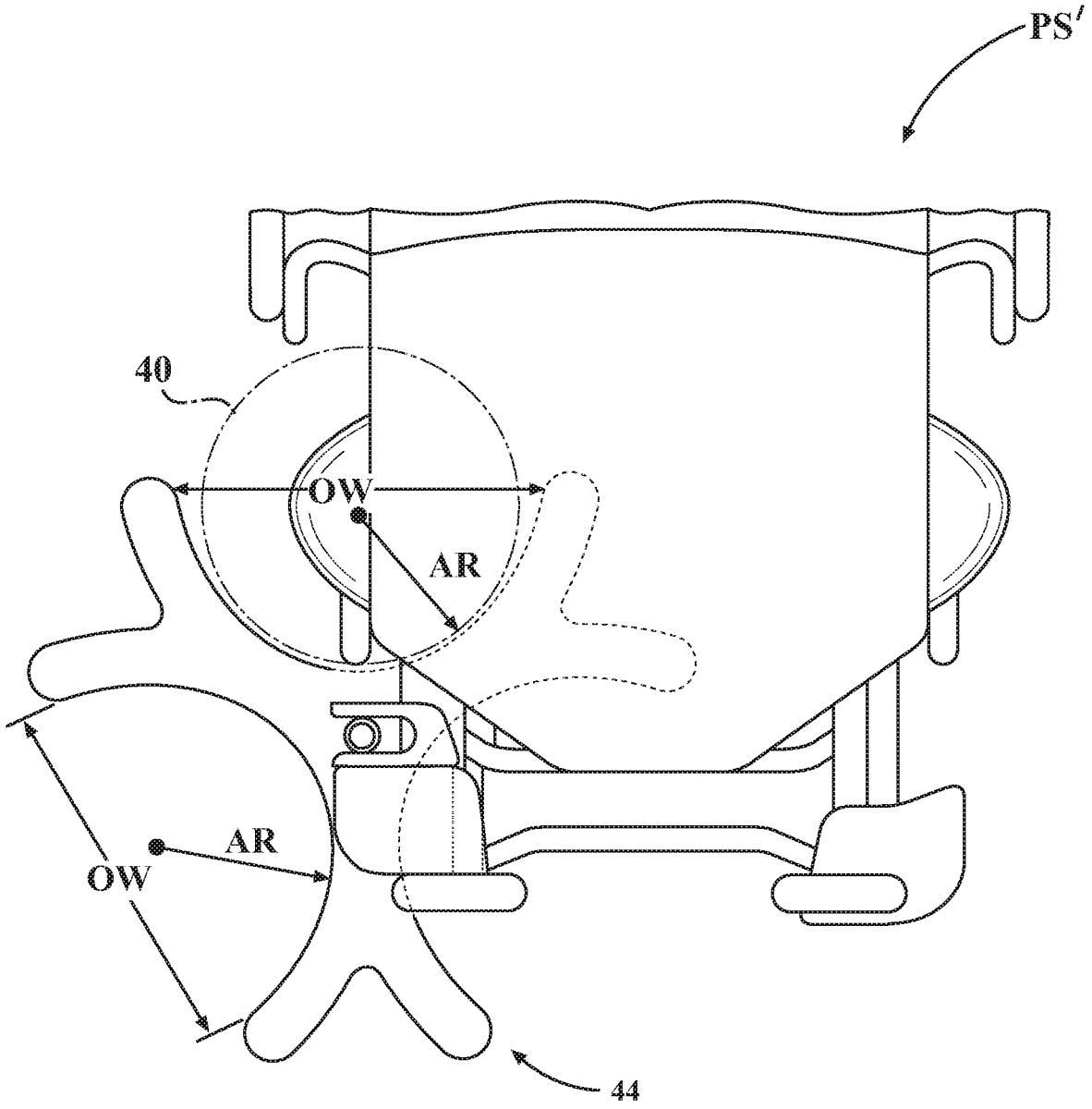
FIG. 7C is a top view of FIG. 7A showing the accessory coupler secured to the wheeled accessory of FIG. 4A in a first position.
Figure 7D:
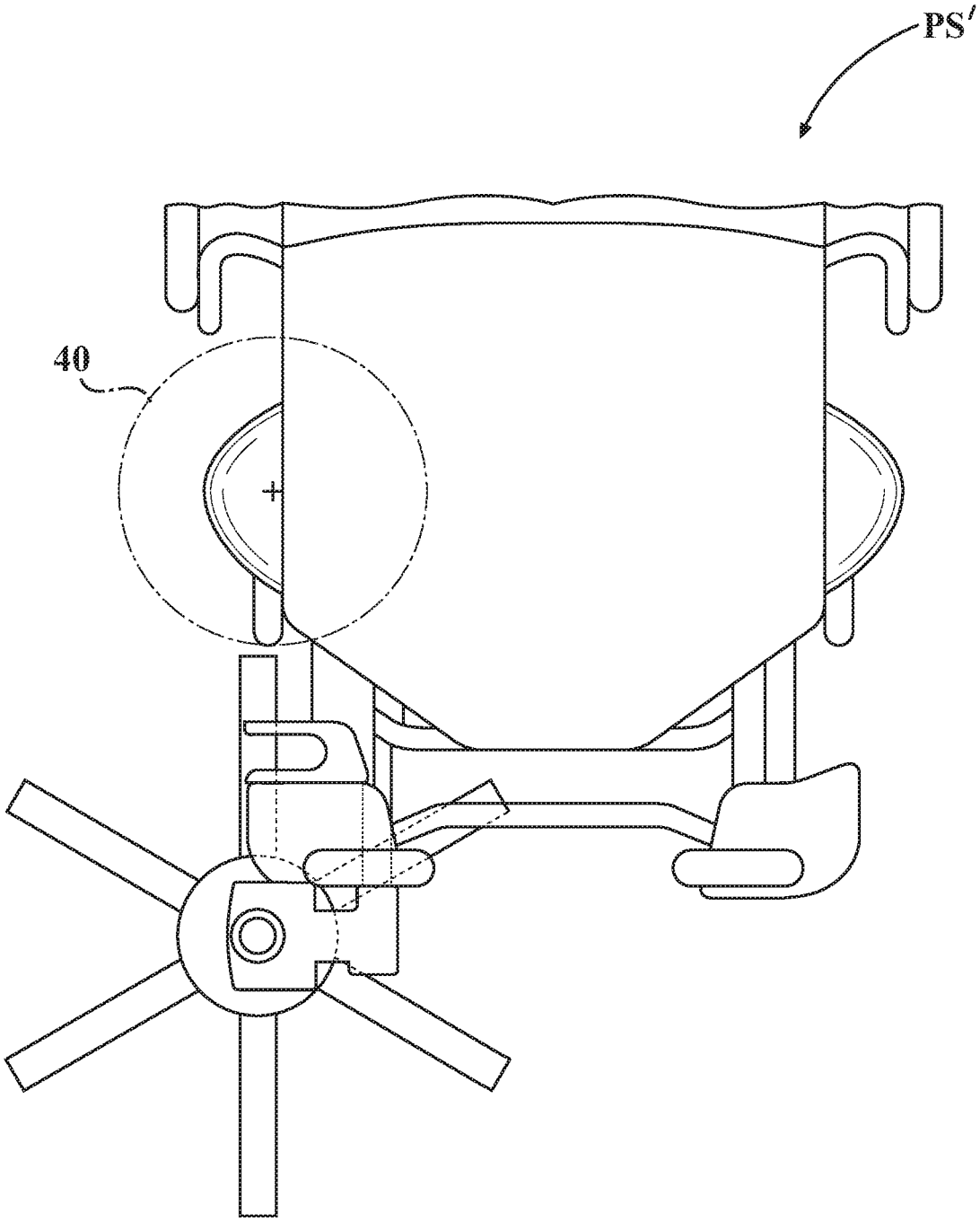
FIG. 7D is a top view of FIG. 7B is a top view of FIG. 7B showing the accessory coupler secured to the wheeled accessory of FIG. 5A in a first position.

Referring to FIGS. 4B and 7C, the wheeled accessory 44 advantageously maximizes both the opening width OW and the accommodation radius AR to enable a smaller profile and increased mobility of the bed wheel 18 relative to the wheeled accessory 44, and thus, allows the wheeled accessory 44 to be coupled to the accessory coupler 42 when the accessory coupler 42 is in the first position. A larger opening width OW allows the wheeled accessory 44 to be positioned more closely to the patient support apparatus 10 than the wheeled accessory 44' (See FIG. 7D). When the swivel area 40 of bed wheel 18 partially overlaps the accommodation space AS, the increased accommodation radius AR further enhances the maneuverability of the patient support apparatus 10 because the bed wheel 18 is able to rotate at least 90, or at least 120 degrees, around the swivel axis SA without contacting the legs 56 of the wheeled base 46. Furthermore, in certain configurations, the accommodation radius AR permits the bed wheel 18 to rotate 360 degrees about the swivel axis SA without contacting the legs 56 when the swivel area 40 of the bed wheel 18 partially overlaps the accommodation space AS.

Referring to FIG. 7D, for the wheeled accessory 44', in order to prevent interference with the movement of the patient support apparatus 10, the wheeled accessory 44' must be positioned such that the bed wheel 18 is outside of the accommodation space AS'. The offset member 67, when in the second position and coupled the wheeled accessory 44', locates the wheeled accessory 44' such that the bed wheel 18 is outside of the accommodation space AS'. This configuration may eliminate the possibility of any interaction between the bed wheels 18 and the legs 56' of the wheeled base 46', which thereby allows the patient transport system PS to move uninhibited.

With continued reference to FIGS. 2A-2C, and advantages of the first position and second position of the accessory coupler 42. The interaction between the wheeled accessory 44 and the patient support apparatus 10 further relates to the litter footprint 38. With reference to FIG. 2B, the accessory coupler 42 is configured such that, when the accessory coupler 42 is in the first position and coupled to the wheeled accessory 44, the wheeled base footprint 58 at least partially overlaps with the litter footprint 38. Alternatively, in another embodiment, when the accessory coupler 42 is in the first position and coupled to the wheeled accessory 44, the base member footprint 54 at least partially overlaps with the litter footprint 38. Additionally, the accessory post 48 may overlap with the litter footprint 38 in the first position. More specifically, when the accessory coupler 42 is in the first position the longitudinal axis of the accessory post 48 is within the litter footprint 38. The accessory post 48 may further define an accessory post footprint that at least partially overlaps with the litter footprint 38.

With reference to FIG. 2C, the accessory coupler 42 is configured such that, when the accessory coupler 42 is in the second position and coupled to the wheeled accessory 44, the base member footprint 54 does not overlap with the litter footprint 38. In other embodiments, when the accessory coupler 42 is in the second position and coupled to the wheeled accessory 44, the wheeled base footprint 58 does not overlap with the litter footprint 38. In other words, the longitudinal axis and the accessory post footprint do not overlap with the litter footprint 58 in the second position.

It should be appreciated that the length of the coupler arm assembly 70 may be varied depending on the dimensions of the wheeled accessories, such as the diameter of the wheeled base footprint, or dimensions of patient support apparatus, such as the distance between the bed wheels and the accessory coupler.

Referring again to FIGS. 7A and 7B, the path of the accessory coupler 42 from the first position to the second position may be limited by one or more intervening features, such as the bumper 28, if the accessory coupler 42 engages the accessory post 48. As such, in these embodiments, the wheeled accessory 44 must be decoupled from the accessory coupler 42 before the accessory coupler 42 can move between the first position and the second position. More generally, it should be appreciated that the configuration of the patient support apparatus 10 and the wheeled accessory 44 are factors in determining both the first and second positions of the accessory coupler, as well as the path that the accessory coupler 42 follows as the accessory coupler 42 moves between the first and second positions.

Figure 8A:
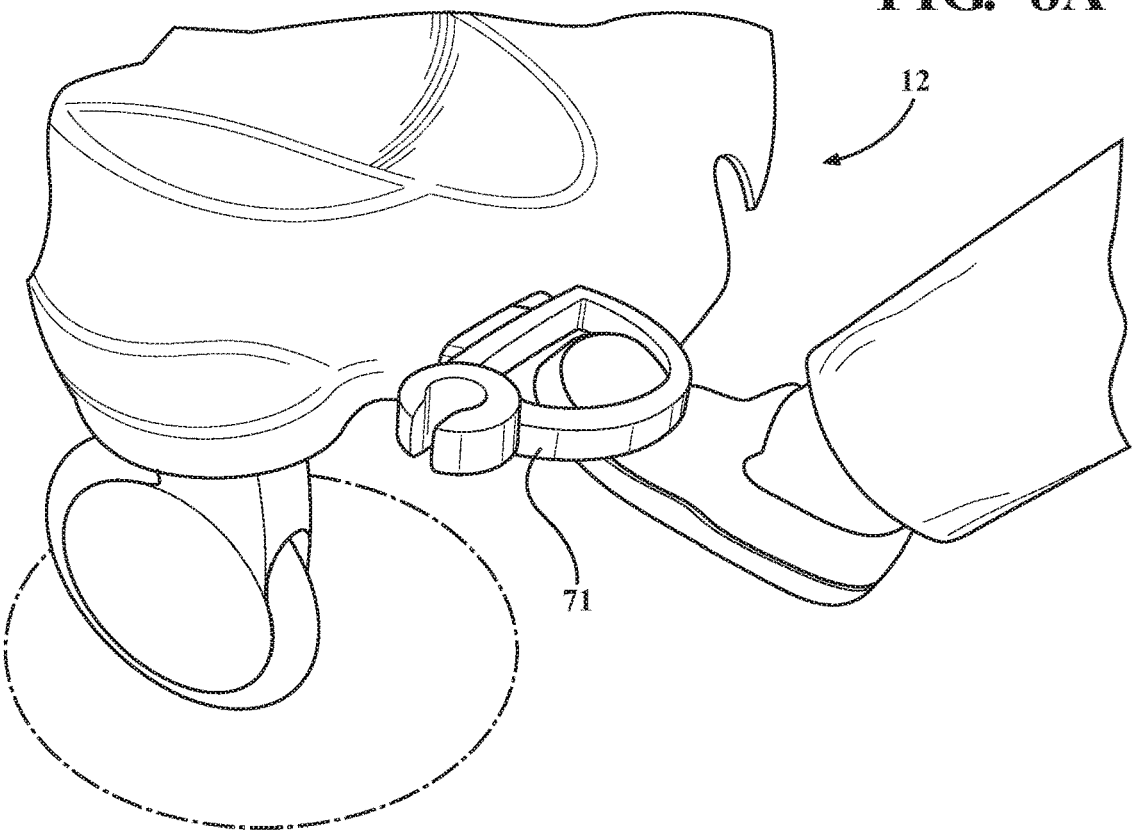
FIG. 8A is a partial perspective view of the patient support apparatus of FIGS. 1A and 1B with another embodiment of an accessory coupler in a first position.
Figure 8B:
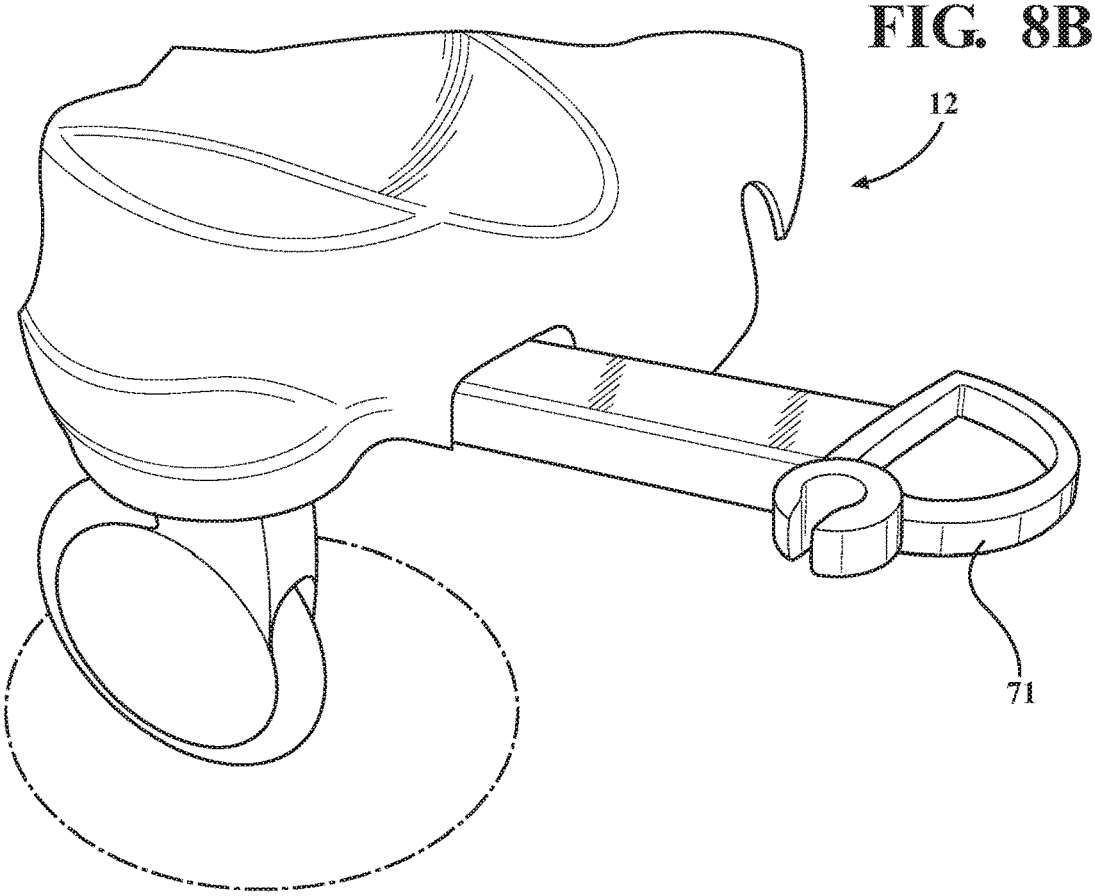
FIG. 8B is a partial perspective view of the patient support apparatus of FIG. 8A with the accessory coupler in a second position.

Referring to FIGS. 8A and 8B, another embodiment of the accessory coupler is shown as a stirrup assembly 71. One side of the stirrup assembly 71 may be configured to removably engage the accessory post, and the other side is a loop to enable the caregiver to move the accessory stirrup assembly 71 from the first position (See FIG. 8A) to the second position (See FIG. 8B), or vice-versa. While illustrated in the form of a loop, any suitable configuration of the stirrup assembly 71 is contemplated that allows the foot of the caregiver to move the stirrup assembly 71 between the first position and the second position, i.e., push the stirrup assembly 71 inward toward the patient support base 12, or pull the stirrup assembly 71 outward away from the patient support base 12. Caregivers can advantageously keep their hands free while moving the stirrup assembly 71 between the first position and the second position.

Figure 9A:
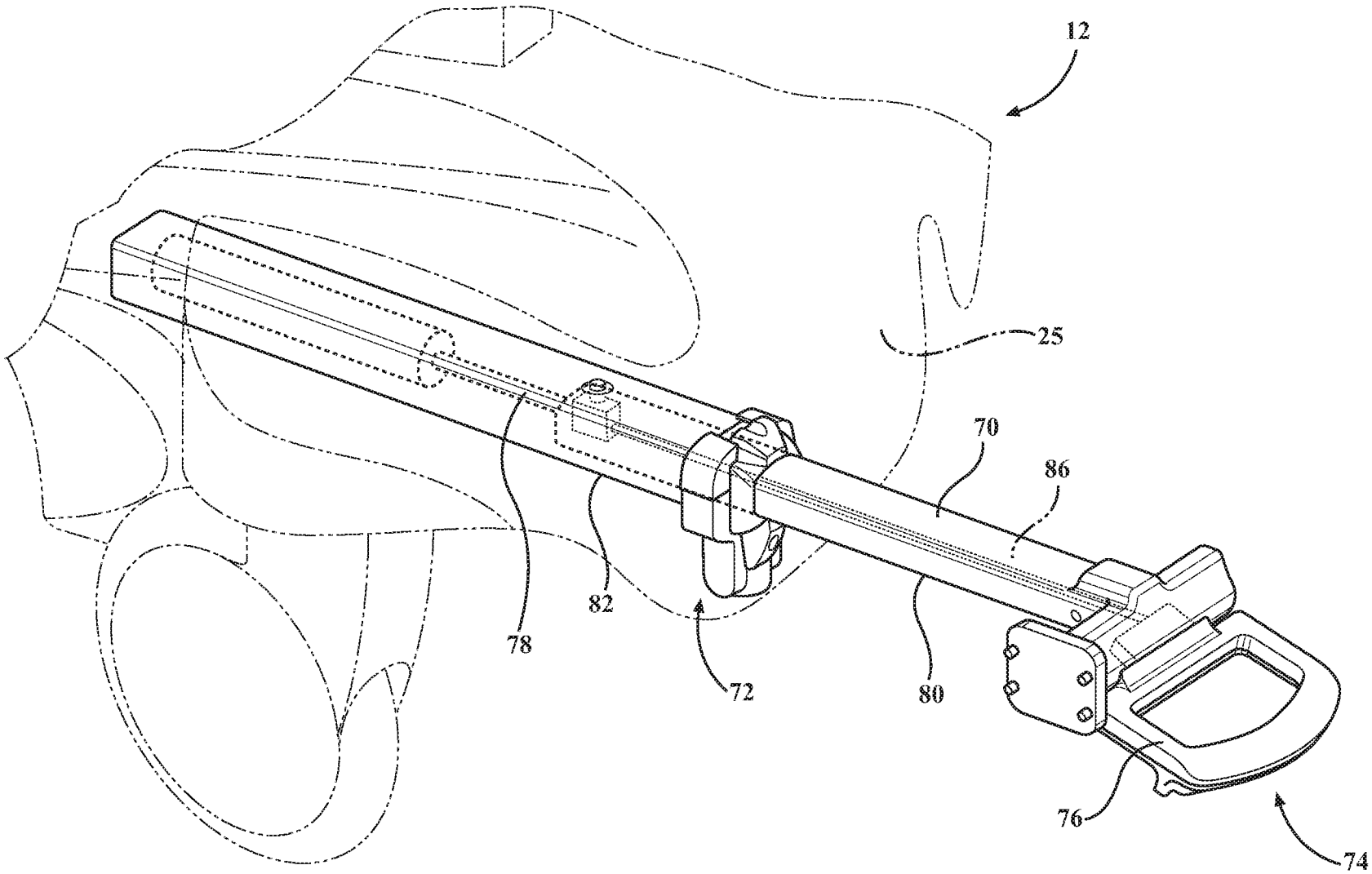
FIG. 9A is a perspective view of a patient support apparatus with a telescoping coupler arm assembly.
Figure 9B:
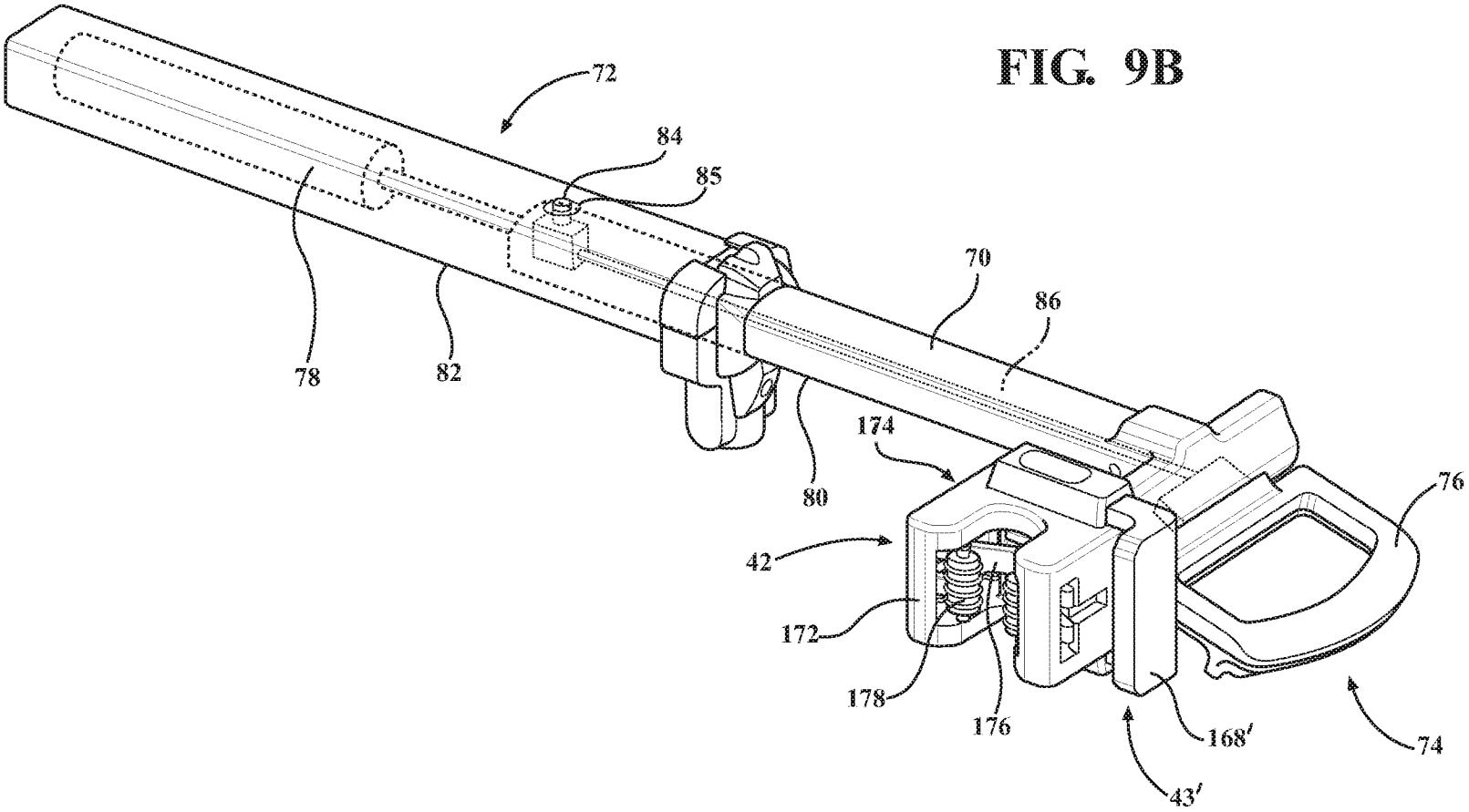
FIG. 9B is a perspective view of a patient support apparatus with a wheeled accessory coupled to an accessory coupler of the telescoping arm assembly in a first position.

Referring to FIGS. 9A and 9B, a latching device 72 may be coupled to the coupler arm assembly 70 to fix the coupler arm assembly 70 in one or more states, such as a retracted state (see FIG. 1A) corresponding the first position of the accessory coupler 42, and an extended state (see FIG. 1B) corresponding with the second position of the accessory coupler 42, and/or any number of intermediate states between the extended state and the retracted state. While the configuration of the latching device 72 is not particularly limited, various embodiments of the latching device 72 are described with respect to different configurations of the coupler arm assembly 70. However, it should be appreciated the latching device 72 configurations used within one embodiment of the coupler arm assembly 70 may be used with other embodiments of the coupler arm assembly 70.

The latching device 72 may be controlled by the caregiver to prevent undesired movement of the accessory coupler 42 relative to the patient support apparatus 10. The latching device 72 may be biased into a latched configuration or an unlatched configuration. If biased to the unlatched position, the accessory coupler 42 is free to move from the first position to the second position and vice-versa, and the caregiver must manually engage the latching device 72 to fix the position of the accessory coupler 42. Alternatively, if biased to the latched configuration, the caregiver must disengage the latching device 72 in order to move the coupler arm assembly 70.

Referring to FIG. 9A, the accessory coupler 42 may further comprise a user input device 74 that cooperates with the latching device 72 to engage or disengage the latching device 72. Thus, the user input device 74 is operable by the caregiver to engage or disengage the latching device 72 to either prevent or allow movement of the accessory coupler 42 between the first position and the second position, and vice-versa. The user input device 74 comprises devices capable of being actuated by a user, such as the caregiver. The user input device 74 may be configured to be actuated in a variety of different ways, including but not limited to, mechanical actuation (hand, foot, finger, etc.), hands-free actuation (voice, foot, etc.), and the like. Each user input device 74 may comprise a button, a gesture sensing device for monitoring motion of hands, feet, or other body parts of the caregiver (such as through a camera), a microphone for receiving voice activation commands, a foot pedal, and a sensor (e.g., infrared sensor such as a light bar or light beam to sense a user's body part, ultrasonic sensor, etc.). Additionally, the buttons/pedals can be physical buttons/pedals or virtually implemented buttons/pedals such as through optical projection or on a touchscreen. The buttons/pedals may also be mechanically connected or drive-by-wire type buttons/pedals where a user applied force actuates a sensor, such as a switch or potentiometer. The user input devices 74 may be located on the litter, on part of the accessory coupler 42, on the patient support base 12, or other suitable locations. The user input devices 74 may also be located on a portable electronic device (e.g., Apple Watch®, iPhone®, iPad®, or similar electronic devices).

The user input device 74 is in the form of a foot-operated switch 76 coupled to the latching device 76 in FIG. 9A. The foot-operated switch 76 is advantageous to caregivers by allowing the latching device 76 to be operated by the caregiver using only their foot. Caregivers can advantageously keep their hands free while operating the accessory coupler 42. Further, caregivers do not need to bend down to operate the accessory coupler 42.

The coupler arm assembly 70 may further comprise a biasing device 78 to bias the accessory coupler 42 toward the second position. The biasing device 78 provides a force to urge the coupler arm assembly 70 towards the second position.

In one embodiment, the accessory coupler 42 further comprises a damping device. The damping device may be configured to dampen motion of the coupler arm assembly 70 relative to the patient support apparatus 10.

In other embodiments, the damping device may be integrated into the biasing device 78, for example a gas spring 78. The gas spring 78 may be configured to provide motion in a damped manner to prevent abrupt extensions of the coupler arm assembly 70 relative to the patient support apparatus 10. More particularly, the gas spring 78 may provide damped motion to urge the coupler arm assembly 70 from the first position to the second position. Of course, other types of biasing devices may also be used to provide a force to urge the accessory coupler 42 towards the second position.

In the illustrated embodiment, the coupler arm assembly 70 is telescopic. The coupler arm assembly 70 comprises an inner telescoping member 80 and an outer telescoping member 82 that extends linearly, relative to the patient support base 12. In the example shown, the outer telescoping member 82 is secured to the patient support base 12, and the inner telescoping member 80 is slidably disposed in the outer telescoping member 82, and thus, is movable relative to the outer telescoping member 82. The accessory coupler 42 is mounted to the inner telescoping member 80. By moving relative to the outer telescoping member 82, the inner telescoping member 80 telescopes out of the outer telescoping member 82 to move the accessory coupler 42 from the first position to the second position. In certain embodiments, the biasing device 78 may be operatively coupled to the inner telescoping member 80 and the outer telescoping member 82 such that the inner telescoping member 80 is biased to telescope out of outer telescoping member 82. Of course, additional telescopic members are also contemplated depending on the stroke of the coupler arm assembly 70 needed, and the space available on the patient support base 12 for retraction of the coupler arm assembly 70. It should be appreciated that the outer telescoping member 82 may be positioned underneath the base shroud 25, and hence, not visible to the caregiver.

Referring now to FIG. 9B, the latching device 72 in this embodiment may comprise a latch pin 84 movable between a latched position and an unlatched position. In the latched position, latch pin 84 protrudes from within the inner telescopic member 80 and engages apertures 85 disposed within the outer telescoping member 82, to fix the position of the inner telescoping member 80 relative to the outer telescoping member 82. The foot-operated switch 76 is operatively coupled the latch pin 84 with a shaft member 86 to move the latch pin 84 to the latched position and the unlatched position. The latching device 72 may further comprise a spring or other biasing device to bias the latch pin 84 towards engagement with the outer telescoping member 82, i.e., towards to the latched position.

The foot-operated switch 76 pivots to move the shaft member 86, and hence the latch pin 84, between the latched position and the unlatched position. The foot-operated switch 76 may take the form of the foot-operated stirrup 71 that the caregiver hooks their foot into to pull the coupler arm assembly 70 into the second position. This may be especially useful in embodiments where no biasing device is used to bias the inner telescoping member 80 towards the second position.

The latching device, coupler arm assembly, and biasing device may cooperate to establish a push-push controlled accessory coupler. In such an embodiment, the caregiver may disengage the latching device by pushing the inner telescoping member inwards toward the patient support base. With the latching device disengaged, and the biasing device coupled to the inner telescoping member and the outer telescoping member, the inner telescoping member is able to be moved into the second position. To re-engage the latching device, the caregiver may push the inner telescoping member inwards toward the first position until the latching device re-engages, latching the accessory coupler in the first position. It should be understood that in order for the latching device to re-engage, the caregiver may have to move the inner telescoping member closer to the patient support base than would otherwise occur in the first position. Of course, the latching positions of the latching device are not particularly limited.

With continued reference to FIGS. 7A and 7B, the foot-operated switch takes the form of an angled button 92. The angled button 92 may be oriented to allow easy depression of the same with the caregiver's foot. Depression of the angled button 92 releases the latching device allowing the coupler arm assembly 70' to be moved to the first position, the second position, and any number of intermediate positions. For example, with reference to FIG. 7B, depression of the angled button 92 releases the latching device and enables the caregiver to press the offset member 67 inwards towards the patient support base 12, i.e., towards the first position. Whereas, with reference to FIG. 7A, depression of the angled button 92 a second time releases the latching device, and allows the biasing device to urge the offset member 67 outwardly away from the patient support base 12, i.e., towards the second position.

Figure 10:
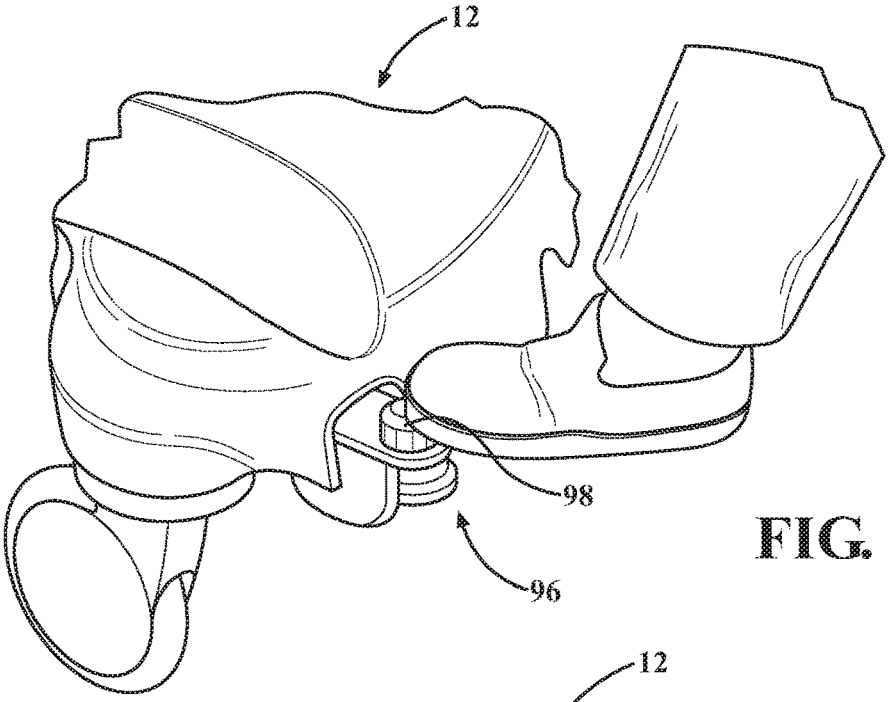
FIG. 10 is a perspective view of another embodiment of an accessory coupler in a first position.
Figure 11:
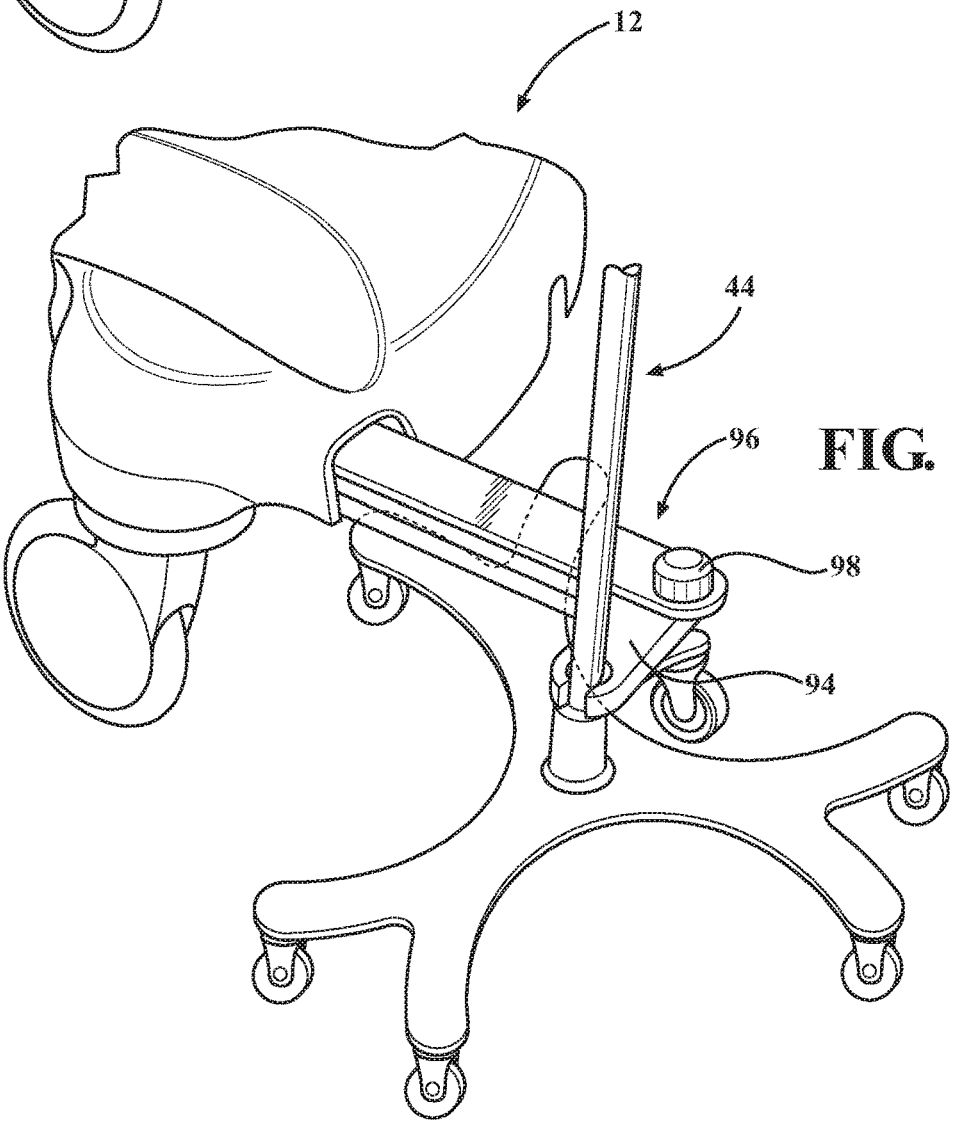
FIG. 11 is a perspective view of the accessory coupler of FIG. 10 in a second position.

Referring to FIGS. 10 and 11, in yet another embodiment, the accessory coupler takes the form of a deployable member 94. One end of the deployable member 94 is rotatably coupled to a slideable arm 96. The other end of the deployable member 94 is configured to engage the wheeled accessory 44. The deployable member 94 is movable between a stowed position (see FIG. 10) and a deployed position (see FIG. 11). In such embodiment, the foot-operated switch takes the form of a toe button 98. The toe button 98 is operatively coupled to the latching device. Depression of the toe button 98 disengages the latching device and allows the deployable member to move from the stowed position to the deployed position. More specifically, depression of the toe button 98 allows the slideable arm 96 to move away from the patient support base 12, while simultaneously allowing the deployable member 94 to rotate relative to the slideable arm 96 towards a substantially perpendicular alignment, i.e., the deployed position. In the deployed position, the deployable member 94 is optimally arranged to engage the wheeled accessory 44.

Figure 12:
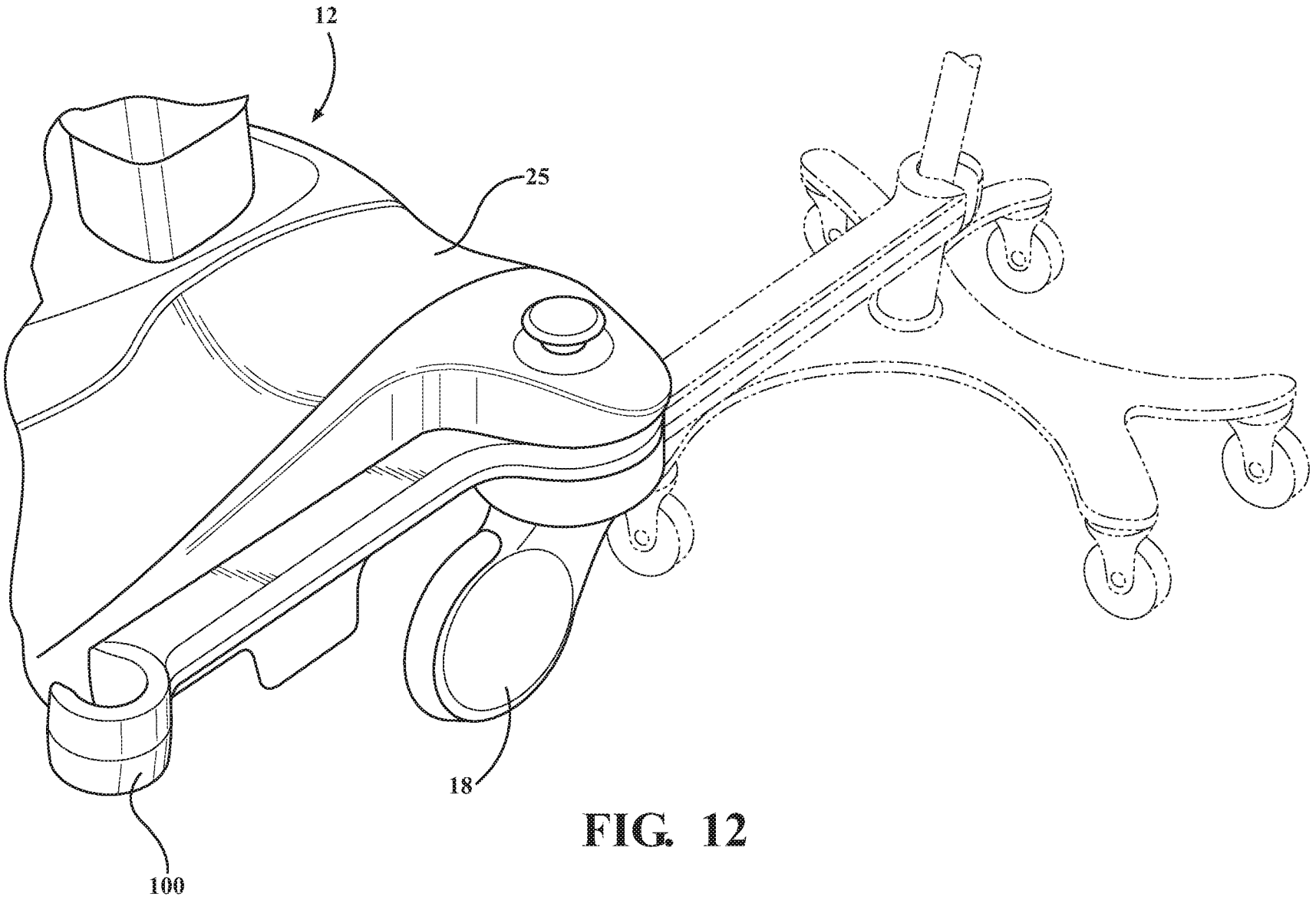
FIG. 12 is a partial perspective view of the patient support apparatus of FIGS. 1A and 1B with another embodiment of an accessory coupler in a first position, with a second position of the accessory coupler shown in phantom being coupled to the wheeled accessory of FIG. 4A.
Figure 13:
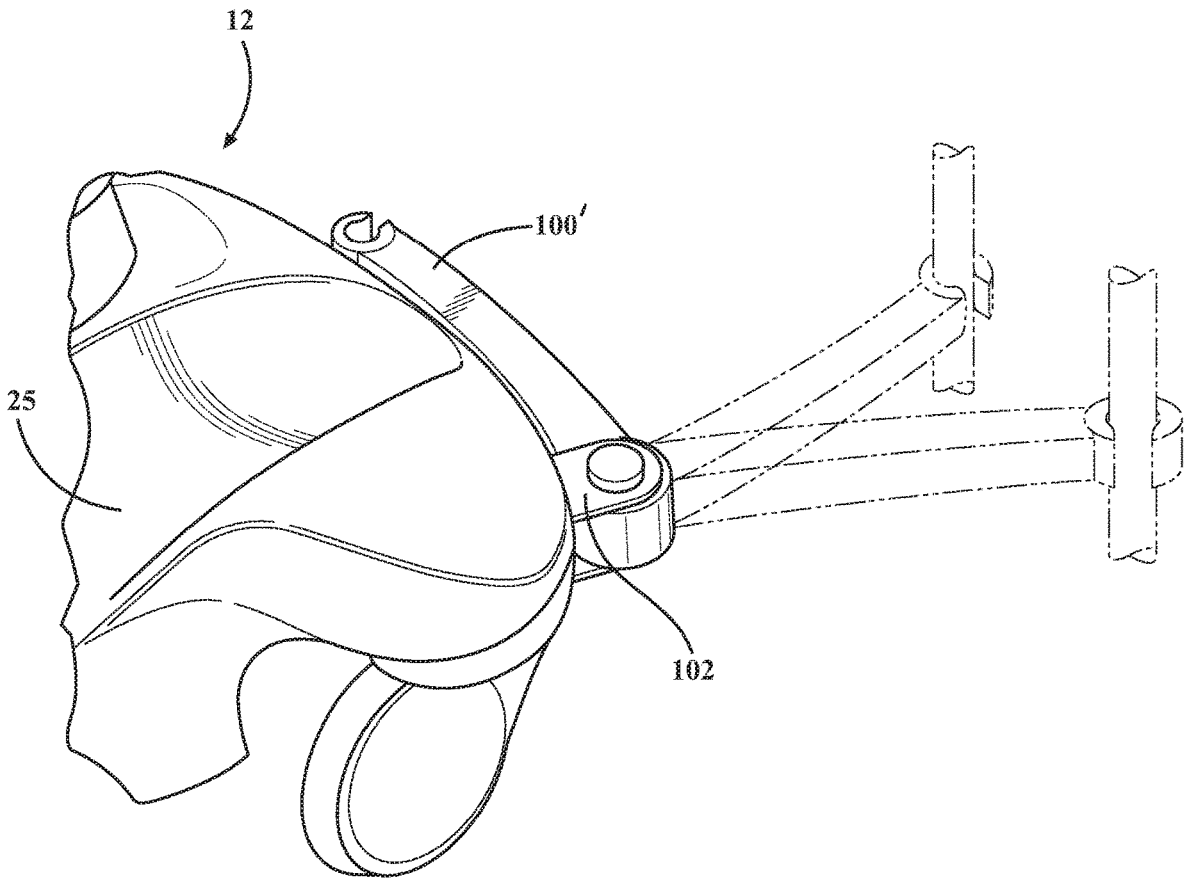
FIG. 13 is a partial perspective view of the patient support apparatus of FIGS. 1A and 1B with another embodiment of an accessory coupler in a first position, with an intermediate position, and a second position of the accessory coupler shown in phantom being coupled to an accessory post.

Referring to FIGS. 12 and 13, in another embodiment, the accessory coupler takes the form of swing arms 100, 100'. A distal portion of the swing arms 100, 100' is configured to engage the wheeled accessory, such as the accessory post. A proximal portion of the swing arms 100, 100' is configured to radially pivot relative to the patient support base 12 between the first position, the second position, and any number of intermediate positions.

Referring specifically to FIG. 12, the proximal end of the swing arm 100 is coupled to the patient support base 12, and configured to pivot about a pivot axis. The pivot axis may be generally aligned with the swivel axis of one of the bed wheels 18 of the patient support apparatus 10. In the first position, the swing arm 100 assumes a folded configuration that is substantially parallel with a longitudinal axis of the patient support base 12, and is adjacent to the patient support base 12 and the base shroud 25. In the second position, the swing arm 100 is rotated approximately 180 degrees from the first position to extend outward from the patient support base 12. As such, in the first position, the width, profile, and length of the patient support base 12 is not significantly expanded by virtue of the inclusion of the swing arm 100.

Referring specifically to FIG. 13, the proximal portion of the swing arm 100' is coupled to a swing mount 102 that is connected to the patient support base 12, and configured to pivot about a pivot axis. In the first position, the swing arm 100' assumes a folded configuration that is substantially perpendicular with the longitudinal axis of the patient support base 12, and is adjacent to the patient support base 12 and the base shroud 25. In the second position, the swing arm 100' is rotated approximately 90 degrees from the first position to extend outwardly from the patient support base 12. As such, in the first position, the width, profile, and length of the patient support base 12 is not significantly expanded by virtue of the inclusion of the swing arm 100'.

It should be appreciated that the features of the biasing device, the latching device, the foot-operated switch, or the stirrup assembly may be used in conjunction with the swing arms 100, 100' to provide certain advantageous functionality.

In one or more alternative configurations, the accessory coupler may be coupled, or connected to, the litter of the patient support apparatus. By coupling the accessory coupler to the litter, the accessory coupler may enhance the stability of the wheeled accessory and preventing tipping of the wheeled accessory by virtue of engagement of the accessory post with the accessory coupler.

Figure 14:
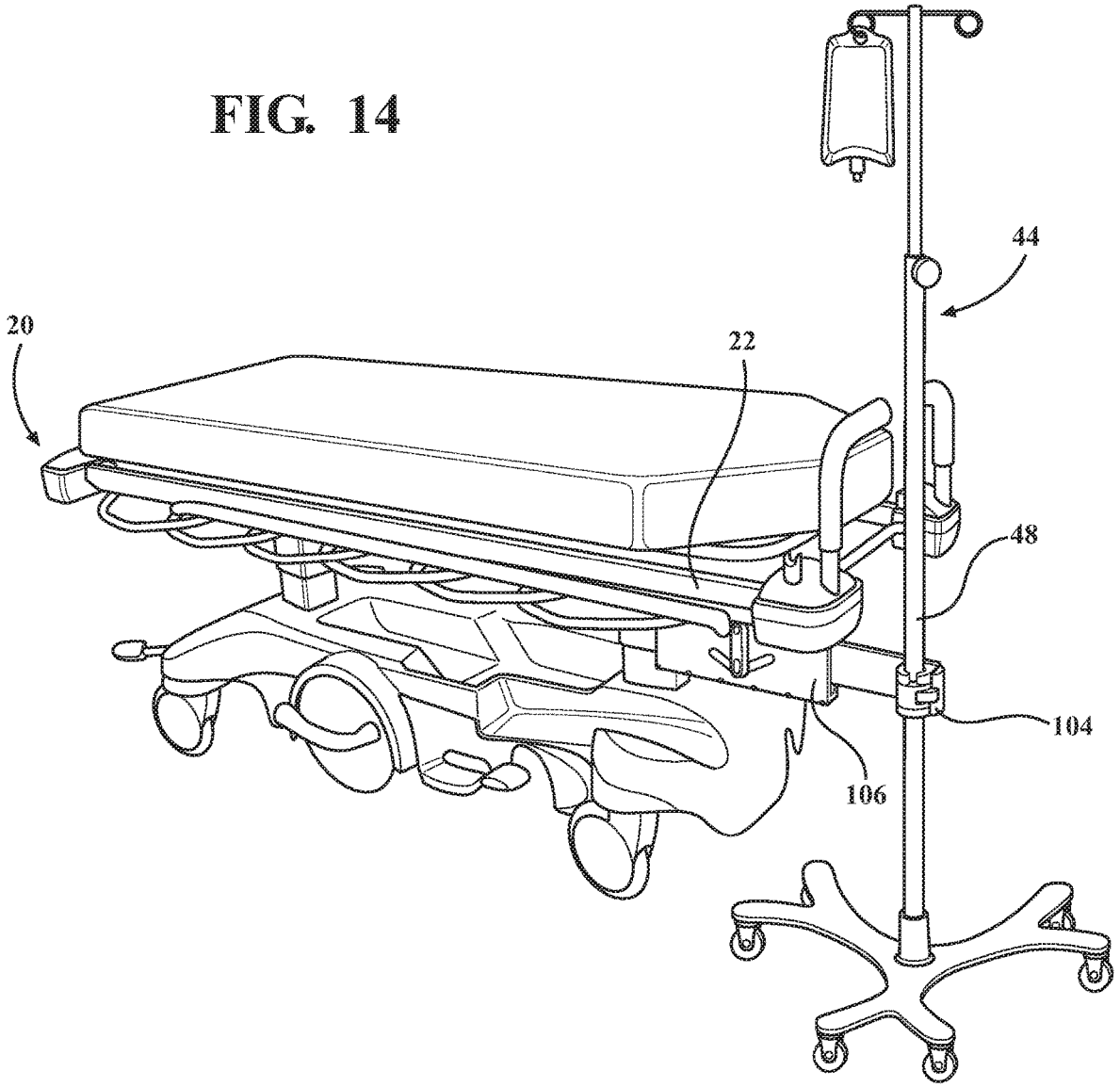
FIG. 14 is a perspective view of the patient support apparatus of FIGS. 1A and 1B with another embodiment of an accessory coupler secured to the wheeled accessory of FIG. 4A.

With reference to FIG. 14, in one exemplary embodiment, the accessory coupler takes the form of a clamp bracket 104 coupled to wheeled accessory 44. The clamp bracket 104 is configured to engage accessory posts 48 having different diameters. The clamp bracket 104 is coupled to a suspension assembly 106. The proximal end of the suspension assembly 106 is shown coupled to the longitudinal support rails 22 of the litter frame 20. The clamp bracket 104 is mounted to the distal end of the suspension assembly 106. As the wheeled accessory 44 encounters one or more thresholds on the floor surface, vibrations are transferred through the accessory post 48 and subsequently absorbed by the suspension device 106.

Figure 15:
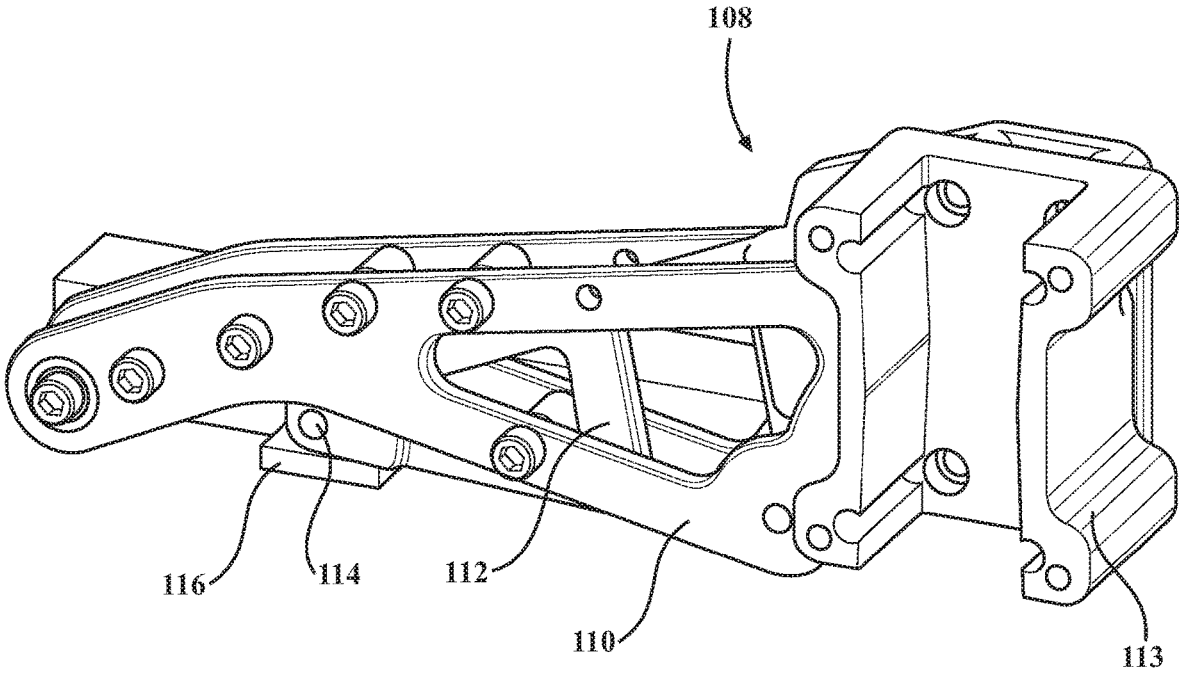
FIG. 15 is a perspective view of another embodiment of the accessory coupler for mounting on a litter of a patient support apparatus.

With reference to FIG. 15, in one exemplary embodiment, the accessory coupler takes the form of a Trendelenburg linkage 108 configured to be coupled to the litter. The Trendelenburg linkage 108 pivots to maintain an upright orientation of the accessory post when the litter is tilted in either the Trendelenburg position or the reverse Trendelenburg position. The Trendelenburg linkage 108 comprises an outer link 110 and an inner link 112. A proximal end of the outer link 110 is rotatably coupled to the litter frame 20. A first distal pivot 111 of the outer link 110 is rotatably coupled to a first distal pivot of the inner link 112. A mounting member 113 is rotatably coupled to a second distal pivot of the outer link 110 and the outer link 112. A cam element 114 is coupled to a proximal portion of the inner link 112 and moves along a flat guide member 116 attached to the litter frame 20. As the litter tilts into either the Trendelenburg position or the reverse Trendelenburg position, the guide member 116 moves the cam element 112 causing the inner link 112 to pivot relative to the outer link 110. Relative movement of the inner link 112 to the outer link 110 pivots the mounting member 113 relative to the litter. As such, when the mounting member 113 is coupled to the accessory post, the accessory post is able to maintain an upright orientation irrespective of the tilt angle of the litter.

Figure 16:
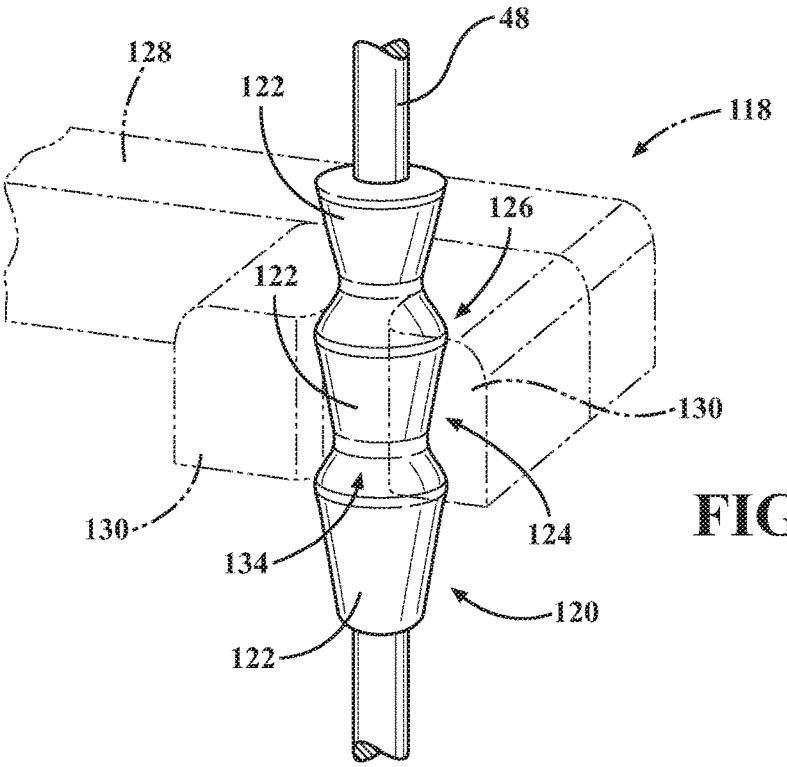
FIG. 16 is a perspective view of another embodiment of an accessory coupler engaging a sleeve mounted to the accessory post of a wheeled accessory.

With reference to FIG. 16, in another embodiment, the accessory coupler takes the form of a sleeve coupler 118. In such embodiment, the accessory post 48 may comprise a lift sleeve 120 coupled thereto. The lift sleeve 120 is disposed about the accessory post 48, and comprises at least one tapered segment 122, with a narrow portion 124 and a wide portion 126. The sleeve coupler 118 is coupled to a distal end of a sleeve coupler arm 128, whereas the proximal end of the sleeve coupler arm 128 is configured to be coupled to the litter frame 20, such as the longitudinal support rails 22. The number of tapered segments 122 is not particularly limited, and may be advantageously selected depending on the desired height of the wheeled accessory 44 relative to the ground.

The sleeve coupler 118 comprises two prongs 130 that are fixed relative to each other, and cooperate to form an insertion channel 134. Once the wheeled accessory 44 is moved such that the accessory post 48 slides through the insertion channel 134, as the litter 14 moves upward relative to the patient support base 12, the wheeled accessory 44 is engaged with the two prongs 130 with the wide portion 126 of the at least one tapered segment 122.

Figure 17:
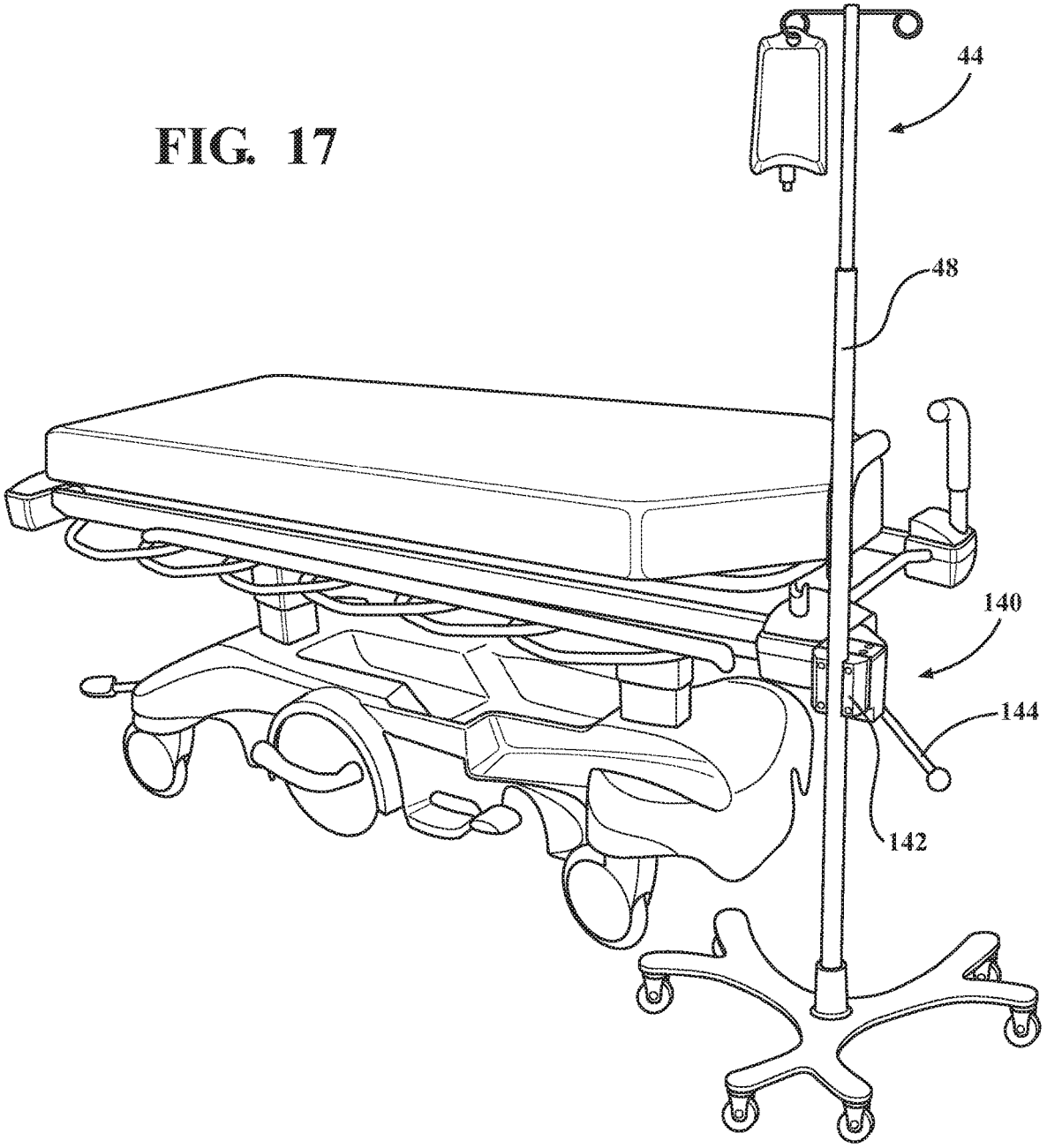
FIG. 17 is a perspective view of another embodiment of an accessory coupler engaging the wheeled accessory of FIG. 4A in an unlifted configuration.

With reference to FIG. 17, the accessory coupler may take the form of a post lifter assembly 140 configured to couple to the accessory post 48 and lift the wheeled accessory 44 off of the floor surface. The post lifter assembly 140 comprises a lifting channel 142 that is operatively coupled to a lift lever 144. The post lifter assembly 140 is configured such that when the caregiver actuates lift lever 144 with a downward motion, the lifting channel 142 engages the accessory post 48, and subsequently lifts the accessory post 48 in the vertical direction, thereby lifting the entire wheeled accessory 44. To lower and release the wheeled accessory 44 from the post lifter assembly 140, the caregiver may lower the lift lever 144 back to the starting position.

Figure 18:
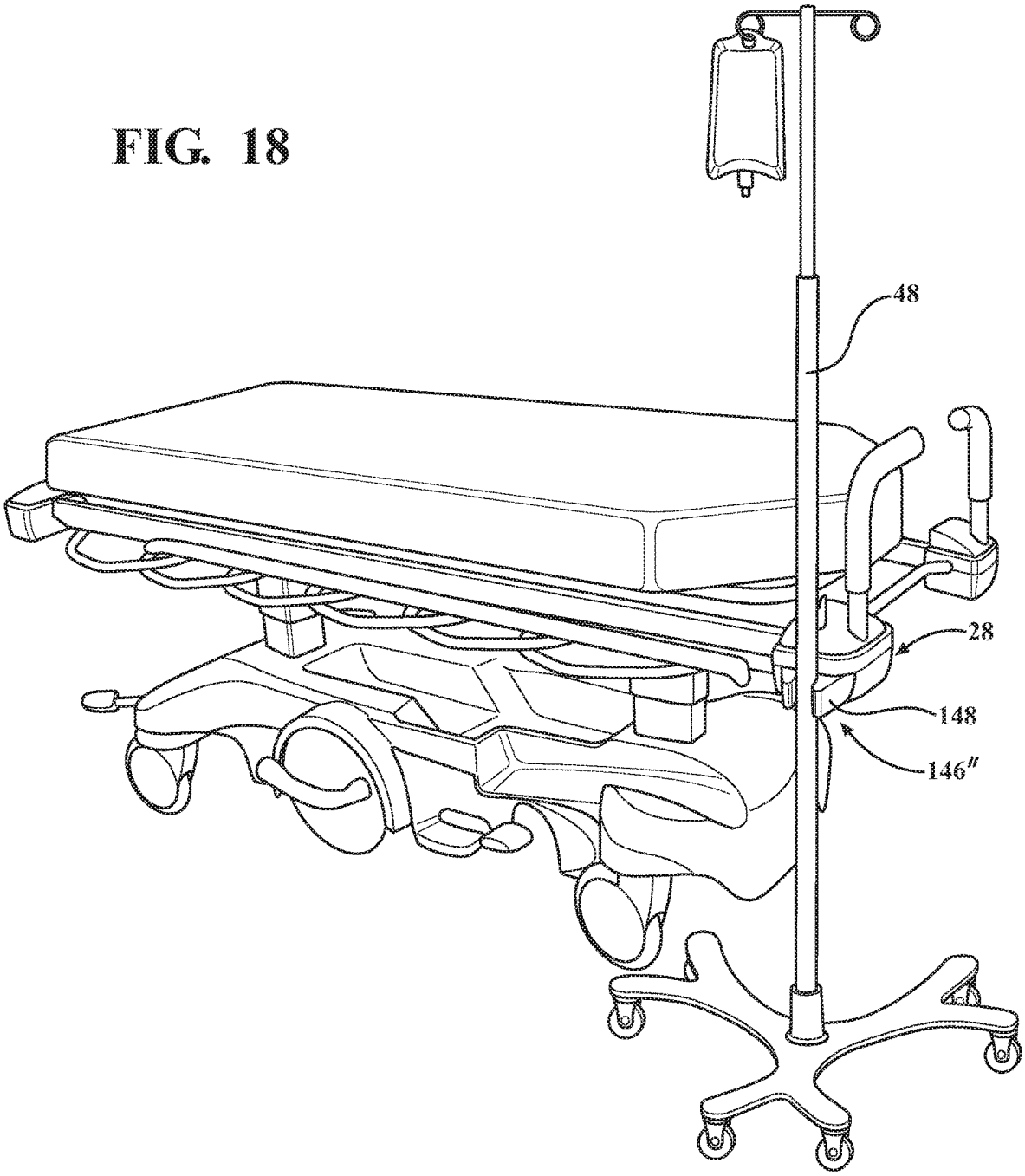
FIG. 18 is a perspective view of another embodiment of an accessory coupler engaging the wheeled accessory of FIG. 4A.

With reference to FIGS. 6A, 7A, and 18, the accessory coupler may take the form of retaining features 146, 146', 146". The retaining features 146, 146', 146" are passive features that do not require actuation by the caregiver to function to retain the accessory post 48 of the wheeled accessory 44 near the litter 14 and do not require actuation by the caregiver to release the accessory post 48 of the wheeled accessory 44. Each of the retaining features 146, 146', 146" may comprise a mouth portion 147 and a gripping portion 148. In certain embodiments, the gripping portion 148 is smaller than the mouth portion 147. Generally, the gripping portion 148 is configured to engage the accessory post and prevent movement of the accessory post relative to the retaining feature, whereas the mouth portion 147 allows the accessory post to easily be placed into the retaining feature, i.e., is suitably dimensioned or tapered to guide the accessory post into engagement with the gripping portion 148.

In certain configurations, the retaining feature 146' may be configured such that accessory post disposed therein may tilt relative to, i.e., within the retaining feature 146'. This allows the retaining features 146' to accommodate motion imparted to the litter 14 when the litter 14 is placed in the Trendelenburg or reverse Trendelenburg position without tipping the accessory post off-axis. Alternatively, or additionally, the retaining features 146' may be configured such that an accessory post disposed therein may slide axially along a longitudinal axis of the support post relative to the retaining features 146' but the retaining features 146' may not permit the accessory post disposed therein to move laterally unless a predetermined force is exceeded. This ability to slide axially again allows the retaining features 146' to be angled in the Trendelenburg position, while still retaining the accessory post. While three exemplary embodiments of the retaining features 146' are described below, still other alternative configurations are contemplated.

Referring specifically to FIG. 7A, in a second embodiment of the retaining feature 146', the retaining feature 146' takes the form of a notch assembly 150. The notch assembly 150 comprises a notch housing 152. The notch housing 152 comprises two elongate notch arms 154 extending from a notch base 156 to form a notch 158. The notch base 156 may be slidably coupled to the litter frame 20, optionally with a damping device, such as to one of the longitudinal support rails 22, or may be fixed relative to the litter 14. This allows the retaining feature 146' to move relative to the litter frame 20. While illustrated as the retaining feature 146' being coupled to the litter frame 20, it should be further appreciated that the retaining feature 146' may alternatively be coupled to the side rails, footboard, etc.

In the illustrated embodiment, a gripping member 160 may be disposed within the notch 158 to further enhance the coupling between the retaining feature 146 and the accessory post 48. In one embodiment, the gripping member 160 takes the form of a deformable cuff 160 configured to engage the accessory post 48 of the wheeled accessory 44. During operation, the deformable cuff 160 deforms to at least partially surround the accessory post 48 and constrain movement of the accessory post 48 relative to the litter 14 of the patient support apparatus 10. Friction and pressure from the deformable cuff 160 prevent the accessory post 48 from accidently disengaging from the retaining feature 146. It should be appreciated that the gripping members may assume any suitable shape and dimension, and may be dome-shaped, hourglass-shaped, etc. In embodiments where the gripping member assumes an hourglass cross-sectional shape, the gripping member has end portions 160*a* and a middle portion 160*b*. The middle portion 160*b* grips the accessory post 48 while the end portions 160*a* provide clearance for the accessory post 48 when the litter 14 is tilted into the Trendelenburg or reverse Trendelenburg positions. The deformable cuff 160 may be deformed further to engage a second accessory post (not shown), where the second accessory post has a diameter larger than the first accessory post. Alternatively, the gripping member may take the form of a biased clip disposed within the notch. This biased clip may assume various configurations, such as a bent metal clip. The gripping member 160 can further function to lessen the noise caused by the abutting of the accessory post 48 and the retaining feature.

Referring specifically to FIG. 6A, in yet another embodiment, the retaining feature 146 takes the form of a groove 162 disposed within the bumper 28. The groove 162 is generally dimensioned and shaped to accommodate the accessory post 48 of the wheeled accessory 44. In the illustrated embodiment, the groove 162 has a U-shape, however other shapes are also contemplated. The groove 162 opens laterally toward the outer surface of the bumper 28 such that the caregiver can position the accessory post 48 of the wheeled accessory 44 within the groove 162. The groove 162 may further comprise the gripping member described above. Based on the lateral opening direction of the groove 162, if the patient support apparatus 10 is pushed forward in a generally longitudinal direction, the accessory post 48 will remain in the groove 162.

Referring specifically to FIG. 18, in a first embodiment of the retaining feature 146, the retaining feature 146 takes the form of a channel element 148 coupled to the bumper 28 of the patient support apparatus 10. The channel element 148 is configured to engage the accessory post 48 when the accessory post 48 is pressed against the channel element 148. Similarly, when the accessory post 48 is pulled by the caregiver away from the litter 14, the channel element 148 decouples from the accessory post 48 to allow unconstrained movement of the wheeled accessory 44. The channel element 148 may comprise an elastomeric material, such as rubber, such that the channel element 148 deforms to engage the accessory post 48.

It should be appreciated that various combinations of the accessory couplers described above may be utilized. For example, with reference to FIG. 7A, the offset member 67 may be used in combination with the notch assembly 150 to couple the accessory post 48 to the patient support apparatus 10. Similarly, with reference to FIG. 6A, the groove 162 may be used in combination with the clamp 43. It may be particularly useful to include one of the accessory couplers that is coupled to the litter in combination with one of the movable accessory couplers that is coupled to the patient support base and in the first position. Such a configuration allows multiple points of contacts with the accessory post 48 of the wheeled accessory 44 to provide additional stability.

As described above, the configuration of the accessory coupler is not particularly limited so long as the accessory coupler is capable of the engaging at least a portion of the wheeled accessory 44. Detailed descriptions of additional embodiments of the accessory coupler are described below.

Referring again to FIGS. 6A and 6B, the accessory coupler takes the form of clamp 43. Clamp 43 comprises two clamp fingers 164 pivotably coupled to a clamp body 166. The clamp fingers 164 are movable relative to the clamp body 166 such that the clamp 43 can assume both a clamped configuration and unclamped configuration. In the clamped configuration a distal end of the clamp fingers 164 are spaced at a distance smaller than the diameter of the accessory post 48. In the unclamped configuration, the clamp fingers 164 are spread apart at a distance larger than the diameter of the accessory post 48, such that the accessory post 48 can be engaged between the clamp fingers 164. The clamp fingers 43 are operatively coupled to a clamp switch 168. The clamp switch 168 may assume various forms, as described with respect to the user input device above. However, in the illustrated embodiment, the clamp switch 168 takes the form of a foot operated button. Depression of the clamp switch 168 moves at least one of the clamp fingers 164 such that the clamp 43 moves from the unclamped configuration to the clamped configuration, or vice-versa. Thus, in one mode of operation, the caregiver may depress the clamp switch 168 to move the clamp 43 to the unclamped position; move the wheeled accessory such that the accessory post 48 is disposed between the clamp fingers 164; and subsequently depress the clamp fingers 164 to move the clamp 43 back into the clamped position.

In other configurations, where no clamp switch is utilized, one or two of the clamp fingers 164 may be biased toward the clamped configuration with a spring or other biasing device.

Figure 9C:
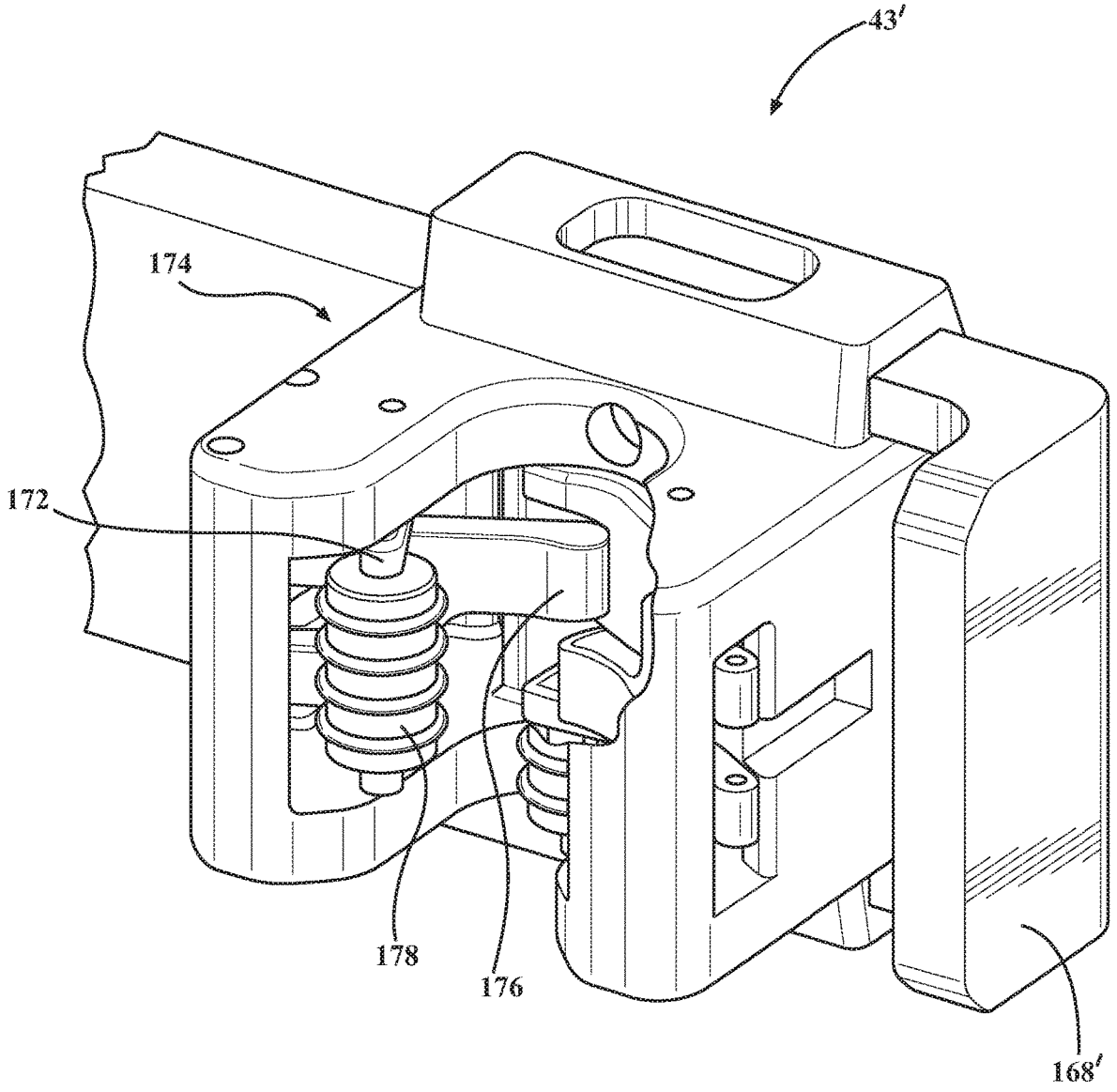
FIG. 9C is a perspective view of a patient support apparatus with a wheeled accessory coupled to an accessory coupler in a first position.

With reference to FIGS. 9B and 9C, in other embodiments, the accessory coupler takes the form of clamp 43'. Clamp 43' is configured to automatically switch from the unclamped configuration to the clamped configuration when the accessory post is engaged with the clamp 43'. To switch the clamp 43' from the clamped configuration to the unclamped configuration in order to decouple the wheeled accessory from the clamp 43', the caregiver must actuate clamp switch 168', which assumes the form of a foot switch that can be engaged by being pressed inwardly toward to the patient support base.

The accessory coupler, such as clamp 43', may further be configured to eject the accessory post 48 from the clamp 43' when the caregiver depresses clamp switch 168'. In this embodiment, the clamp switch 168' is operatively coupled to the engagement member 176 of the clamp 43'. More specifically, if clamp 43' is in clamped configuration with the accessory post 48 engaged with the clamp 43', and the caregiver depresses the clamp switch 168', the clamp 43' ejects the accessory post 48.

In the illustrated embodiment, with reference to FIG. 9C, clamp 43' comprises two detent arms 172 each pivotably coupled to a clamp housing 174 and an engagement member 176 that cooperates with the detent arms 172 to eject the accessory post from the clamp 43'. Each of the detent arms 172 comprises a roller element 178 coupled to a distal end of the detent arms 172. To couple the accessory post to the clamp 43', the accessory post is moved into contact with the detent arms 172. The accessory post causes the detent arms 172 to pivot toward each other automatically pressing the roller elements 178 into contact with the accessory post to secure the accessory post in the clamp housing 174. The caregiver depresses the clamp switch 168' to disengage the clamp 43'. More specifically, the clamp switch 168' is operatively coupled to the engagement member 176 which simultaneously pivots the detent arms 172 to move the roller elements 178, and ejects the accessory post out of the clamp housing 174.

In certain embodiments, the accessory coupler, such as clamp 43', may be further configured to automatically engage and disengage the wheeled accessory 44 when the wheeled accessory 44 is forced into the clamp 43'. The clamp 43' may comprise a spring (not shown) coupled between the roller elements 178 and the clamp housing 174. When a force applied to engage the wheeled accessory 44 with the clamp 43' exceeds a predetermined level the roller elements 178 move away from the accessory post allowing the accessory post to move into the clamp housing 174. The springs press the roller elements 178 into contact with the accessory post to secure the accessory post in the clamp housing 174. The caregiver may eject the accessory post by applying a force greater than the predetermined level. Advantageously, the spring may prevent damage to the patient transport system PS or the wheeled accessory 44. For example, if one of the legs 56 of the wheeled base 46 unintentionally collides with an obstacle, such as a doorframe or medical equipment, the force applied to the wheeled accessory 44, and accordingly to the accessory coupler, could exceed the predetermined level, and would cause the clamp 43' to release the accessory post. More specifically, such a force would disengage the accessory post from the roller elements 178.

With reference to FIGS. 7A-7F, the accessory coupler takes the form of offset member 67. Offset member 67 may assume the shape of a dog-leg in certain embodiments as described above. Offset member 67 may comprise a first end coupled to the coupler arm assembly 70' and a second end configured to engage the accessory post 48. The second end comprises a C-shaped member 180. Offset member 67 further comprises clamp fingers 182 that are configured to extend or recede from the inner face of the C-shaped member 180 to assume the clamped configuration and the unclamped configuration respectively. The clamp fingers 182 are operatively coupled to a clamp trigger 184. The clamp trigger 184 is a mechanical or electrical device that, when engaged through contact or proximity with the accessory post 48, and causes the clamp fingers 182 to extend from the C-shaped member 180 to engage the accessory post 48.

The offset member 67 further comprises a clamp switch 168", shown in the form of a foot-operated button that is also operatively coupled to the clamp fingers 182. In the illustrated embodiment, the offset member 67 has a generally trapezoidal cross-sectional shape to present the foot-operated button at an angle to facilitate easy engagement by the caregiver. The foot-operated button may assume any suitable configuration, such as rectangular or round shapes. Through actuation of the clamp switch 168" with the caregiver's foot, the clamp fingers 182 move from the clamped configuration to the unclamped configuration, or vice-versa. It is to be appreciated that the clamp fingers 182 may move farther or closer together to accommodate a second accessory post having a different shape or diameter. Furthermore, the clamp 43 may comprise a gripping portion and a mouth portion as described above. The mouth portion allows entry of the accessory post into the clamp, and the accessory post rests within the gripping portion.

In other configurations, where no clamp switch is utilized, one or two of the clamp fingers 182 may be biased toward the clamped configuration with a spring or other biasing device. Additionally, the clamp fingers 182 may be deformable such that the accessory post 48 may be engaged with the offset member 67 by forcing the accessory post 48 past the clamp fingers 182 and into the C-shaped member 180. It is to be appreciated that the clamp fingers 182 may deform more or less to accommodate a second accessory post having a different shape or diameter.

It is further contemplated that the offset member 67 comprises a magnetic element (not shown). The magnetic element generates a magnetic force that secures the wheeled accessory 44 to the accessory coupler. To engage the accessory post 48 with the magnetic element, the caregiver need only place the accessory post 48 near the offset member 67 and the force from the magnetic element will automatically secure the wheeled accessory 44 to the accessory coupler. The caregiver can disengage the accessory post 48 from the magnetic element by moving the wheeled accessory 44 away from the accessory coupler with a force greater than the force generated by the magnetic element.

Figure 7E:
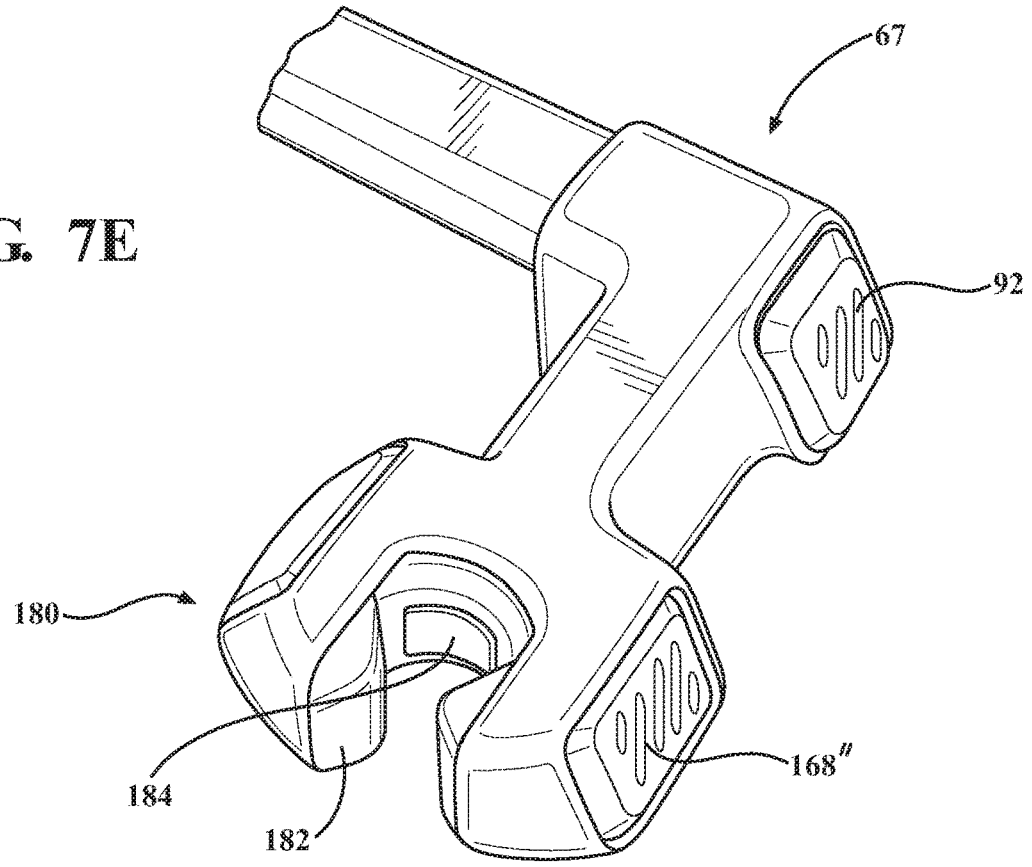
FIG. 7E is a partial perspective view of the accessory coupler of FIG. 7A in an unclamped configuration.
Figure 7F:
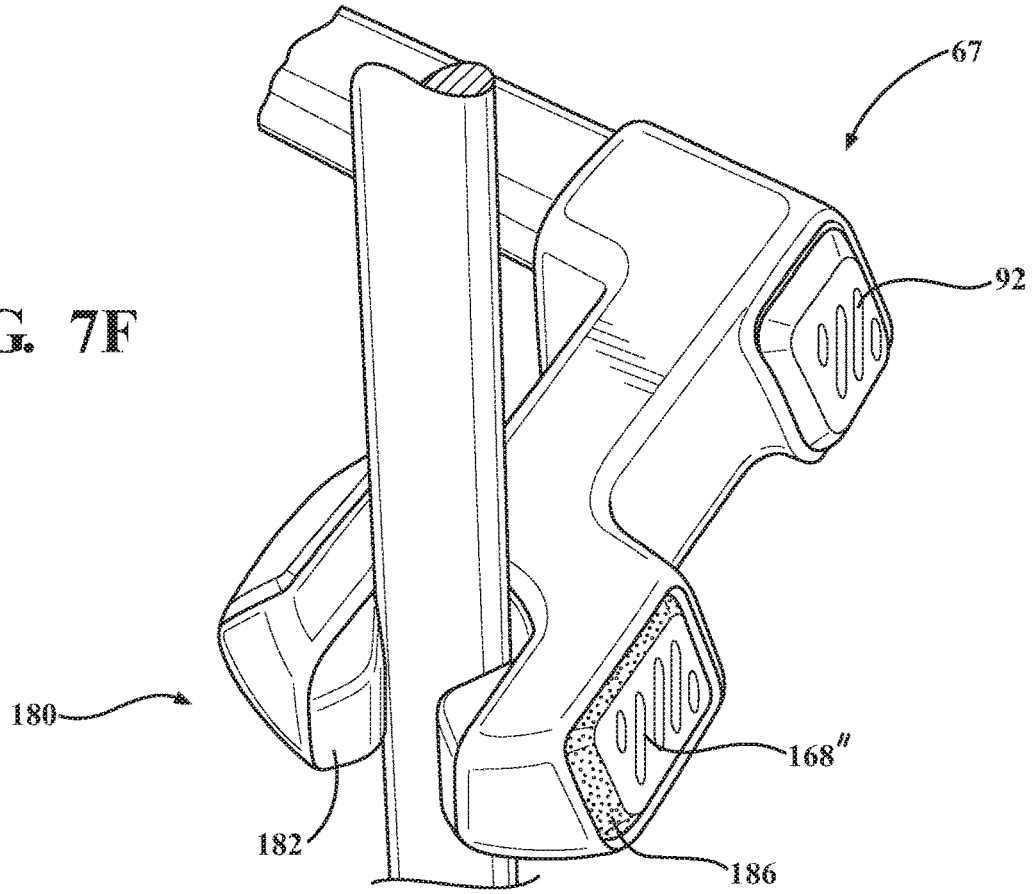
FIG. 7F is a partial perspective view of the accessory coupler of FIG. 7A in a clamped configuration.

Referring specifically to FIGS. 7E and 7F, the accessory coupler, such as the offset member 67 may further comprise an indicator device 186 to generate feedback confirming that the accessory post 48 is properly engaged with the offset member 67. In the illustrated embodiment, the indicator device 186 is coupled to clamp trigger 184. When the clamp trigger 184 is pressed against the accessory post 48, the indicator device 186 generates visual feedback in the form of a visual indicator 186 visible to the caregiver when the accessory post 48 is engaged with the accessory coupler 42. The visual indicator 186 may be a colored segment of the clamp switch 168" that is hidden when the accessory post 48 is not engaged with the accessory coupler 42, and is visible when the accessory post 48 is engaged with the accessory coupler 42. Additional indicator devices 186 that generate audible feedback, such as a click or a chime are also contemplated. Indicator devices 186 that generate other types of feedback, such as an illuminated light source from an electrical circuit completed when the accessory post 48 is engaged with the accessory coupler 42 are also contemplated.

With reference to FIG. 19, the accessory coupler takes the form of a ball detent assembly 190. The ball detent assembly 190 comprises three detent elements 192 coupled to a detent housing 194. The detent housing 194 forms a channel segment 196 with the detent elements 192 movably disposed around the channel segment 196. A biasing element 198 is in operable communication with each detent element 192 to bias the detent elements 192 toward the channel segment 196. The detent elements 192 are arranged such that a pocket 200 with a diameter smaller than that of the accessory post 48 is formed between the three detent elements 192. When the accessory post 48 is engaged with the ball detent assembly 190, the biasing elements 198 move toward the channel segment 196 to retain the accessory post 48 in the pocket 200. The ball detent assembly 190 may further comprise threaded adjusters 202 to increase or decrease force applied by the biasing elements 198 on the detent elements 192 such that engaging the accessory post 48 requires a larger or smaller force to engage with the ball detent assembly 190. The movable nature of the detent elements 192 allows the ball detent assembly 190 to accommodate accessory posts having different diameters.

With reference to FIG. 20, the accessory coupler takes the form of a cantilever pedal clamp 204. The cantilever pedal clamp 204 comprises two clamp fingers 206 pivotably coupled to a clamp body. The clamp fingers 206 are movable relative to the clamp body such that the cantilever pedal clamp 204 can assume both a clamped configuration and unclamped configuration. In the clamped configuration a distal end of the clamp fingers 206 are spaced at a distance smaller than the diameter of the accessory post 48. In the unclamped configuration, the clamp fingers 206 are spread apart at a distance larger than the diameter of the accessory post 48, such that the accessory post 48 can be positioned between the clamp fingers 206. The clamp body may be coupled to the coupler arm, which may be coupled to either the patient support base or the litter, as described above. The clamp fingers 206 are operatively coupled to a clamp pedal 208. The clamp pedal 208 may assume various forms, as described with respect to the user input device above. However, in the illustrated embodiment, the clamp pedal 208 takes the form of a foot operated pedal. The cantilever pedal clamp 204 further comprises an actuator shaft 210. The actuator shaft comprises a cam element in communication with the clamp fingers 206 such that displacement of the actuator shaft pivots at least one of the clamp fingers 206 moving cantilever pedal clamp 204 from the unclamped configuration to the clamped configuration, or vice-versa. The actuator shaft 210 is coupled to the clamp pedal 208 such that depression of the clamp pedal 208 displaces the actuator shaft 210. Thus, in one mode of operation, the caregiver may depress the clamp pedal 208 to move the cantilever pedal clamp 204 to the unclamped position; move the wheeled accessory such that the accessory post 48 is disposed between the clamp fingers 206; and subsequently depress the clamp pedal 208 to move the cantilever pedal clamp 204 back into the clamped position.

Figure 21:
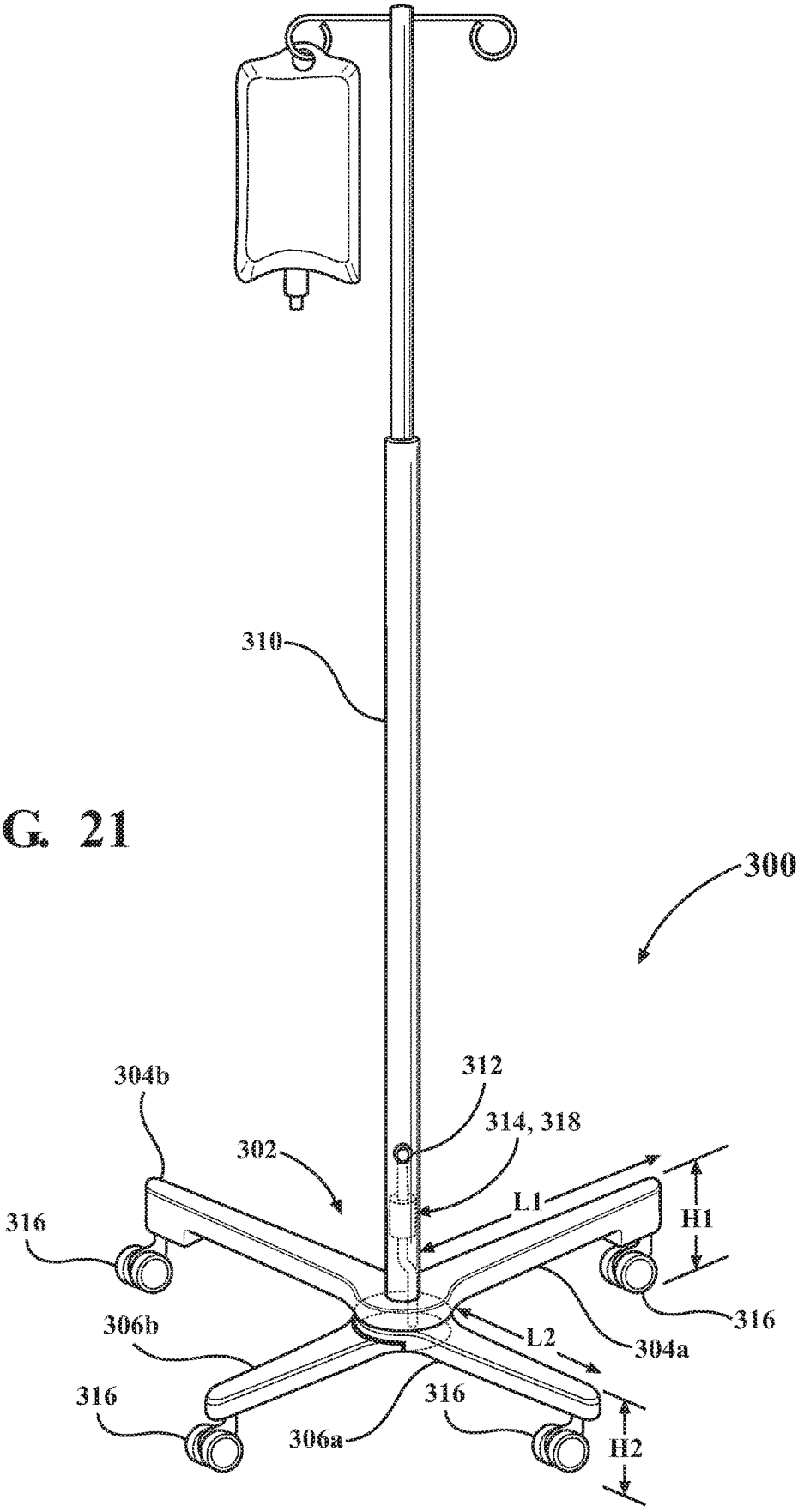
FIG. 21 is a perspective view of another embodiment of a wheeled accessory in a first configuration.

Referring now to FIG. 21, another embodiment of a wheeled accessory is shown as a folding support 300. The folding support 300 comprises an accessory base 302, first legs 304*a*, 304*b*, and second legs 306*a*, 306*b*. Each of the first legs 304*a*, 304*b* and the second legs 306*a*, 306*b* are coupled to the accessory base 302, and radially arranged about the accessory base 302. The first legs 304*a*, 304*b* and the second legs 306*a*, 306*b* cooperate to define a footprint 308 of the folding support 300.

While the exemplary folding support 300 has four legs, it should be appreciated that the folding support may comprise combinations totaling fewer than four legs. For example, the folding support may comprise three, or five or more legs.

As described in greater detail above, the accessory coupler 42 is capable of releasably securing the folding support 300. The accessory coupler 42 is movable relative to the patient support base 12 to position the folding support 300 nearer to the patient support apparatus 10 such that one of the bed wheels 18 is at least partially nested between the first legs 304*a*, 304*b*. As described above, the accessory coupler 42 may take any suitable form for coupling to the folding support 300.

In one embodiment, at least one of the first legs 304*a*, 304*b* has a length L1 and a height H1. At least one of the second legs 306*a*, 306*b* has a length L2 and a height H2. In the illustrated embodiment, the second legs 306*a*, 306*b* are respectively smaller than the first legs 304*a*, 304*b*. More specifically, in one embodiment, the height H2 of the second leg 306*a* is less than the height H1 of the first leg 304*a*, and the length L2 of the second leg 306*a* is less than the length L1 of the first leg 304*a*. It should be appreciated that each of the first legs 304*a*, 304*b* may have different heights from one another. It should be also be appreciated that the first legs and the second legs may have the same height as one another. In certain configurations, the height of the first leg and the height of the second leg refers to only a portion of the respective leg, i.e., a portion of one of the legs is recessed to accommodate the first and second legs aligning with one another in a compact fashion.

The folding support 300 may further comprise an accessory wheel 316 coupled to each of the first legs 304*a*, 304*b* and the second legs 306*a*, 306*b*. The accessory wheels 316 allow the accessory base 302 to be moved along a surface such as a floor of a healthcare facility. The accessory wheels 316 may be further defined as caster wheels.

Figure 23A:
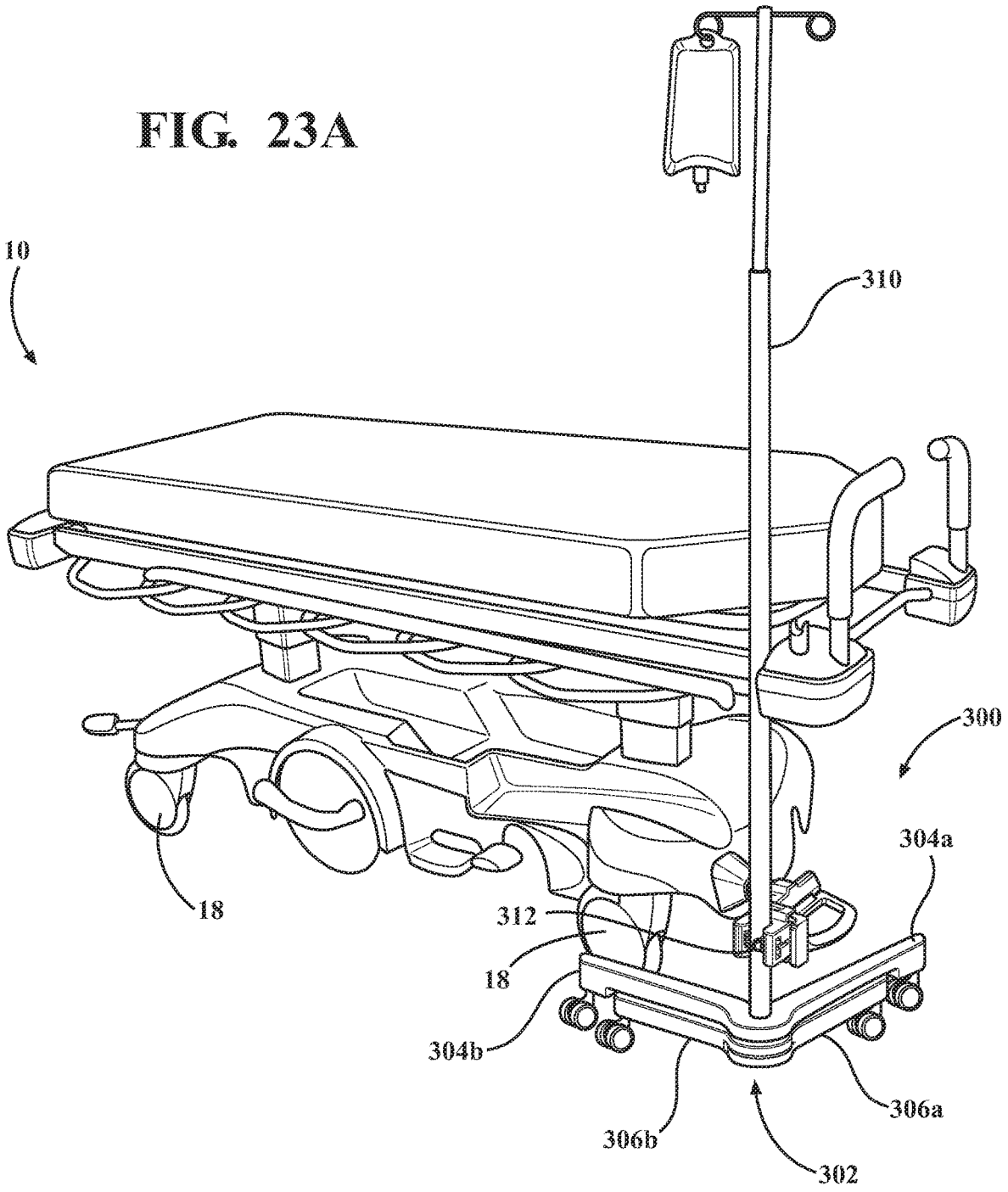
FIG. 23A is a perspective view of a patient transport system with a patient support apparatus having an accessory coupler in a first position and the wheeled accessory of FIG. 21 in a second configuration coupled to the accessory coupler.
Figure 23B:
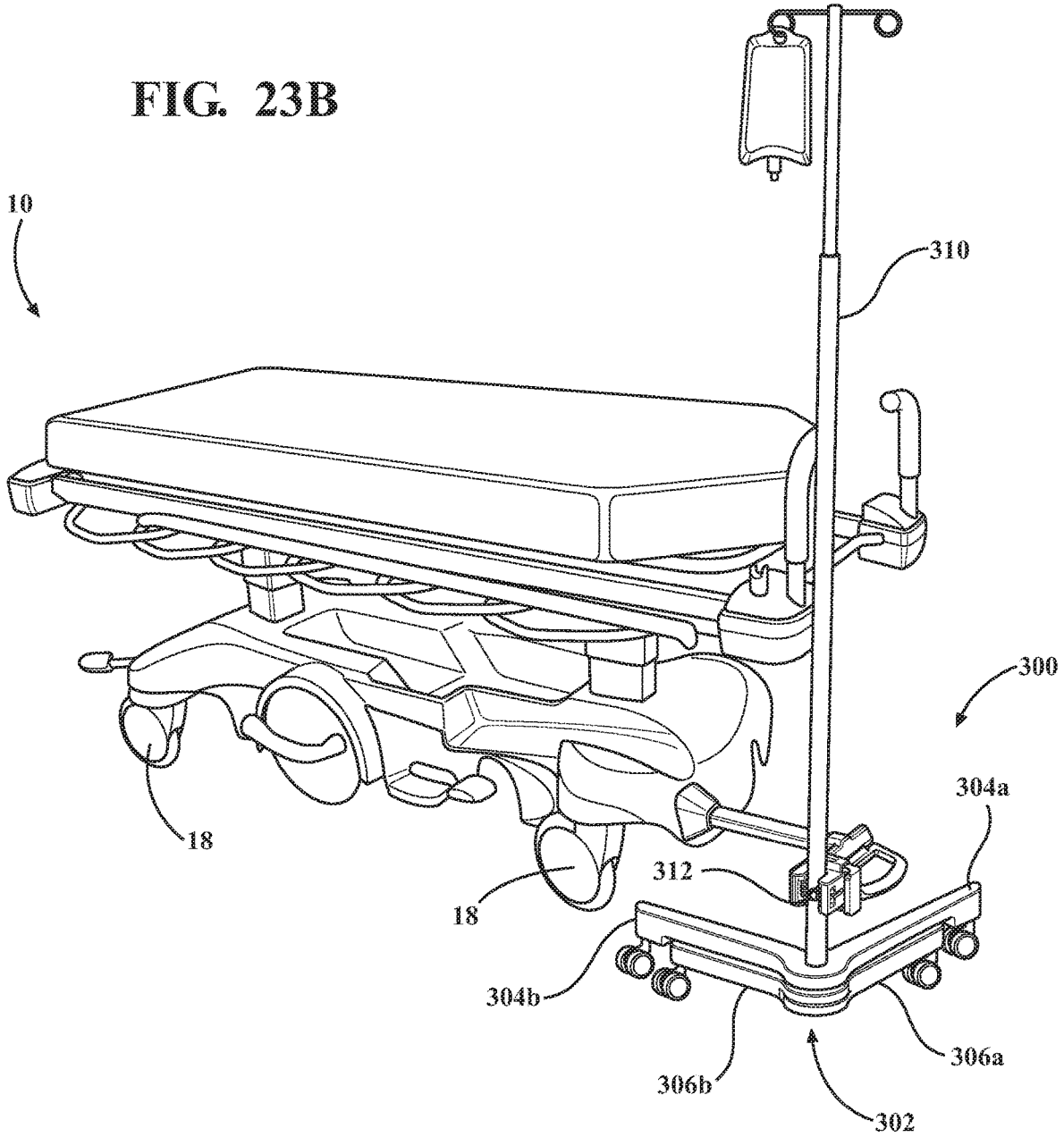
FIG. 23B is a perspective view of the patient transport system of FIG. 23A with a patient support apparatus and the accessory coupler in a second position and the wheeled accessory of FIG. 21 in the second configuration coupled to the accessory coupler.
Figure 24:
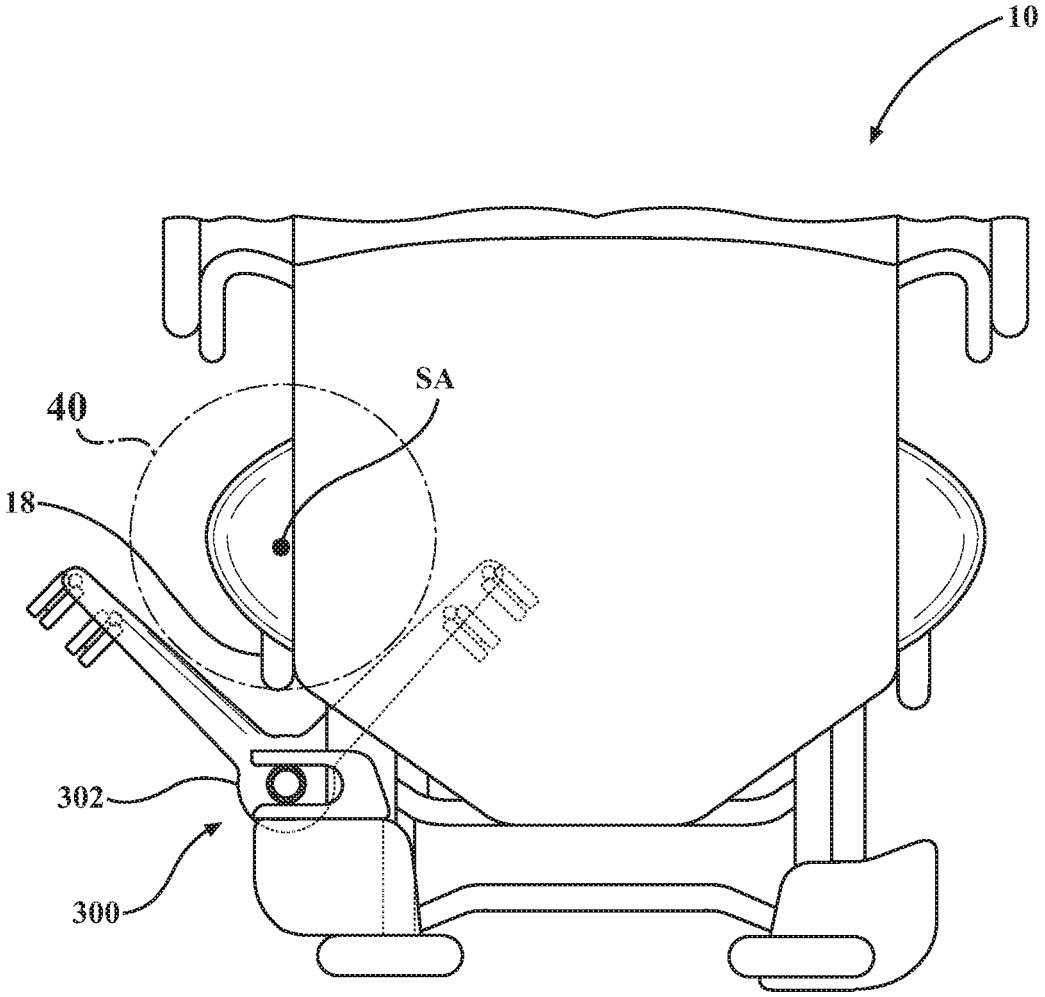
FIG. 24 is a partial top view of a patient transport system with the wheeled accessory of FIG. 21 coupled to a patient support apparatus.

As illustrated, the second legs 306*a*, 306*b* are coupled to the accessory base 302 and are each independently movable relative to the one or more first leg 304*a*, 304*b* between a first position, as shown in FIG. 21, and a second position, as shown in FIGS. 23A-24. For example, when the second legs 306*a* is moved between the first position and the second position, relative to the first leg 304*a*, the second leg 306*a* generally moves along the surface to become nearer to the first leg 304*a* while the first leg 304*a* is generally stationary on the surface. In the illustrated embodiment, the second legs 306*a*, 306*b* are pivotably coupled to the accessory base 302.

The folding support 300 may be placed in a first configuration where one or more of the second legs 306*a*, 306*b* is in the first position (see FIG. 21), and in a second configuration where one or more of the second legs 306*a*, 306*b* is in the second position (see FIG. 23A). It should be appreciated that the second legs 306*a*, 306*b* are movable into any number of intermediate positions between the first position and the second position.

With continued reference to FIG. 21, in the first configuration, each of the first legs 304*a*, 304*b* and the second legs 306*a*, 306*b* are radially arranged about the accessory base 302, spaced apart from one another. The first legs 304*a*, 304*b* and the second legs 306*a*, 306*b* each extend laterally from the accessory base 302 to support the folding support 300. In the first position, the second leg 306*a* generally extends laterally from the accessory base 302 and is spaced apart from the first leg 304*a*.

Figure 22:
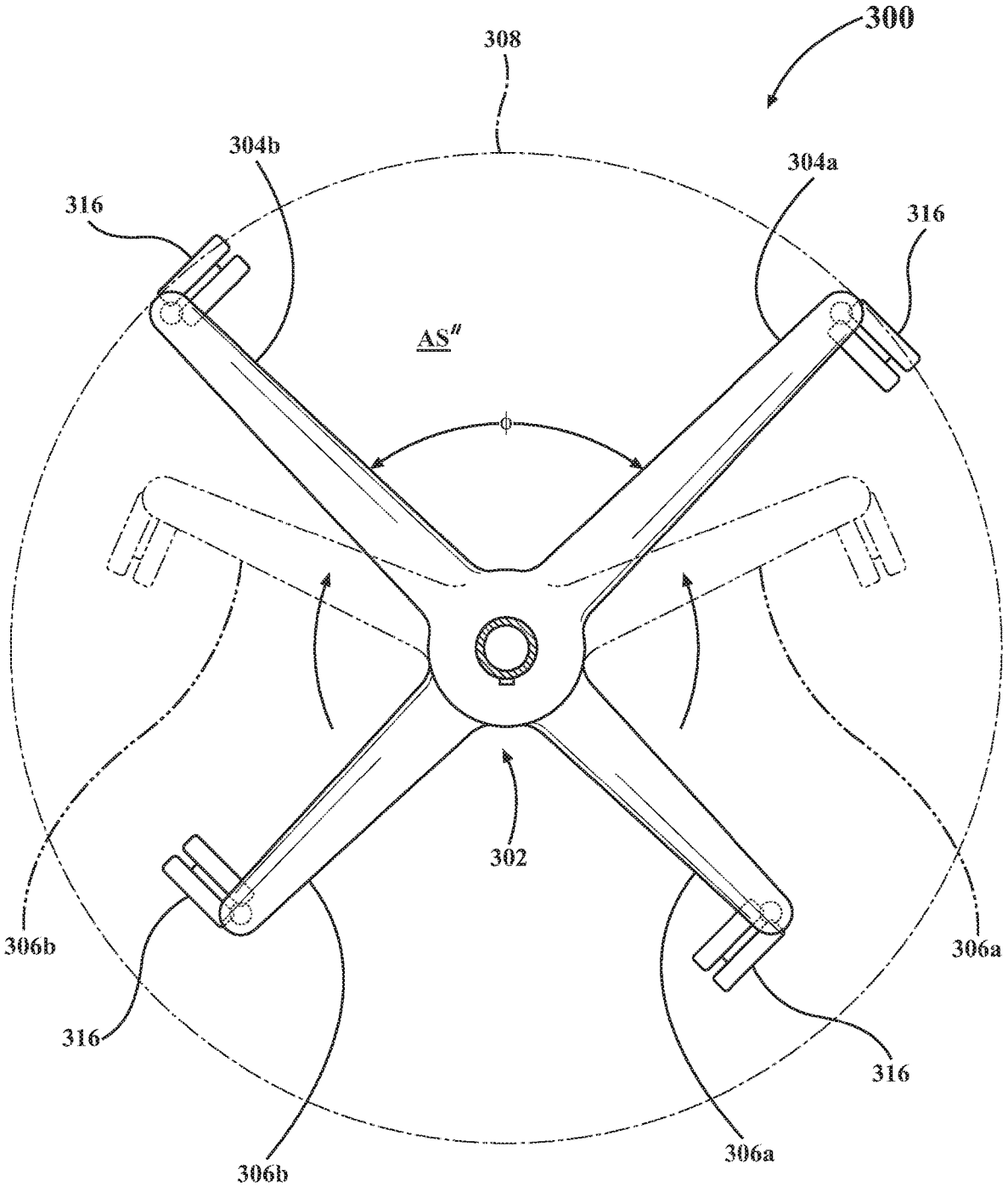
FIG. 22 is a top view of the wheeled accessory of FIG. 21 in the first configuration with an intermediate configuration shown in phantom.

Referring now to FIG. 22, the folding support 300 is shown in the first configuration with the second legs 306*a*, 306*b* in the first position. Additionally, the folding support 300 is shown in phantom in an intermediate configuration, with the second legs 306*a*, 306*b* in the intermediate position. Arrows generally indicate movement of the second legs 306*a*, 306*b* between the first position and the second position.

The folding support 300 is shown in the second configuration in FIGS. 23A-24. In the second configuration, the second legs 306*a*, 306*b* are in the second position, and beneath the first legs 304*a*, 304*b*. In the second position, the second leg 306*a* extends laterally from the accessory base 302 and is substantially collinear with the first leg 304*a*, and the second leg 306*b* is substantially collinear with the first leg 304*b*. It should be appreciated that the second position may also be understood as a position where the second legs 306*a*, 306*b* are closer in proximity to the first legs 304*a*, 304*b* than in the first position, without actually being collinear.

As an alternative embodiment, in the second position, the angle formed between the second leg 306*a* and the first leg 304*a* is less than the angle formed between the second leg 306*a* and the first leg 304*a* in the first position. Similarly, in the second position, the angle formed between the second leg 306*b* and the first leg 304*b* is less than the angle formed between the second leg 306*b* and the first leg 304*b* in the first position. It should be appreciated that the angle of the second position may be zero, such that the legs are aligned, or collinear.

The folding support 300 may be coupled to a patient support apparatus 10 comprising an accessory coupler 42. FIGS. 23A and 23B illustrate a movable coupler and patient support apparatus similar to the patient support apparatus 10 and accessory coupler described above. It is contemplated that the folding support 300 is compatible with any of the accessory couplers illustrated herein.

For example, the folding support 300 is shown engaged with an accessory coupler similar to the clamp 43' as shown in FIGS. 9B and 9C. In this example, when the folding support 300 is coupled to the patient support apparatus 10, the accessory post 310 is disposed in the clamp housing 174 and retained by the detent arms 172. As such, when a user moves the patient support apparatus 10 along the floor surface of a healthcare facility, the folding support 300 is similarly moved by the patient support apparatus 10.

Additionally, the user may decouple the folding support 300 from the patient support apparatus 10 in a manner similar to that described above. For example, when the accessory post 310 is engaged with an accessory coupler, such as the clamp 43 shown in FIGS. 6A and 6B, the user may depress the clamp switch 168 to move the clamp 43 into the unclamped configuration thereby decoupling the folding support 300 from the patient support apparatus 10. When the folding support 300 is decoupled form the patient support apparatus 10, movement of the patient support apparatus 10 by a user does not result in coordinated motion of the folding support 300.

In certain embodiments, the folding support 300 may comprise the accessory post 310. As illustrated, the accessory post 310 is supported on the accessory base 302 and configured to support a medical accessory. For example, the medical accessory may be IV fluids, or other accessories used for patient care. The accessory post 310 may have an accessory post footprint as is described above. When the folding support 310 is coupled to the movable coupler, the accessory post footprint may be partially within the litter footprint. Additionally, the footprint 308 of the folding support 300 may at least partially overlap with the litter footprint.

The folding support 300 may comprise a switch 312, shown as a button, operatively coupled to the accessory base 302. The switch 312 is configured to detect when the folding support 300 is coupled to the patient support apparatus 10. For example, the switch 312 may be activated when the folding support 300 is coupled to the patient support apparatus 10. The switch 312 may be any type of mechanical or electrical switch or sensor suitable to detect when the folding support 300 and the patient support apparatus 10 have been coupled. For example, the switch 312 may be a mechanical linkage movable in response to an external force, an electrical switch that completes a circuit, a Hall Effect sensor that senses a presence of the accessory post 310. While not particularly limited, the switch 312 may be advantageously positioned and/or configured such that the switch 312 is triggered when the accessory post 310 is positioned adjacent or in contact with the accessory coupler 42.

While the switch 312 is illustrated on the accessory post 310 and near the floor surface, the switch 312 may be positioned in any suitable location on the folding support 300 to detect when any of the accessory couplers illustrated throughout the Figures are engaged with the folding support 300. For example, in the embodiment where the accessory coupler is the deformable cuff 160 and arranged on the litter 14, the switch 312 would be arranged on the accessory post 310 at a height similar to the height of the litter 14. Alternatively, the switch 312 may be arranged on the accessory base 302.

Activation of the switch 312 may enable one or more of the second legs 306*a*, 306*b* to move out of the first position, i.e., to the second position where one or more of the second legs 306*a*, 306*b* are positioned at least partially beneath one of the first legs 304*a*, 304*b*. The switch 312 is configured to be triggered when the folding support 300 is coupled to the patient support apparatus 10 via the accessory coupler 42. As such, the switch 312 has two states, a triggered state and an untriggered state. The triggered state corresponds to the folding support 300 being coupled to the patient support apparatus 10 and the untriggered state corresponds to the folding support 300 being decoupled from the patient support apparatus 10. In the embodiment where the switch is an electrical switch, the triggered state may correspond to a change in voltage, a change in current, or a change in resistance. Alternatively, in the embodiment where the switch is a sensor, the triggered position may correspond to a change in a digital or analog signal generated by the switch.

The folding support 300 may further comprise a linkage 314 coupled to the accessory base 302 and in operative communication with the switch 312. The linkage 314 has a first position that limits movement of the second legs 306*a*, 306*b* relative to the respective first legs 304*a*, 304*b*, and a second position that permits movement of the second legs 306*a*, 306*b* relative to the respective first legs 304*a*, 304*b*. When the folding support 300 is connected to the patient support apparatus 10, the switch 312 causes the linkage 314 to move from the first position to the second position, thereby allowing one or more of the second legs 306*a*, 306*b* to be moved beneath the first legs 304*a*, 304*b*.

The linkage 314 may be coupled to a spring configured to exert a force to pivot each of the second legs 306*a*, 306*b* relative to the accessory base 302 from the first position to the second position. More specifically, the spring may pivot the second legs 306*a*, 306*b* from the first position extending laterally from the accessory base 302 to the second position extending laterally from the accessory base 302 and toward the patient support apparatus 10. The spring is engaged by the switch 312 such that when the switch 312 is triggered the spring moves one or more of the second legs 306*a*, 306*b* into the second position via the linkage 314.

If the switch 312 remains untriggered, one or more of the second legs 306*a*, 306*b* may be movable from the second position to the first position as the absence of a triggering event indicates that the folding support 300 is decoupled from the patient support apparatus 10. In certain embodiments, if the switch 312 detects that the folding support 300 is decoupled from the patient support apparatus 10, the switch 312 causes the linkage 314 to permit one or more of the second legs 306*a*, 306*b* to move from the second position to the first position to prevent the folding support 300 from tipping.

In some embodiments, the linkage 314 may only move one of the second legs 306*a*, 306*b* from the first position to the second position. When the folding support 300 is coupled to the patient support apparatus 10 the linkage 314 automatically moves at least one of the second legs 306*a*, 306*b* into the second position, however when the folding support 300 is decoupled from the patient support apparatus 10, the linkage 314 does not automatically move the second legs 306*a*, 306*b* back to the first position. In this embodiment, the user may be required to manually pivot each of the second legs 306*a*, 306*b* from the second position into the first position. If the folding support 300 is subsequently re-coupled to the patient support apparatus 10, the linkage 314 will again move at least one of the second legs 306*a*, 306*b* to the second position via the spring or other suitable mechanism.

In some embodiments, the folding support 300 may further comprise an actuator 318 in communication with the switch 312. The actuator 318 is coupled to either one or more of the first legs 304*a*, 304*b* or one or more of the second legs 306*a*, 306*b*. The actuator 318 may be coupled to each of the second legs 306*a*, 306*b* and be configured to pivot each of the second legs 306*a*, 306*b* relative to the accessory base 302. The actuator 318 pivots the second legs 306*a*, 306*b* between the first position extending laterally from the accessory base 302 and the second position extending laterally from the accessory base 302 and toward the patient support apparatus 10. The actuator 318 may be in operative communication with the switch 312 such that the switch 312 activates the actuator 318 and to move the second legs 306*a*, 306*b* when the folding support 300 is coupled to the patient support apparatus 10, i.e., when the switch 312 is in the triggered state. In one embodiment, the actuator 318 may be electrically powered to move the second legs 306*a*, 306*b*, and may be embodied as a rotary actuator. The actuator 318 may additionally be configured to exert a force on each of the second legs 306*a*, 306*b* in order to move the second legs 306*a*, 306*b* from the second position into the first position when the folding support 300 is decoupled from the patient support apparatus 10, i.e., when the switch 312 transitions from a triggered state to an untriggered state.

With continued reference to FIG. 22, the pair of first legs 306*a*, 306*b* may define an accommodation space AS" having an arc φ. The pair of first legs 306*a*, 306*b* are radially arranged about the accessory post 310 such that the arc φ is less than 180 degrees.

Referring specifically to FIG. 24, where the folding support 300 is in the second configuration and coupled to the patient support apparatus 10, the reduced footprint of the folding support 300 is illustrated. As described above, the patient support apparatus 10 comprises bed wheels 18, which are caster wheels swivelable around a swivel axis SA to define a swivel area 40. When the folding support 300 is coupled to the patient support apparatus 10 the swivel area 40 is inside the accommodation space AS" defined by the first legs 304*a*, 304*b*.

Figure 25:
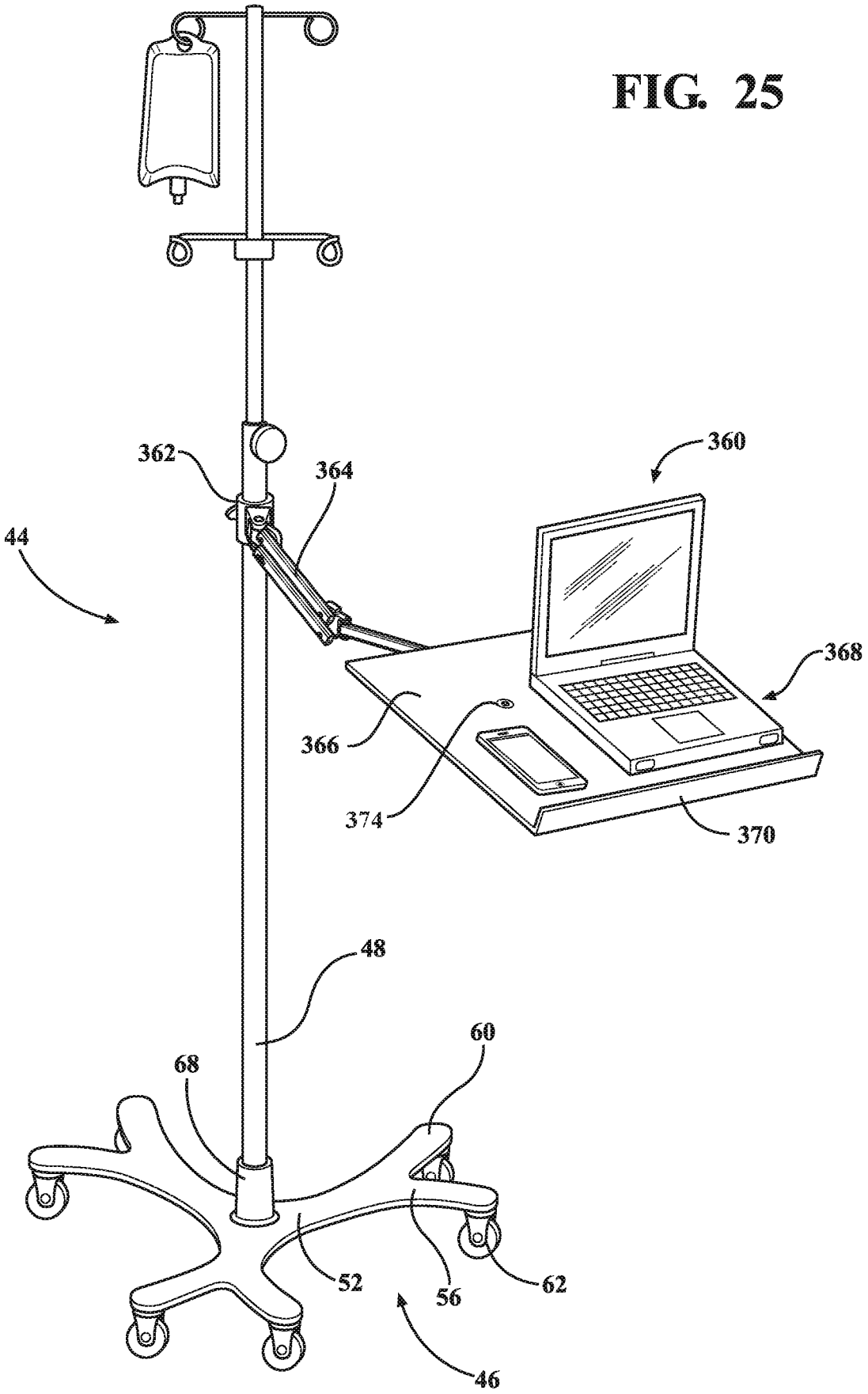
FIG. 25 is a perspective view of a wheeled accessory having an electronics support.

In addition to medical accessories such as infusion pumps or IV fluid, electronic devices may be supported by the wheeled accessory 44. The electronic devices may be supported by an accessory shelf 360. One embodiment of the accessory shelf 360 is illustrated in FIG. 25. The accessory shelf 360 comprises a post coupler 362, a support arm 364, and a platform 366. The support arm 364 is coupled to the post coupler 362 and extends away from the accessory post 48. The platform 366 is supported on the support arm 364 such that the platform 366 is spaced from the accessory post 48. The platform 366 may comprise a raised edge 370 along one or more sides to prevent items from falling off the accessory shelf 360.

Different electronic devices, shown generally at 368, may be supported by the accessory shelf 360. For example, the electronic device may be a personal computer such as a laptop, a tablet device, a cellular phone, or a display and input devices for a surgical navigation system. The electronic device 368 may be mounted to the accessory shelf 360 in a removable fashion.

The accessory shelf 360 may be coupled to the accessory post 48 of the wheeled accessory 44 with the post coupler 362. The post coupler 362 is movable along the accessory post 48 such that the accessory shelf 360 may be placed at different heights as desired by the caregiver. Additionally, the post coupler 362 may be rotated about the accessory post 48 such that the accessory shelf 360 may be placed at different azimuth angles as desired by the caregiver. In other words, the accessory shelf 360 may be rotated around the accessory post 48 to face a different direction. The support arm 364 may include a number of different joints that allow the accessory shelf 360 to be moved into various positions, and retained at those positions until further movement is desired. For example, the support arm 364 may comprise two or more segments that enable the caregiver to reposition the platform 366 during use. Each segment of the support arm 364 may pivot independently of each other such that the support arm 364 may be routed around obstructions. Further, the support arm 364 may allow the platform 366 to be positioned at different angles, such as tilted downward, to accommodate different electronic devices 368.

Figure 26:
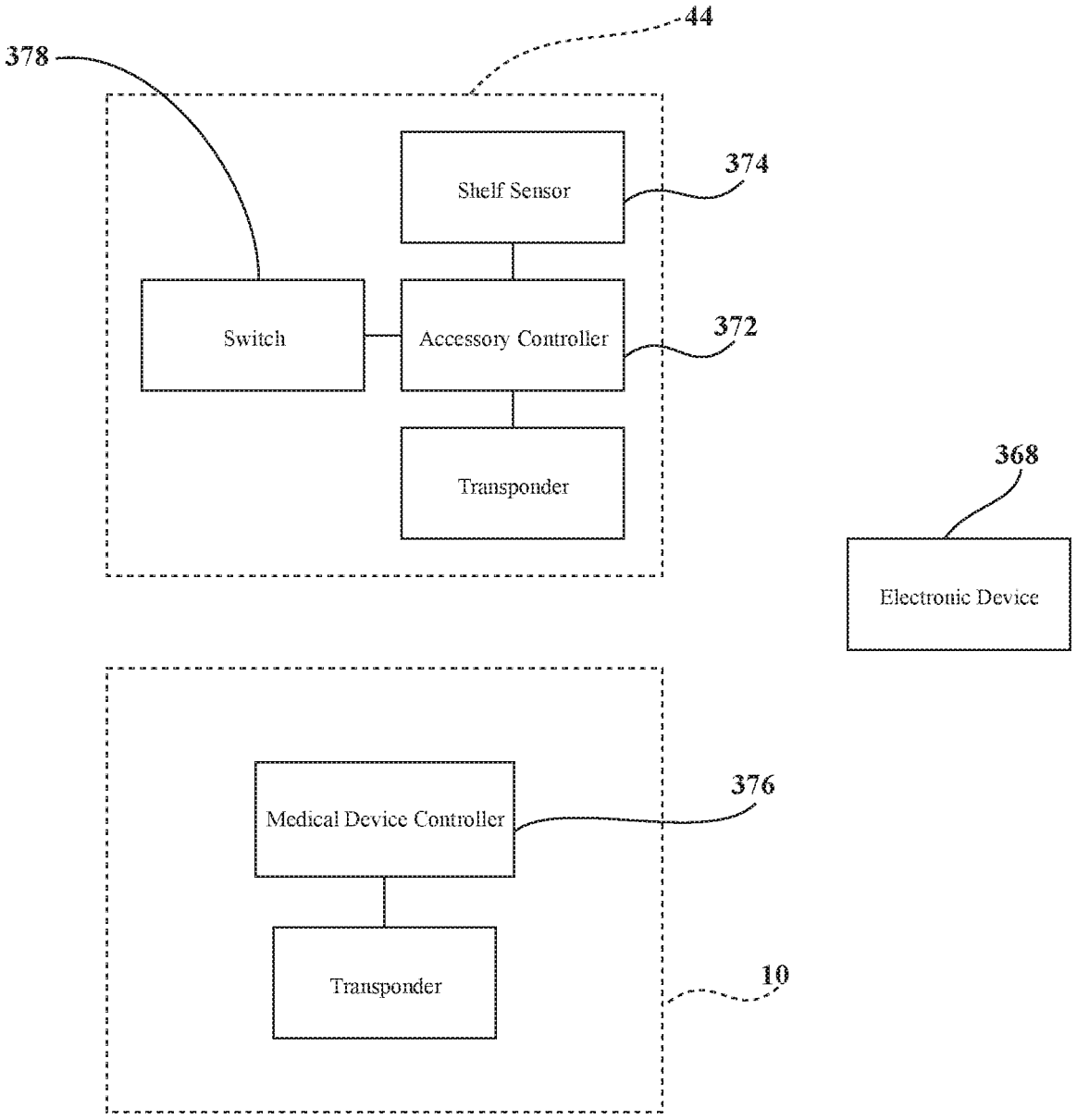
FIG. 26 is a schematic diagram of a wheeled accessory and patient support apparatus.

Referring to FIG. 26, the accessory shelf 360 comprises an accessory controller 372 configured to determine whether the electronic device 368 is supported by the accessory shelf 360. It should be appreciated that the accessory controller 372 may be mounted remotely from the accessory shelf 360. For example, the accessory controller 372 may be mounted to the accessory base, or alternatively, to the patient support apparatus 10.

The accessory shelf 360 may further comprise a shelf sensor 374 configured to detect a presence of the electronic device 368. The shelf sensor 374 electronically communicates with the accessory controller 372 such that the accessory controller 372 may determine whether the electronic device 368 has been placed on, or adjacent to, the platform 366 when the shelf sensor 374 detects the presence of the electronic device 368. In the present embodiment, the shelf sensor 374 is illustrated as an optical eye sensor, however the shelf sensor may be a load sensor, an optical sensor, a proximity sensor, or the like.

The accessory shelf 360 may also comprise a power source configured to provide power to the electronic device 368. For example, the power source may be an inductive charger that wirelessly charges the electronic device 368 placed on the platform 366. When the accessory controller 372 determines that the electronic device 368 is placed on the platform 366 via the shelf sensor 374, the accessory controller 372 may enable the inductive charger. The power source may also be a USB port or household outlet.

Once the accessory controller 372 determines that the electronic device 368 is supported on the platform 366, the accessory controller 372 communicates with a medical device controller 376, such as a controller of the patient support apparatus 10. To accommodate this communication, respective transponders may be mounted to the accessory shelf 360 and the patient support apparatus 10 in some embodiments. In some embodiments, the transponders may be wireless antennas capable of transmitting or receiving via any wireless protocol at any frequency or wavelength of the electromagnetic spectrum at any amplitude, including but not limited to FM, AM, radio frequency (RF), infrared (IR), cellular, 3G, 4G, CDMA, GSM, Bluetooth, Bluetooth low-energy, Wi-Fi, RFID, near-field communication (NFC), VHF, UHF, analog, digital, one way, two way, and combinations thereof.

Once the medical device controller 376 receives a signal indicating that the electronic device 368 is supported by the platform 366, the medical device controller 376 enables a wireless communication between the electronic device 368 and the medical device controller 376 to be established. For example, when a caregiver places a tablet device on the platform 366 a wireless connection between the tablet device and the medical device controller 376 for the patient support apparatus 10 is automatically established.

In certain embodiments, the medical device controller 376 may only enable communication once the wheeled accessory 44 is coupled to the patient support apparatus 10. To accomplish this, the wheeled accessory 44 or the patient support apparatus 10 may include a switch 378 configured to detect when the wheeled accessory 44 is coupled to the patient support apparatus 10. For example, the switch 378 may be activated when the wheeled accessory 44 is coupled to the patient support apparatus 10. The accessory controller 372 may receive an input signal from the switch 378 that is indicative of the coupled state and transmit a coupled state indicator to the medical device controller 376. Upon receiving the coupled state indicator from the accessory controller 372, the medical device controller 376 may enable communication with the electronic device 368. Either of the accessory controller 372 and medical device controller 376 may further comprise a proximity sensor to sense when other medical devices are within a predetermined distance and send a signal to the electronic device 368, which may prompt the caregiver to allow a wireless connection to be automatically established with the other medical device.

Once the wireless connection has been established, the electronic device 368 and the medical device controller 376 may communicate data with each other to facilitate patient care. For example, these data may comprise, patient data such as treatment or therapy records, and remote control signals such as lifting or lowering the litter of the patient support apparatus 10. Additionally, medical device controller 376 may transmit diagnostic information of the patient support apparatus such as service history or errors.

Exemplary operation of the accessory shelf 360 and the wheeled accessory 44 may comprise a step of coupling the wheeled accessory 44 to the patient support apparatus 10. Next, the switch 378 sends a signal to the accessory controller 372 indicating that the wheeled accessory 44 is coupled to the patient support apparatus 10. When the electronic device 368 is placed on the platform 366, the shelf sensor 374 sends a signal to the accessory controller 372. The accessory controller 372 communicates with the medical device controller 376 that the wheeled accessory 44 is coupled to the patient support apparatus 10 and that the electronic device 368 has been placed on the platform 366. Accordingly, the medical device controller 376 enables a wireless communication between the electronic device 368 and the medical device controller 376 to be automatically established. It should be appreciated that the electronic device 368 may be placed on the platform 366 prior to coupling the wheeled accessory 44 to the patient support apparatus 10.

In addition to the above advantages the present invention may also be quickly and efficiently provided on all existing patient support apparatuses without destroying the integrity thereof. The device according to the present invention can also be provided as a standard integral feature on all new patient support apparatuses which may hereinafter be produced.

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient transport system comprising:

a wheeled accessory comprising:

an accessory base;

at least two legs radially extending outwardly from said accessory base, said at least two legs spaced apart from one another to define an accommodation space between said at least two legs; and at least one accessory wheel coupled to each of said legs, wherein at least one of said legs comprises at least two feet, with at least one of said accessory wheels coupled to each of said feet;

a patient support apparatus comprising:

a patient support base;

a patient support surface supported by said patient support base; and wheels coupled to said patient support base; and an accessory coupler capable of releasably securing said wheeled accessory to said patient support apparatus, wherein said accessory coupler is movable relative to said patient support base into a first position and a second position, wherein said accessory base and said patient support apparatus are configured such that at least one of said wheels is at least partially nested within said accommodation space when said wheeled accessory is secured to said accessory coupler and said accessory coupler is in said first position.

2. The patient transport system according to claim 1, wherein said accessory base and said patient support apparatus are configured such that all of said wheels are outside said accommodation space when said wheeled accessory is secured to said accessory coupler and said accessory coupler is in said second position.

3. The patient transport system according to claim 1, wherein one of said wheels comprises a caster wheel that is swivelable about a swivel axis, and wherein said caster wheel swivels about said swivel axis to define a swivel diameter.

4. The patient transport system according to claim 3, wherein said at least two legs further delineate an opening width into said accommodation space, said opening width being greater than said swivel diameter.

5. The patient transport system according to claim 3, further comprising a second wheeled accessory comprising a second accessory base and at least two second legs that delineate a second opening width into a second accommodation space, said second opening width being smaller than said swivel diameter of said caster wheel.

6. The patient transport system according to claim 1, wherein said wheeled accessory comprises no more than three legs.

7. The patient transport system according to claim 1, wherein said accommodation space of said accessory base is U-shaped.

8. A patient transport system comprising:

a wheeled accessory comprising:

an accessory base;

at least two legs extending outwardly from said base, with at least one accessory wheel coupled to each of said at least two legs; and an accessory post coupled to said accessory base, said accessory post having an accessory post footprint projected downward on a floor surface;

a patient support apparatus comprising:

a patient support base;

a litter supported by said patient support base, said litter comprising a bumper and a deformable cuff that is configured to accommodate said accessory post, said litter also projecting a litter footprint downward on the floor surface; and an accessory coupler capable of releasably securing said wheeled accessory to said patient support apparatus, wherein said accessory coupler is movable relative to said patient support base into a first position and a second position, wherein said patient support apparatus and said wheeled accessory are configured such that said accessory post footprint is at least partially within said litter footprint when said accessory coupler is in said first position and secured to said wheeled accessory, and configured such that said accessory post footprint is not within said litter footprint when said accessory coupler is in said second position and secured to said wheeled accessory.

9. The patient transport system according to claim 8, wherein said wheeled accessory comprises an accessory mount, said accessory post extending upwards from said accessory mount.

10. The patient transport system according to claim 8, wherein said deformable cuff comprises an hourglass cross-sectional shape configured to allow said accessory post to tilt within said deformable cuff.

11. The patient transport system according to claim 8, wherein said deformable cuff is axially slidable along said accessory post.

12. A patient transport system comprising: a wheeled accessory comprising: an accessory base; at least two legs radially extending outwardly from said accessory base, said at least two legs spaced apart from one another to define an accommodation space between said at least two legs, and an accessory post coupled to said accessory base; a patient support apparatus comprising: a patient support base, a patient support surface supported by said patient support base, and a bumper comprising a deformable cuff that is configured to accommodate said accessory post; wheels coupled to said patient support base; and an accessory coupler capable of releasably securing said wheeled accessory to said patient support apparatus, wherein said accessory coupler is movable relative to said patient support base into a first position and a second position, wherein said accessory base and said patient support apparatus are configured such that at least one of said wheels is at least partially nested within said accommodation space when said deformable cuff accommodates said accessory post when said accessory coupler is secured to said wheeled accessory and is in said first position.

13. A patient transport system comprising:

a wheeled accessory comprising:

an accessory base;

at least two legs extending outwardly from said base;

at least one accessory wheel coupled to each of said legs;

wherein at least one of said legs comprises at least two feet, with at least one of said accessory wheels coupled to each of said feet; and an accessory post coupled to said accessory base, said accessory post having an accessory post footprint projected downward on a floor surface;

a patient support apparatus comprising:

a patient support base;

a litter supported by said patient support base, said litter comprising a litter footprint projected downward on the floor surface; and an accessory coupler capable of releasably securing said wheeled accessory to said patient support apparatus, wherein said accessory coupler is movable relative to said patient support base into a first position and a second position, wherein said patient support apparatus and said wheeled accessory are configured such that said accessory post footprint is at least partially within said litter footprint when said accessory coupler is in said first position and secured to said wheeled accessory, and configured such that said accessory post footprint is not within said litter footprint when said accessory coupler is in said second position and secured to said wheeled accessory.

* * * * *